US008173343B2

(12) United States Patent
Nakamori

(10) Patent No.: US 8,173,343 B2
(45) Date of Patent: May 8, 2012

(54) ELECTROPHOTOGRAPHIC PHOTOCONDUCTOR, IMAGE FORMING APPARATUS USING THE SAME, AND PROCESS CARTRIDGE

(75) Inventor: Hideo Nakamori, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 525 days.

(21) Appl. No.: 12/427,955

(22) Filed: Apr. 22, 2009

(65) Prior Publication Data

US 2010/0015538 A1 Jan. 21, 2010

(30) Foreign Application Priority Data

Jul. 15, 2008 (JP) ..... 2008-183932

(51) Int. Cl.
*G03G 15/06* (2006.01)

(52) U.S. Cl. ..... 430/66; 430/57.1; 430/58.75

(58) Field of Classification Search ..... 430/57.1, 430/58.75, 66
See application file for complete search history.

(56) References Cited

U.S. PATENT DOCUMENTS

| | | | |
|---|---|---|---|
| 3,873,312 | A | 3/1975 | Contois et al. |
| 4,727,009 | A | 2/1988 | Takai |
| 7,267,916 | B2 | 9/2007 | Sugino et al. |
| 7,314,693 | B2 | 1/2008 | Ikegami et al. |
| 7,486,914 | B2 | 2/2009 | Kabata et al. |
| 2007/0019989 | A1 | 1/2007 | Nakamori |
| 2007/0059618 | A1 | 3/2007 | Kurimoto et al. |
| 2007/0287083 | A1 | 12/2007 | Gondoh et al. |
| 2008/0112742 | A1 | 5/2008 | Nakamori et al. |
| 2008/0113285 | A1 | 5/2008 | Nakamori et al. |
| 2008/0219694 | A1 | 9/2008 | Nakamori et al. |

FOREIGN PATENT DOCUMENTS

| | | |
|---|---|---|
| EP | 1 921 507 A2 | 5/2008 |
| EP | 1 921 507 A3 | 5/2008 |
| JP | 53-133444 | 12/1978 |
| JP | 55-157748 | 12/1980 |
| JP | 57-30846 | 2/1982 |
| JP | 58-57739 | 12/1983 |
| JP | 2-4275 | 1/1990 |
| JP | 4-281461 | 10/1992 |
| JP | 7-244389 | 9/1995 |
| JP | 8-82941 | 3/1996 |
| JP | 2552695 | 8/1996 |
| JP | 2000-66434 | 3/2000 |
| JP | 3085077 | 7/2000 |
| JP | 3286711 | 3/2002 |

(Continued)

OTHER PUBLICATIONS

Machine English language translation of JP 2004-233955, Aug. 19, 2004.*

*Primary Examiner* — Hoa V Le
(74) *Attorney, Agent, or Firm* — Oblon, Spivak, McClelland, Maier & Neustadt, L.L.P.

(57) ABSTRACT

The present invention provides an electrophotographic photoconductor which includes at least a photosensitive layer and a surface protective layer over a support, wherein the surface protective layer contains a filler, a charge transporting material and a specific compound; and the photosensitive layer contains at least a charge transporting material; the charge transporting material contained in the photosensitive layer has an oxidation potential lower than the oxidation potential of the charge transporting material contained in the surface protective layer and is a specific compound.

18 Claims, 7 Drawing Sheets

FOREIGN PATENT DOCUMENTS

| | | |
|---|---|---|
| JP | 2004-2874 | 1/2004 |
| JP | 3568431 | 6/2004 |
| JP | 2004-233955 | 8/2004 |
| JP | 3624706 | 12/2004 |
| JP | 2005-154319 | 6/2005 |
| JP | 3694591 | 7/2005 |
| JP | 3720927 | 9/2005 |
| JP | 4071653 | 1/2008 |

* cited by examiner

ELECTROPHOTOGRAPHIC PHOTOCONDUCTOR, IMAGE FORMING APPARATUS USING THE SAME, AND PROCESS CARTRIDGE

BACKGROUND OF THE INVENTION

1. Field of the Invention

The present invention relates to an electrophotographic photoconductor used in image formation based on electrophotography, for example, in copiers, electrostatic printing, printers, facsimiles, and electrostatic recording. The present invention also relates to an image forming apparatus using the electrophotographic photoconductor and a process cartridge using the electrophotographic photoconductor.

2. Description of the Related Art

Information processing systems using electrophotography are making remarkable progress recently. Particularly, laser printers and digital multifunction processing machines, in which information is converted into digital signals and recorded by means of light, have been extremely improved in terms of printing quality and reliability. Further, technologies used in these laser printers and digital copiers are applied to laser printers and digital copiers capable of printing full-color images by merging with high-speed printing technologies. For the above reasons, photoconductors (otherwise referred to herein as a "photoconductor") used for such laser printers and digital copiers are required both to produce high quality images and to have high durability.

Photoconductors (OPCs) using organic photoconductive materials are widely used for laser printers and digital copiers using electrophotography, due to their cost, manufacturability, and non-polluting properties. The organic photoconductors (OPCs) are generally classified into (1) organic photoconductors using a photoconductive resin typified by polyvinyl carbazole (PVK), (2) photoconductors using a charge-transfer complex typified by PVK-TNF (2,4,7-trinitrofluorenone), (3) pigment dispersion type photoconductors using a pigment typified by phthalocyanine-binder, and (4) function-separated photoconductors in which a charge generating layer containing a charge generating material is combined with a charge transporting layer containing a charge transporting material.

However, each photosensitive layer of the organic photoconductors (OPCs) is easily peeled off by repetitive use, and therefore the potential of the photoconductors tends to decrease and the photosensitivity tends to degrade. Further, a scratch on a surface of the photoconductor tends to cause background smear, and degradation in image density and quality of the resultant images. Therefore, improvement of abrasion resistance of the organic photoconductors has been an important subject. Further, improvement of durability of the organic photoconductors has become a more important subject recently, in accordance with speeding up of the printing speed and the reduction in diameter of the photoconductors accompanied by downsizing of an image forming apparatus.

As a method of improving the abrasion resistance of photoconductors, there are known methods of providing a surface protective layer as its outermost surface layer of a photoconductor and imparting lubricity to the outermost surface layer, hardening the outermost surface layer, or incorporating a filler into the outermost surface layer. However, another problem occurs when these methods are used to prevent the abrasion of the photoconductor. Specifically, oxidized gases, such as ozone and NOx arising due to use conditions or environment, adhere to the surface of the photosensitive layer and decrease the surface resistance thereof, resulting in a problem such as blurring of the resultant images. Of these methods, the method of incorporating a filler into a surface protective layer is one of the effective methods to impart high-durability to photoconductors (see Japanese Patent Application Laid-Open (JP-A) Nos. 53-133444, 55-157748, 57-30846, 2-4275, 4-281461, and 2000-66434).

However, when a filler is incorporated into the surface protective layer for the sake of imparting high-durability to the photoconductor, the residual potential is conspicuously increased due to increased electrical resistance. The increase in residual potential is greatly affected by an increase of electrical resistance caused by the incorporation of the filler and an increase of charge trap sites. Meanwhile, when a conductive filler is used in the surface protective layer, the outline of an image is blurred, i.e., so-called image blur is caused, resulting in a significant influence upon the image quality, although the electrical resistance is reduced and the influence on the increase in residual potential is relatively small.

It is known that when the method of incorporating a filler into the surface protective layer is employed in order to reduce abrasion of the photosensitive layer, ozone, NOx or other oxidative substances caused by the repetitive use of the photoconductor and the environment surrounding the photoconductor adsorb onto the surface protective layer, and the electrical resistance of the photoconductor decreases depending on the frequency of use and the use environment, causing a problem such as image flow (image blur), etc.

So far, such a problem has been avoided to some extent because the substances causing the blurred images are gradually scraped off in accordance with the abrasion of the surface protective layer. However, in order to comply with the above-described recent demand for higher sensitivity and durability of photoconductors, a new technique must be provided. In order to decrease the influence of substances causing the blurred images, a method of adding an additive such as an antioxidant in the surface protective layer is effective, however, the additive typically does not have photoconductivity, and therefore the addition of much amount thereof in the surface protective layer causes problems such as degradation of sensitivity and increase of residual potential of the resultant photoconductor.

To reduce the occurrence of image blurring, the photoconductor is preferred to have higher surface resistance. Meanwhile, to suppress the decrease in initial residual potential of the photoconductor and the increase in residual potential in repetitive use thereof, the surface of the photoconductor and the film itself are preferred to have lower resistance. For this reason, there is a trade-off relation therebetween, which makes it difficult to solve the problem.

The increase in residual potential which is often observed when a filler having high insulating property is used in a surface protective layer of a photoconductor leads to a high-electric potential at bright areas in the image forming apparatus, causing degradation of image density and gray-scale properties. To compensate for the high-electric potential at bright areas, there is a need to increase the electric potential at dark areas in the image forming apparatus. However, when the electric potential is increased at dark areas in an image forming apparatus, the intensity of the electric field is increased, leading to not only an image defect, such as background smear, but also the shortening of the longevity of the photoconductor.

For this reason, it is hard to use a filler having high insulation property. Thus, a filler having a low insulating property, which has relatively less influence on the residual potential, is usually used, and in order to prevent blurred images caused thereby, a method of mounting a drum heater for heating a photoconductor is used. Although the occurrence of image blurring can be reduced by heating the photoconductor, this poses a great obstacle to the downsizing of an image forming apparatus, reduction of power consumption, and shortening of the start-up time of an image forming apparatus.

Recently, full color image forming apparatuses each using a roller charging unit and enabling energy-saving operation with less ozone generation and enabling its compactness are most commonly used. However, in order to achieve image forming apparatuses having higher durability and enabling higher speed operation, a fresh look has been taken at non-contact charging units utilizing corona discharge, which have been conventionally used. However, the charging unit utilizing corona discharge cause a generation amount of discharge products (ozone, NOx, etc.) greater than the roller charging units cause. When a photoconductor containing a filler in the outermost surface layer is used in an attempt to achieve high durability, image blur is liable to occur.

Further, for the purpose of achieving high image quality, image forming apparatuses each equipped with a lubricant supplying unit that applies a lubricant to a surface of an electrophotographic photoconductor so as to reduce the friction coefficient have been proposed in which the image transfer rate is increased to thereby reduce the occurrence of character dropout and transfer nonuniformity of solid images. Such an image forming apparatus that employs a lubricant supplying unit has another advantage in that the abrasion loss of the photoconductor and the occurrence of photoconductor filming can be reduced, thereby realizing longer operation life of the photoconductor. In order to achieve further higher-durability of a photoconductor, use of a lubricant supplying unit in combination with a photoconductor containing a filler in its surface protective layer makes it possible to achieve much higher-durability than that of a photoconductor containing no filler in its surface protective layer, because the resistance to abrasion of the photoconductor caused by a variation of an amount of lubricant applied by the lubricant supplying unit and the scratch resistance of the photoconductor surface are more improved than those of the photoconductor containing no filler in its surface protective layer. In the meanwhile, the problem with image blur has been avoided to some extent because substances causing blurred images are gradually scraped off in accordance with the abrasion of the surface protective layer. However, in the image forming process where the photoconductor surface is hardly scraped off, in order to achieve further higher-durability of photoconductors, stability of electrostatic properties, i.e., suppression of an increase in residual potential, is required for, in addition to the image blur resistance and the abrasion resistance.

As mentioned above, in use of a photoconductor that contains a filler in its surface protective layer serving as the outermost surface thereof for the purpose of achieving higher-durability, an effective method whereby problems with the reduction in initial residual potential, the increase in residual potential due to repetitive use, and occurrence of image blurring can be solved all together has not yet been found out so far. Thus, in reality, the subject of providing high durability to photoconductors and providing high image quality still remains in the field of high-speed image forming apparatus.

BRIEF SUMMARY OF THE INVENTION

The present invention aims to provide an electrophotographic photoconductor containing a filler in its surface protective layer serving as the outermost surface layer, which is capable of realizing higher speed image formation by reducing the initial residual potential, reducing image degradation due to the occurrence of image blurring, and suppressing an increase in residual potential and the occurrence of interface cracking, thereby stably forming a high-quality image even when repeatedly used for a long period of time, and to provide an image forming apparatus using the electrophotographic photoconductor, and a process cartridge using the electrophotographic photoconductor.

The present inventors carried out extensive studies and examinations in order to reduce the initial residual potential and solve the problem with image degradation due to image blur and the problem with an increase in residual potential and have found the following results. Specifically, the present inventors have found that although it has been conventionally considered that when a charge transporting material having a low oxidation potential is contained in a photosensitive layer of a photoconductor, and a charge transporting material having an oxidation potential higher than that of the charge transporting material contained in the photosensitive layer is contained in a surface protective layer of the photoconductor, a difference in oxidation potential of the charge transporting materials contained in each of the photosensitive layer and the surface protective layer forms a barrier to charge injection, leading to a decrease in charge transporting rate and suppression of an increase in residual potential, when a surface protective layer is not so thick in a photoconductor having a layer configuration where a photosensitive layer and the surface protective layer are provided, it is possible to suppress the increase in residual potential and stably form a high-quality image at high-speed even though the photoconductor is repeatedly used.

The present invention is based on the findings of the present inventors. The following are means for solving the aforesaid problems:

<1> An electrophotographic photoconductor including: a support, at least a photosensitive layer, and a surface protective layer, the photosensitive layer and the surface protective layer being laid over the support, wherein the surface protective layer contains a filler, a charge transporting material, and a compound represented by any one of the following General Formulas (1) and (2), and the photosensitive layer contains at least a charge transporting material, and the charge transporting material contained in the photosensitive layer has an oxidation potential lower than the oxidation potential of the charge transporting material contained in the surface protective layer and is a compound represented by the following General Formula (3), General Formula (1)

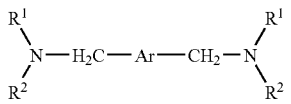

where $R^1$ and $R^2$ may be identical to or different from each other, each represent any one of an alkyl group that may have a substituent and an aryl group that may have a substituent, and at least one of $R^1$ and $R^2$ is an aryl group that may have a substituent. Note that $R^1$ and $R^2$ may be bonded to each other to form a heterocyclic ring containing a nitrogen atom, and the heterocyclic ring may be further substituted with a substituent; and Ar represents an allylene group that may have a substituent, General Formula (2)

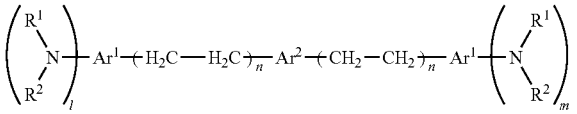

where $R^1$ and $R^2$ may be identical to or different from each other, each represent any one of an alkyl group that may have a substituent and an aryl group that may have a substituent, $R^1$ and $R^2$ may be bonded to each other to form a heterocyclic ring containing a nitrogen atom, and the heterocyclic ring may be further substituted with a substituent;

$Ar^1$ and $Ar^2$ each represent an allylene group that may have a substituent; l and m each represent an integer of 0 to 3, both of which are not zero at the same time; and n is an integer of 1 or 2, General Formula (3)

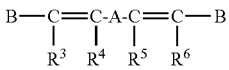

where $R^3$ to $R^6$ each represent any one of a hydrogen atom, an alkyl group having 1 to 4 carbon atoms, an alkoxy group having 1 to 4 carbon atoms, and a phenyl group that may have a substituent; A represents any one of an allylene group that may have a substituent and a substituent represented by the following Structural Formula (3-1), Structural Formula (3-1)

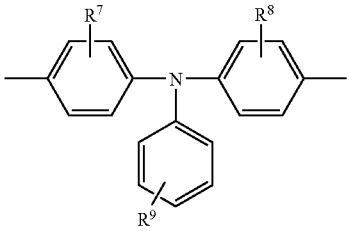

where $R^7$, $R^8$ and $R^9$ each represent any one of a hydrogen atom, an alkyl group having 1 to 4 carbon atoms, an alkoxy group having 1 to 4 carbon atoms, and a phenyl group, the phenyl group may be further substituted with a substituent; and B represents any one of an aryl group that may have a substituent, and a substituent represented by the following Structural Formula (3-2), Structural Formula (3-2)

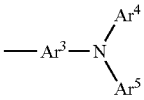

where $Ar^3$ represents an allylene group that may have a substituent; and $Ar^4$ and $Ar^5$ each represent an aryl group that may have a substituent.

<2> The electrophotographic photoconductor according to <1>, wherein the charge transporting material contained in the photosensitive layer is a distyrylbenzene derivative represented by the following General Formula (4), General Formula (4)

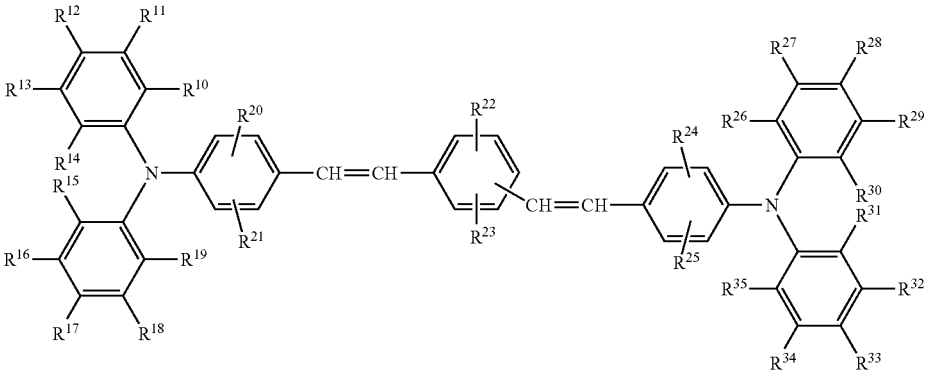

where $R^{10}$ to $R^{35}$ may be identical to or different from each other, and each represent any one of a hydrogen atom, an alkyl group having 1 to 4 carbon atoms, an alkoxy group having 1 to 4 carbon atoms, and a phenyl group that may have a substituent.

<3> The electrophotographic photoconductor according to any one of <1> and <2>, wherein the photosensitive layer contains a charge generating material, and the charge generating material contains a titanylphthalocyanine pigment.

<4> The electrophotographic photoconductor according to <3>, wherein the titanylphthalocyanine pigment has an X-ray diffraction spectrum by a CuKα characteristic X-ray with a wavelength of 1.541 angstrom, having a maximum diffraction peak at least at a Bragg angle of 27.2° among their Bragg angles (2θ±0.2°), main diffraction peaks at Bragg angles of 9.4°, 9.6° and 24.0° and a diffraction peak at the smallest Bragg angle of 7.3°, and having no diffraction peaks at Bragg angles between 7.3° and 9.4° and at 26.3°.

<5> The electrophotographic photoconductor according to any one of <1> to <4>, wherein a difference in oxidation potential between the charge transporting material contained in the surface protective layer and the charge transporting material contained in the photosensitive layer is within the range of 0.01 V to 0.20 V.

<6> The electrophotographic photoconductor according to any one of <1> to <5>, wherein the charge transporting material contained in the surface protective layer has a melting point of 170° C. or lower.

<7> The electrophotographic photoconductor according to any one of <1> to <6>, wherein the amount of the charge transporting material contained in the photosensitive layer is 65 parts by mass or more relative to 100 parts by mass of a resin contained in the photosensitive layer.

<8> The electrophotographic photoconductor according to any one of <1> to <7>, wherein the photosensitive layer contains an additive having a melting point of 150° C. or lower, and the amount of the additive is 2.5 parts by mass to 10 parts by mass relative to 100 parts by mass of the charge transporting material contained in the photosensitive layer.

<9> The electrophotographic photoconductor according to <8>, wherein the additive contained in the photosensitive layer is at least one of compounds having any one of the following Structural Formulas (1) to (3), Structural Formula (1)

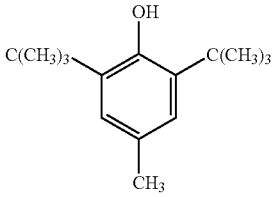

Structural Formula (2)

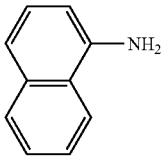

Structural Formula (3)

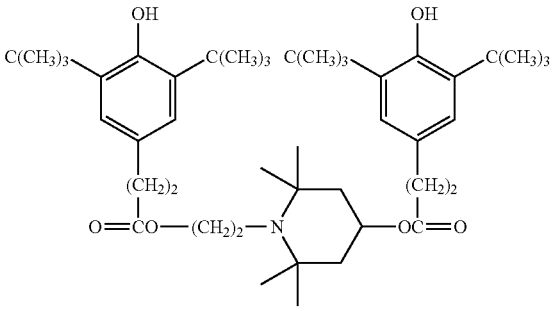

<10> The electrophotographic photoconductor according to any one of <2> to <9>, wherein the charge transporting material contained in the photosensitive layer and represented by any one of General Formulas (3) and (4) has a melting point of 170° C. to 240° C.

<11> The electrophotographic photoconductor according to any one of <1> to <10>, wherein the filler contains at least one selected from metal oxides.

<12> The electrophotographic photoconductor according to any one of <1> to <11>, wherein the filler has an average primary particle diameter of 0.01 μm to 1.0 μm.

<13> The electrophotographic photoconductor according to any one of <1> to <12>, wherein the amount of the filler contained in the surface protective layer is 5% by mass to 50% by mass.

<14> The electrophotographic photoconductor according to any one of <1> to <13>, wherein the surface protective layer contains an organic compound having an acid value of 10 mgKOH/g to 700 mgKOH/g.

<15> The electrophotographic photoconductor according to any one of <1> to <14>, wherein the surface protective layer has a thickness of 0.1 μm to 10 μm.

<16> The electrophotographic photoconductor according to any one of <2> to <15>, wherein the photosensitive layer has a charge generating layer and a charge transporting layer, and the charge transporting layer contains a charge transporting material represented by any one of General Formulas (3) and (4).

<17> An image forming apparatus including: an electrophotographic photoconductor, a charging unit configured to charge a surface of the electrophotographic photoconductor, an exposing unit configured to expose the charged surface of the electrophotographic photoconductor to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the electrophotographic photoconductor is the electrophotographic photoconductor according to any one of <1> to <16>.

<18> The image forming apparatus according to <17>, wherein the exposing unit is one of a semiconductor laser (LD) and a light emitting diode (LED), and a latent electrostatic image is written on the electrophotographic photoconductor in a digital mode, using the exposing unit.

<19> The image forming apparatus according to <17>, wherein the exposing unit employs a multibeam exposure method, where a plurality of exposing areas are exposed using a plurality of beam fluxes.

<20> The image forming apparatus according to <19>, wherein an optical source employed for the multibeam exposure method is composed of four or more plane emitting laser arrays.

<21> The image forming apparatus according to any one of <19> to <20>, wherein an optical source employed for the multibeam exposure method is composed of four or more plane emitting laser arrays, and plane emitting lasers are two-dimensionally arranged.

<22> The image forming apparatus according to any one of <17> to <21>, wherein multi-colored visible images are sequentially superimposed on the electrophotographic photoconductor to form a color image.

<23> The image forming apparatus according to any one of <17> to <22>, having a plurality of the electrophotographic photoconductors, wherein each of monochrome color visible images that have been developed on each of the electrophotographic photoconductors are sequentially superimposed to form a color image.

<24> The image forming apparatus according to any one of <17> to <23>, further having an intermediate transfer unit configured to primarily transfer a visible image that has been developed on the electrophotographic photoconductor to an intermediate transfer member and to secondarily transfer the visible image on the intermediate transfer member onto a recording medium, wherein multi-colored visible images are sequentially superimposed on the intermediate transfer member to form color images, and the color images are secondarily transferred onto a recording medium at a time.

<25> The image forming apparatus according to any one of <17> to <24>, wherein the charging unit is of corona charging unit configured to discharge in a non-contact manner.

<26> A process cartridge detachably mounted to a main body of an image forming apparatus, the process cartridge including:

at least one selected from a charging unit, an exposing unit, a developing unit, a transfer unit, a cleaning unit, and a charge eliminating unit, and an electrophotographic photoconductor, wherein the electrophotographic photoconductor is the electrophotographic photoconductor according to any one of <1> to <16>.

<27> An image forming method including at least:

charging a surface of an electrophotographic photoconductor, exposing the charged surface of the electrophotographic photoconductor to form a latent electrostatic image, developing the latent electrostatic image using a toner to form a visible image, transferring the visible image onto a recording medium, and fixing the transferred image on the recording medium, wherein as the electrophotographic photoconductor, the electrophotographic photoconductor according to any one of <1> to <16> is used.

The electrophotographic photoconductor of the present invention includes a support, and at least a photosensitive layer and a surface protective layer on or above the support, wherein the surface protective layer contains a filler, a charge transporting material, and a compound represented by any one of the above-mentioned General formulas (1) and (2), and the photosensitive layer contains at least a charge transporting material, and the charge transporting material contained in the photosensitive layer has an oxidation potential lower than that of the charge transporting material contained in the surface protective layer and is a compound represented by the above-mentioned General Formula (3), preferably the General Formula (4) described above.

There has been a problem that when a charge transporting material disclosed in Japanese Patent (JP-B) No. 2552695, which has a high electron hole mobility and a low oxidation potential and which is represented by any one of the above-mentioned General Formulas (3) and (4) is contained in a photosensitive layer and a surface protective layer, in order to reduce the initial residual potential, image blur conspicuously occurs due to ozone, NOx or other oxidative substances caused by the repetitive use of the photoconductor and the environment surrounding the photoconductor, and as the oxidation potential of the charge transporting material contained in the surface protective layer lowers, the image blur is liable to occur.

Then, the present inventors have found that even when the photosensitive layer contains a charge transporting material represented by any one of the above-mentioned General Formulas (3) and (4), incorporation of a charge transporting material having an oxidation potential higher than that of the charge transporting material contained in the photosensitive layer and incorporation of a compound represented by any one of the above-mentioned General Formulas (1) and (2) makes it possible to prevent the occurrence of image blurring as well as an increase in residual potential caused by repetitive use. In other words, the present inventors have found that it is possible to reduce the initial residual potential, to prevent the occurrence of image degradation due to image blur and to suppress an increase in residual potential in a photoconductor containing a filler in its surface protective layer for the purpose of imparting high-durability thereto by incorporating a charge transporting material and a compound represented by any one of the above-mentioned General Formulas (1) and (2) in the surface protective layer and incorporating a charge transporting material which has an oxidation potential lower than that of the charge transporting material contained in the surface protective layer and is represented by any one of the above-mentioned General Formulas (3) and (4).

In order to achieve high durability of an electrophotographic photoconductor, it is effective to provide, as an outermost surface layer, a surface protective layer containing a filler to a conventional photoconductor. However, as described above, inconveniently, such an electrophotographic photoconductor easily cause image degradation such as an increase in residual potential and the occurrence of image blurring. The present inventors have also found that even in an image forming apparatus provided with an electrophotographic photoconductor containing a filler in its surface protective layer in view of the longer operation life thereof, in combination with a charging unit using corona discharge, it is possible to prevent reduction in image density near the charging unit under a high-humidity condition and to prevent image degradation due to image blur by incorporating a compound represented by any one of the General Formulas (1) and (2) as disclosed in Japanese Patent Application (JP-A) Nos. 2004-233955 and 2004-264788 so as to impart, to the electrophotographic photoconductor, resistance not only to oxidized gases and substances arising from surrounding environment but also to oxidized gases and substances arising from the charging unit.

The reason why the resistance of the electrophotographic photoconductor to oxidized gases and substances can be improved by incorporating a compound represented by any one of the General Formulas (1) and (2) is not clearly understood at the present time, however, it is presumed that a substituted amino groups included in the structure of the compound prevents the generation of radical materials effective for preventing oxidized gases. Further, since the compound represented by any one of the General Formulas (1) and (2) also has charge transportability, the compound itself does not work as a trap of the charge carrier, and degradation of the electric properties associated with the addition thereof, such as an increase of residual potential, is hardly observed.

Further, by incorporating distyrylbenzene derivatives in the photosensitive layer, and incorporating a filler, distyrylbenzene derivatives and a compound represented by any one of the above-mentioned General Formulas (1) and (2) in the surface protective layer, it is possible to reduce the initial residual potential and to suppress the increase in residual potential when the electrophotographic photoconductor is repeatedly used. The reason that the residual potential can be reduced by the use of distyrylbenzene derivatives is that distyrylbenzene derivatives have significantly high electric charge mobility, and electric field strength dependency of the charge mobility is small, etc. In other words, it is possible to move electric charge satisfactorily even with low electric field strength and to reduce residual potential. The high-electric charge mobility exhibited by distyrylbenzene derivatives is considered because distyrylbenzene derivatives are characterized by having large-size molecules whose structure is straight-chain, a plurality of triphenylamine structures and styryl structures in the molecule structure, and also having extended n-conjugated system which is extended to the overall molecules, thereby in the transfer of electric charge, the rate of intramolecular transfer becomes higher than the rage of intermolecular transfer. The suppression of the increase in residual potential is attributable to the low oxidation potential of distyrylbenzene derivatives, and thus the barrier to charge injection from a charge generating material contained in the photosensitive layer is lowered and photo carriers hardly remains in the surface protective layer.

However, it turned out that when distyrylbenzene derivatives are used in the surface protective layer of the photoconductor as described above, image blur due to ozone, NOx or other oxidative substances caused by the repetitive use of the photoconductor and the environment surrounding the photoconductor. From the studies obtained in the present invention, it is presumed that this phenomenon is attributable from the low oxidation potential. As described above, since distyrylbenzene derivatives have characteristics of having large-size molecules whose structure is straight-chain, a plurality of triphenylamine structures and styryl structures in the molecule structure, and also having extended n-conjugated system which is extended to the overall molecules, the oxidation potential is lowered. That is, it can be considered that because of the low oxidation potential, distyrylbenzene derivatives are vulnerable to chemical attack from ozone, NOx or other oxidative substances caused by the repetitive use of the photoconductor and the environment surrounding the photoconductor, thereby the resistance of the photoconductor surface is lowered, leading to image blur of a latent electrostatic image.

Since a photoconductor having a surface protective layer containing a filler easily has a high residual potential, it has been considered that in order to reduce the residual potential, the oxidation potential of a charge transporting material used for the photosensitive layer is required to be equal to the oxidation potential of a charge transporting material used for the surface protective layer or the oxidation potential of the charge transporting material used for the surface protective layer is required to be lower than that of the charge transporting material used for the photosensitive layer, i.e., it is necessary not to form a barrier to charge injection between the photosensitive layer and the surface protective layer.

However, it was found that even though the oxidation potential of the charge transporting material of the surface protective layer is made to be greater than that of distyrylbenzene derivatives contained in the photosensitive layer, the residual potential increases or rarely varies, unless the film thickness of the surface protective layer is sufficiently thick. The occurrence of image blurring depends on the oxidation potential of the charge transporting material of the surface protective layer and can be suppressed by increasing the oxidation potential of the charge transporting material of the surface protective layer. Furthermore, by reducing the initial residual potential of the photoconductor containing a filler at the outermost surface layer, it has become possible to form an image at higher speed, to prevent image degradation due to image blur and to suppress an increase in residual potential in repetitive use of the photoconductor.

When a difference in oxidation potential between the charge transporting material contained in the surface protective layer and the charge transporting material contained in the photosensitive layer is within the range of 0.01 V to 0.20 V, the initial residual potential of the photoconductor lowers, the increase in residual potential during repetitive use can be suppressed, and the preventive effect of the occurrence of image blurring caused from the surface protective layer can be obtained.

The charge transporting material of the photosensitive layer, which is represented by any one of the General Formulas (3) and (4), has a melting point of 170° C. or higher, an extended molecular structure where n-electron conjugated system where the molecules externally extend, and high-crystallinity. Thus, when a surface protective layer is provided using the charge transporting material, cracks may be found at the interface between the photosensitive layer and the surface protective layer. It is preferable to prevent the occurrence of cracks at the interface because there is a concern that serious cracks may appear on an image, and the surface protective layer of the photoconductor may peel off during repetitive use of the photoconductor. The occurrence of interface cracks is presumed primarily attributable to a difference in plasticity, caused by a difference of thermal properties of the charge transporting materials, between the photosensitive layer and the surface protective layer. The present inventors have found that such interface cracks can be suppressed by improving the plasticity of the photosensitive layer or the surface protective layer. More specifically, such interface crack can be suppressed by setting the additive amount of the charge transporting material in the photosensitive layer to 65% by mass or more relative to the amount of the resin used therein, or by adding a low-molecular weight additive having a melting point of 150° C. or lower in an amount of 2.5 parts by mass to 10 parts by mass relative to 100 parts by mass of the charge transporting material contained in the photosensitive layer. Further, by incorporating, as a low-molecular weight additive, at least one of compounds having a melting point of 150° C. or lower and each represented by any one of the following Structural Formulas (1) to (3), in the photosensitive layer, not only a preventive effect of the occurrence of interface cracks, but also the occurrence of image blurring can be reduced, thereby a long lived photoconductor can be achieved.

Structural Formula (1)

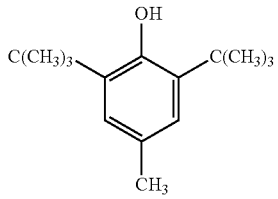

Structural Formula (2)

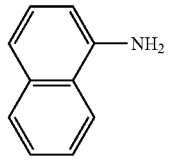

Structural Formula (3)

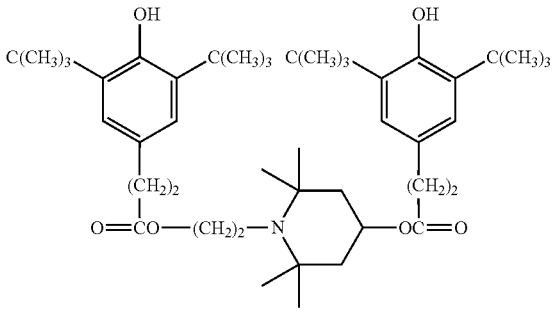

The present inventors have also found that the preventive effect of the occurrence of interface cracks can be more increased by using, as a charge transporting material for the surface protective layer, a charge transporting material whose oxidation potential is higher than that of a charge transporting material used for the photosensitive layer and further, by selecting a charge transporting material having a melting point of 170° C. or lower, for the surface protective layer.

Accordingly, in the present invention, by taking the above-mentioned configuration, it has become possible to provide an electrophotographic photoconductor capable of preventing the occurrence of cracks and stably forming a high-quality image at high speed even in repetitive use for a long period of time, a highly durable image forming apparatus using the electrophotographic photoconductor as well as a process cartridge using the electrophotographic photoconductor.

The image forming apparatus of the present invention includes an electrophotographic photoconductor, and also includes at least a latent electrostatic image forming unit configured to form a latent electrostatic image on the electrophotographic photoconductor, a developing unit configured to develop the latent electrostatic image using a toner so as to form a visible image, a transfer unit configured to transfer the visible image onto a recording medium, and a fixing unit configured to fix the transferred image on the recording medium. As the electrophotographic photoconductor, the electrophotographic photoconductor of the present invention is used.

In the image forming apparatus of the present invention, the latent electrostatic image forming unit forms a latent electrostatic image. The developing unit develops the latent electrostatic image formed on the electrophotographic photoconductor using a toner to form a visible image. The transfer unit transfers the visible image onto a recording medium. The fixing unit fixes the transferred image on the recording medium. In the image formation, the electrophotographic photoconductor of the present invention is used as the electrophotographic photoconductor, and thus image degradation due to image blur and an increase in residual potential can be prevented, and a high-quality image can be formed with stability even in repetitive use for a long period of time.

The image forming method of the present invention includes at least a latent electrostatic image forming step in which a latent electrostatic image is formed on an electrophotographic photoconductor; a developing step in which the electrostatic image is developed using a toner to form a visible image; a transferring step in which the visible image is transferred onto a recording medium; and a fixing step in which the transferred image is fixed on the recording medium. As the electrophotographic photoconductor, the electrophotographic photoconductor of the present invention is used.

According to the image forming method of the present invention, in the latent electrostatic image forming step, a latent electrostatic image is formed on the electrophotographic photoconductor; in the developing step, the latent electrostatic image formed on the electrophotographic photoconductor is developed using a toner to form a visible image; in the transferring step, the visible image is transferred onto a recording medium; and in the fixing step, the transferred image is fixed on the recording medium. In the image formation, the electrophotographic photoconductor of the present invention is used as the electrophotographic photoconductor, and thus image degradation due to image blur and an increase in residual potential can be prevented, and a high-quality image can be formed with stability even when the electrophotographic photoconductor is repeatedly used for a long period of time.

The process cartridge of the present invention includes at least an electrophotographic photoconductor and a developing unit configured to develop a latent electrostatic image formed on the electrophotographic photoconductor using a toner to form a visible image. The process cartridge is detachably mounted on an image forming apparatus, is superior in user-friendliness, and is capable of preventing image degradation due to image blur and an increase in residual potential and also capable of forming a high-quality image with stability even in repetitive use for a long period of time because the electrophotographic photoconductor of the present invention is used therein.

According to the present invention, it is possible to solve the problems in related art and to achieve higher-speed image formation by suppressing the initial residual potential of an electrophotographic photoconductor containing a filler in a surface protective layer as an outermost surface layer. Further, the present invention can provide an electrophotographic photoconductor capable of preventing image degradation due to image blur, suppressing an increase in residual potential, suppressing interface cracks and stably forming a high-quality image even in repetitive use for a long period of time; an image forming apparatus using the electrophotographic photoconductor; and a process cartridge using the electrophotographic photoconductor.

Figure 1:
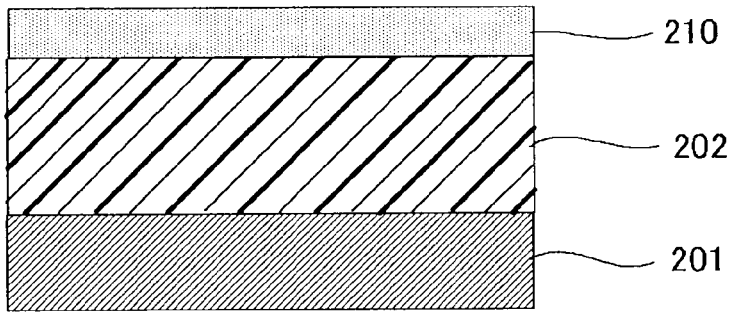
FIG. 1 is a schematic cross-sectional diagram showing one example of a single-layer type electrophotographic photoconductor according to the present invention.

DETAILED DESCRIPTION OF THE INVENTION (Electrophotographic Photoconductor)

An electrophotographic photoconductor of the present invention has a support, at least a photosensitive layer and a surface protective layer over the support, and further has other layers in accordance with the intended use.

In the present invention, the surface protective layer contains a filler, a charge transporting material, and a compound represented by any one of the following General Formulas (1) and (2), and further contains other components in accordance with the necessity. Further, the photosensitive layer contains at least a charge transporting material having an oxidation potential lower than that of the charge transporting material contained in the surface protective layer, a compound represented by any one of the following General Formulas (3) and (4), and further contains other components in accordance with the necessity. With this, the initial residual potential can be reduced, and the occurrence of image degradation due to image blur and an increase in residual potential can be prevented.

General Formula (1)

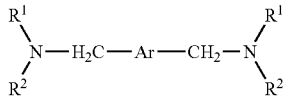

In General Formula (1), $R^1$ and $R^2$ may be identical to or different from each other, each represent any one of an alkyl group that may have a substituent and an aryl group that may have a substituent, and at least one of $R^1$ and $R^2$ is an aryl group that may have a substituent. Note that $R^1$ and $R^2$ may be bonded to each other to form a heterocyclic ring containing a nitrogen atom, and the heterocyclic ring may be further substituted with a substituent; and Ar represents an allylene group that may have a substituent.

General Formula (2)

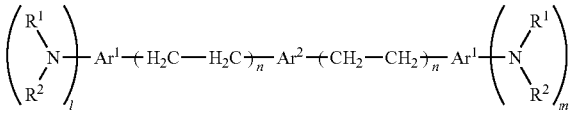

In General Formula (2), $R^1$ and $R^2$ may be identical to or different from each other, each represent any one of an alkyl group that may have a substituent and an aryl group that may have a substituent, $R^1$ and $R^2$ may be bonded to each other to form a heterocyclic ring containing a nitrogen atom, and the heterocyclic ring may be further substituted with a substituent; $Ar^1$ and $Ar^2$ each represent an allylene group that may have a substituent; l and m each represent an integer of 0 to 3, both of which are not zero at the same time; and n is an integer of 1 or 2.

General Formula (3)

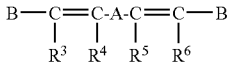

In General Formula (3), $R^3$ to $R^6$ each represent any one of a hydrogen atom, an alkyl group having 1 to 4 carbon atoms, an alkoxy group having 1 to 4 carbon atoms, and a phenyl group that may have a substituent; A represents any one of an allylene group that may have a substituent and a substituent represented by the following Structural Formula (3-1).

Structural Formula (3-1)

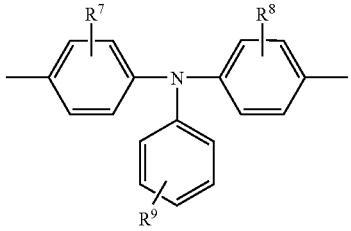

In Structural Formula (3-1), $R^7$, $R^8$ and $R^9$ each represent any one of a hydrogen atom, an alkyl group having 1 to 4 carbon atoms, an alkoxy group having 1 to 4 carbon atoms, and a phenyl group, the phenyl group may be further substituted with a substituent; and B represents any one of an aryl group that may have a substituent, and a substituent represented by the following Structural Formula (3-2).

Structural Formula (3-2)

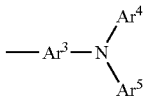

In Structural Formula (3-2), $Ar^3$ represents an allylene group that may have a substituent; and $Ar^4$ and $Ar^5$ each represent an aryl group that may have a substituent.

General Formula (4)

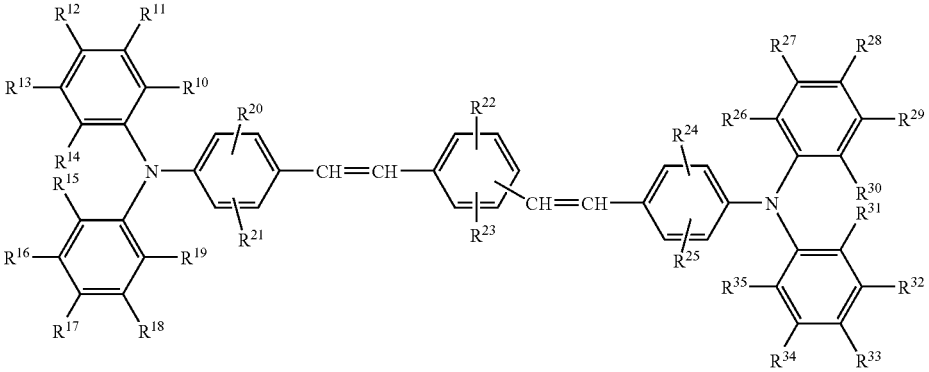

In General Formula (4), $R^{10}$ to $R^{35}$ may be identical to or different from each other, and each represent any one of a hydrogen atom, an alkyl group having 1 to 4 carbon atoms, an alkoxy group having 1 to 4 carbon atoms, and a phenyl group that may have a substituent.

—Layer Configuration—

The layer configuration of the electrophotographic photoconductor is not particularly limited and may be suitably selected in accordance with the intended use. A first embodiment of the electrophotographic photoconductor has a support, a single-layer photosensitive layer (otherwise referred to as "single-layer type photosensitive layer") and a surface protective layer over the support, and has other layers, such as an undercoat layer, in accordance with the necessity. A second embodiment of the electrophotographic photoconductor has a support, a photosensitive layer (otherwise referred to as "multi-layered type photosensitive layer") having a structure where a charge generating layer and a charge transporting layer are laminated, and a surface protective layer over the support, and has other layers, such as an undercoat layer, in accordance with the necessity. Note that in the second embodiment, the charge generating layer and the charge transporting layer may be laminated in the reverse order.

Figure 2:
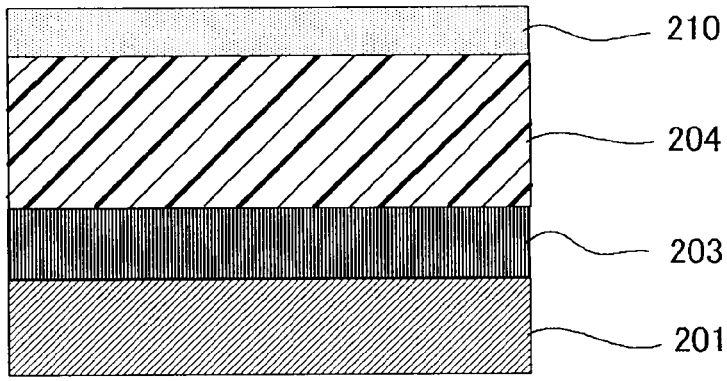
FIG. 2 is a schematic cross-sectional diagram showing one example of a multi-layered type electrophotographic photoconductor according to the present invention.
Figure 3:
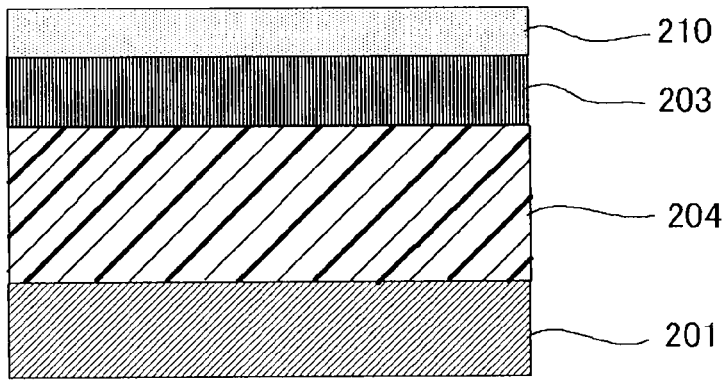
FIG. 3 is a schematic cross-sectional diagram showing another example of a multi-layered type electrophotographic photoconductor according to the present invention.

Hereinbelow, the electrophotographic photoconductor will be explained with reference to the accompanying drawings. FIGS. 1 to 3 are each a schematic cross-sectional diagram showing one example of the electrophotographic photoconductor according to the present invention.

In an electrophotographic photoconductor shown in FIG. 1, a photosensitive layer 202 containing a charge transporting material represented by any one of General Formulas (3) and (4), preferably containing at least one of compounds represented by any one of Structural Formulas (1) to (3) is laid on a support 201 and a surface protective layer 210 is laid on the photosensitive layer 202. The surface protective layer 210 contains a filler, a charge transporting material, and a compound represented by any one of General Formulas (1) and (2).

In an electrophotographic photoconductor shown in FIG. 2, a charge generating layer 203 containing a charge generating material and a charge transporting layer 204 containing a charge transporting material represented by any one of General Formulas (3) and (4), preferably containing at least one of compounds represented by any one of Structural Formulas (1) to (3) are laid over a support 201 in this order, and further a surface protective layer 210 is laid on a surface of the charge transporting layer 204. The surface protective layer 210 contains a filler, a charge transporting material, and a compound represented by any one of General Formulas (1) and (2).

In an electrophotographic photoconductor shown in FIG. 3, a charge transporting layer 204 containing a charge transporting material represented by any one of General Formulas (3) and (4), preferably containing at least one of compounds represented by any one of Structural Formulas (1) to (3), and a charge generating layer 203 containing a charge generating material are laid over a support 201 in this order, and further a surface protective layer 210 is laid on a surface of the charge generating layer 203. The surface protective layer 210 contains a filler, a charge transporting material, and a compound represented by any one of General Formulas (1) and (2).

<Surface Protective Layer>

The surface protective layer is provided as the outermost surface layer of the electrophotographic photoconductor in view to protecting the photosensitive layer and improving the durability. The surface protective layer contains a filler, a charge transporting material having an oxidation potential higher than the oxidation potential of the charge transporting material contained in the photosensitive layer and represented by any one of General Formulas (3) and (4), preferably contains a binder resin, an organic compound having an acid value of 10 mgKOH/g to 700 mg KOH/g, and further contains other components in accordance with the necessity.

General Formula (1)

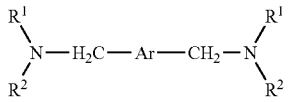

In General Formula (1), $R^1$ and $R^2$ may be identical to or different from each other, each represent any one of an alkyl group that may have a substituent and an aryl group that may have a substituent, and at least one of $R^1$ and $R^2$ is an aryl group that may have a substituent. Note that $R^1$ and $R^2$ may be bonded to each other to form a heterocyclic ring containing a nitrogen atom, and the heterocyclic ring may be further substituted with a substituent; an Ar represents an allylene group that may have a substituent.

General Formula (2)

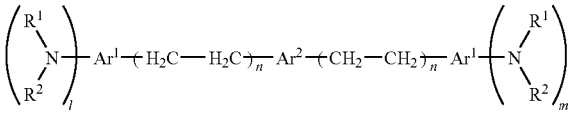

In General Formula (2), $R^1$ and $R^2$ may be identical to or different from each other, each represent any one of an alkyl group that may have a substituent and an aryl group that may have a substituent, $R^1$ and $R^2$ may be bonded to each other to form a heterocyclic ring containing a nitrogen atom, and the heterocyclic ring may be further substituted with a substituent; $Ar^1$ and $Ar^2$ each represent an allylene group that may have a substituent; l and m each represent an integer of 0 to 3, both of which are not zero at the same time; and n is an integer of 1 or 2.

—Filler—

As the filler, an organic filler or an inorganic filler is used. Examples of the organic filler include fluororesin powders such as polytetrafluoroethylene; silicone resin powders, and a-carbon powders. Examples of the inorganic filler include metal powders such as tin, aluminum, and indium; metal oxides such as silica, tin oxide, zinc oxide, titanium oxide, alumina, zirconium oxide, indium oxide, antimony oxide, bismuth oxide, calcium oxide, antimony-doped tin oxide, and tin-doped indium oxide; metal fluorides such as tin fluoride, calcium fluoride, and aluminum fluoride; potassium titanate, and boron nitride. Of these, from the viewpoint of hardness of the filler, it is advantageous to use an inorganic filler because the abrasion resistance of the resulting photoconductor can be improved.

Further, as a filler that is less likely to cause so-called image blur, a filler having high electric insulation property is preferred. As such a filler, it is particularly effective to use a filler having a pH value of 5 or higher or a filler having a dielectric constant of 5 or higher. Examples thereof include metal oxides such as titanium oxide, alumina, zinc oxide, and zirconium oxide. Further, a filler having a pH value of 5 or higher or a filler having a dielectric constant of 5 or higher may be used alone, two or more of fillers each having a pH value of 5 or lower and fillers each having a pH value of 5 or higher may be used in combination, or two or more of fillers each having a dielectric constant of 5 or lower and fillers each having a dielectric constant of 5 or higher may be used in combination. Of these fillers, α-type alumina having a hexagonal close-packed structure, which has high-insulation property, high-thermal stability, and high abrasion resistance, is particularly useful in terms of preventing the occurrence of image blurring and improving the abrasion resistance of the resulting photoconductor.

Use of a filler having a low dispersibility causes not only an increase in residual potential but also degradation of transparency of the outermost surface layer, occurrence of a defective coated film, and degradation of abrasion resistance, and thus the filler is preferably surface treated with at least one surface treatment agent.

The surface treatment agent is not particularly limited and may be suitably selected from conventionally used surface treatment agents in accordance with the intended use. However, surface treatment agents capable of maintaining the insulation property of the filler. For example, titanate coupling agents, aluminum coupling agents, zirconium-aluminum coupling agents, higher fatty acids, or mixtures of these agents and silane coupling agents; $Al_2O_3$, $TiO_2$, $ZrO_2$, silicon, aluminum stearate or mixtures thereof are more preferable in terms of the dispersibility of the filler and preventing the occurrence of image blurring. The surface treatment with the silane coupling agent relatively adversely affects the occurrence of image blurring, but the affect may be suppressed by mixing the surface treatment agents with the silane coupling agent. The use amount of the surface treatment agent(s) varies depending on the average primary particle diameter of a filler used, however, it is preferably 3% by mass to 30% by mass, and more preferably 5% by mass 20% by mass. When the use amount of the surface treatment agent(s) is less than 3% by mass, the dispersing effect of the filler is not obtained, and when more than 30% by mass, the residual potential may significantly increase.

The average primary particle diameter of the filler is preferably 0.01 μm to 1.0 μm, and more preferably 0.05 μm to 0.8 μm. When the average primary particle diameter is smaller than 0.01 μm, degradation of abrasion resistance, degradation of dispersibility of the filler and the like may be caused. When it is larger than 1.0 μm, the sedimentation property of the filler may be accelerated, and/or toner filming can possibly occur.

The average primary particle diameter of the filler can be found by directly measuring particle diameters through the use of an electron microscope.

The amount of the filler contained in the surface protective layer is preferably 5% by mass to 50% by mass, and more preferably 10% by mass to 40% by mass. When the amount of the filler is less than 5% by mass, the abrasion resistance of the resulting photoconductor is insufficient. When it is more than 50% by mass, the transparency of the surface protective layer may be impaired. In this case, when a filler is contained in the photosensitive layer surface, the filler may be contained in the whole of the photosensitive layer. However, it is preferable to employ the following layer configuration. Specifically, the concentration gradient of the filler is provided so that the outermost surface side of the charge transporting layer has the highest filler concentration and the support side of the charge transporting layer has the lowest filler concentration, or the charge transporting layer is made to have a plurality of layers, and the filler concentration is gradually increased from the support side toward the outermost surface side of the charge transporting layer.

—Organic Compound having Acid Value of 10 mgKOH/g to 700 mgKOH/g—

The incorporation of a filler into the surface protective layer in the photoconductor can impart high durability to the photoconductor and avoid the occurrence of image blurring, however, the influence on the increase in residual potential increases. In order to suppress the increase in residual potential, it is preferable to add an organic compound having an acid value of 10 mgKOH/g to 700 mgKOH/g.

Here, the acid value is defined with the unit of milligram of potassium hydroxide required for neutralizing free fatty acids contained in 1 gram of the compound, and can be measured by a method specified in JIS K2501 or the like.

The organic compound having an acid value of 10 mgKOH/g to 700 mgKOH/g is not particularly limited. Examples thereof include organic fatty acids having an acid value of 10 mgKOH/g to 700 mgKOH/g and resins having an acid value of 10 mgKOH/g to 700 mgKOH/g. However, organic acids of significantly low-molecular weight such as maleic acid, citric acid, tartaric acid and succinic acid; acceptors and the like may drastically lower the dispersibility of a filler, and the residual potential reducing effect of a photoconductor is not sometimes sufficiently exhibited. Accordingly, in order to reduce the residual potential of the resulting photoconductor and to improve the dispersibility of the filler, it is preferable to use a low-molecular weight polymer, resins, a copolymer etc. and/or a mixture thereof. To improve the dispersibility of a filler, it is necessary to impart compatibility with the filler to a binder resin. As to materials having high steric hindrance, a decrease in the compatibility thereof cause a decrease of the dispersibility, leading to a variety of problems mentioned above.

From the above-mentioned view point, as the organic compound having an acid value of 10 mgKOH/g to 700 mgKOH/g, polycarbonic acids are preferably used. As the polycarbonic acids, it is possible to use compounds each having a structure which contains a carbonic acid in polymer or copolymer, polyester resins, acrylic resins; organic compounds containing carbonic acids such as copolymers with use of acrylic acids or methacrylic acids, styrene-acrylic acid copolymers, or all of the derivatives thereof. These compounds may be used in combination. In some instances, by mixing these materials with organic fatty acids, the dispersibility of filler or the reducing effect of the residual potential may be improved.

The acid value of the organic compound is preferably 10 mgKOH/g to 700 mgKOH/g, and more preferably 30 mgKOH/g to 400 mgKOH/g. When the acid value is excessively high, the resistance decreases too much, leading to an increase of the influence of image blur. When the acid value is excessively low, the additive amount of the organic compound must be increased, and the residual potential reducing effect becomes insufficient. It is necessary to determine the acid value of the organic compound having an acid value of 10 mgKOH/g to 700 mg KOH/g in consideration of the balance with the additive amount of the organic compound. Even with the same amount of organic compound added, it cannot be said that the higher the acid value is, the higher the reducing effect of residual potential, and the effect is also largely related to the adsorptivity of the organic compound having an acid value of 10 mgKOH/g to 700 mgKOH/g to the filler.

The amount of the organic compound having an acid value of 10 mgKOH/g to 700 mgKOH/g contained in the surface protective layer is determined by the acid value and the filler content. Specifically, when the amount of the organic compound having an acid value of 10 mgKOH/g to 700 mgKOH/g contained is represented by A, the acid value of the organic compound having an acid value of 10 mgKOH/g to 700 mgKOH/g is represented by B, and the amount of the filler contained is represented by C, it is preferable that the values of A, B and C satisfy the following Relational Expression 1.

$$0.2 \leqq \text{acid value equivalence } (A \times B/C) \leqq 20 \qquad \text{Relation Expression 1}$$

When the amount of the organic compound having an acid value of 10 mgKOH/g to 700 mgKOH/g is excessively large, conversely, dispersion failure occurs, and the influence of image blur may increase. In contrast, when the amount of the organic compound is excessively small, dispersion failure occurs, and the reducing effect of residual potential may be insufficient.

The filler can be dispersed together with at least an organic solvent and an organic compound having an acid value of 10 mgKOH/g to 700 mgKOH/g by the use of a ball mill, an atrighter, a sand mill, supersonic waves. Among these, in terms of dispersibility, it is more preferable to disperse the components by a ball mill, which can increase the rate of contact of the filler with the organic compound having an acid value of 10 mgKOH/g to 700 mgKOH/g and have less mixing of impurities from the outside. As to material of the dispersion medium used, all the conventionally used media, such as zirconia, alumina, and agate, can be used. In terms of the dispersibility of the filler and the reducing effect of residual potential, alumina is particularly preferable.

Zirconia causes a large amount of abrasion of a dispersion medium during dispersion treatment, and the residual potential is significantly increased by mixing-in of the abraded matter. Further, the dispersibility is significantly decreased by mixing-in of the abrasion powder, resulting in an acceleration of the sedimentation property of the filler. When alumina is used in the medium, the amount of abrasion can be suppressed small, and the influence of mixing-in of abrasion powder on the residual potential is vary small, although the medium is abraded during dispersion treatment. Even when the abrasion powder is mixed in the dispersion components, adverse influence on the dispersibility is small, and thus it is preferable to use alumina as the medium used in the dispersion treatment.

The organic compound having an acid value of 10 mgKOH/g to 700 mgKOH/g is preferably added into the dispersion medium before dispersion treatment because by adding the organic compound together with the filler and an organic solvent into the dispersion medium before the dispersion treatment, aggregation of the filler in the coating liquid and the sedimentation property of the filler can be suppressed, and the dispersibility of the filler can be significantly improved. Meanwhile, the binder resin and the charge transporting material can be added into the dispersion medium before the dispersion treatment, however, in this case, the dispersibility of the filler may slightly degrade. Accordingly, the binder resin and the charge transporting material are preferably added in a state of being dissolved in an organic solvent after completion of the dispersion treatment.

As to the organic compound having an acid value of 10 mgKOH/g to 700 mgKOH/g, oxidized gases such as ozone and NOx caused by the surrounding environment and a corona discharge type charging unit easily adsorb thereonto, and in some instances, the electrical resistance of the photoconductor may decrease, causing a problem such as image flow (image blur), etc.

—Compound Represented by any One of General Formulas (1) and (2)—

In the present invention, in order to solve the aforementioned problems, the surface protective layer contains a charge transporting material having an oxidation potential higher than that of a charge transporting material contained in the photosensitive layer and represented by any one of General Formulas (3) and (4), and contains a compound represented by any one of the following General Formulas (1) and (2).

General Formula (1)

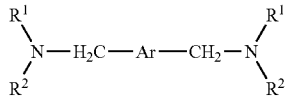

In General Formula (1), $R^1$ and $R^2$ may be identical to or different from each other, each represent any one of an alkyl group that may have a substituent and an aryl group that may have a substituent, and at least one of $R^1$ and $R^2$ is an aryl group that may have a substituent. Note that $R^1$ and $R^2$ may be bonded to each other to form a heterocyclic ring containing a nitrogen atom, and the heterocyclic ring may be further substituted with a substituent; and Ar represents an allylene group that may have a substituent.

General Formula (2)

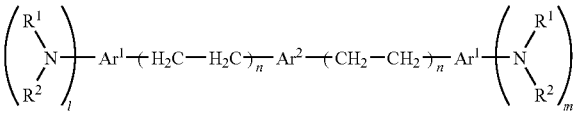

In General Formula (2), $R^1$ and $R^2$ may be identical to or different from each other, each represent any one of an alkyl group that may have a substituent and an aryl group that may have a substituent, $R^1$ and $R^2$ may be bonded to each other to form a heterocyclic ring containing a nitrogen atom, and the heterocyclic ring may be further substituted with a substituent; $Ar^1$ and $Ar^2$ each represent an allylene group that may have a substituent; l and m each represent an integer of 0 to 3, both of which are not zero at the same time; and n is an integer of 1 or 2.

Examples of the alkyl group mentioned in General Formulas (1) and (2) include methyl group, ethyl group, propyl group, isopropyl group, butyl group, isobutyl group, sec-butyl group, tert-butyl group, pentyl group, isopentyl group, neopentyl group, hexyl group, heptyl group, octyl group, nonyl group, decyl group, undecyl group, undecanyl group, dodecyl group, vinyl group, benzyl group, phenetyl group, styryl group, cyclopentyl group, cyclohexyl group, cycloheptyl group, and cyclohexenyl group.

Examples of the aryl group mentioned in General Formulas (1) and (2) include phenyl group, tolyl group, xylyl group, styryl group, naphthyl group, anthryl group, and biphenyl group.

The alkyl group of $R^1$ and $R^2$ in General Formula (2) is preferably substituted with an aromatic hydrocarbon group. Examples of the aromatic hydrocarbon group include aromatic groups such as benzene, biphenyl, naphthalene, anthracene, fluorene, and pyrene; and aromatic heterocyclic groups such as pyridine, quinoline, thiophene, oxazole, oxadiazole, and carbazole.

When $R^1$ and $R^2$ are bonded to each other to form a heterocyclic ring group containing a nitrogen atom, as the heterocyclic group, condensed heterocyclic groups are exemplified in which an aromatic hydrocarbon group is condensed with a pyrrolidino group, piperidino group, piperazine group or the like.

Further, examples of the substituents include those described in examples of the alkyl group; alkoxy groups such as methoxy group, ethoxy group, propoxy group, and butoxy group; halogen atoms such as fluorine atom, chlorine atom, bromine atom, and iodine group; the above-mentioned aromatic hydrocarbon groups; and heterocyclic groups such as pyrrolidine, piperidine, and piperazine.

Diamine compounds each represented by any one of General Formulas can be easily produced by a method described in the document, "E. Elce and A. S. Hay, Polymer, Vol. 37 No. 9, 1745(1996)". Specifically, a diamine compound can be obtained by reacting a dihalogen compound represented by the following General Formula (a) with a secondary amine compound represented by the following General Formula (b) in the presence of a basic compound at a temperature of from the room temperature to 100° C.

$XH_2C—Ar—CH_2X$ General Formula (a)

In General Formula (a), Ar has the same meaning as defined in General Formula (1), and X represents a halogen atom.

General Formula (b)

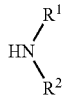

In General Formula (b), $R^1$ and $R^2$ each have the same meaning as defined in General Formula (1).

The basic compound is not particularly limited and may be suitably selected in accordance with the intended use. Examples there of include potassium carbonate, sodium carbonate, potassium hydrate, sodium hydrate, sodium hydride, sodium methylate, and t-butoxy potassium. A solvent used in the reaction is not particularly limited and may be suitably selected in accordance with the intended use. Examples thereof include dioxane, tetrahydrofuran, toluene, xylene, dimethylsulfoxide, N,N-dimethylformamide, N-methylpyrrolidone, 3-dimethyl-2-imidazolidinone, and acetonitrile.

The following are specific examples of the compounds represented by any one of General Formulas (1) and (2). The compounds are not limited to the disclosed compounds.

TABLE A

| Compound No. | Structural Formula |
|---|---|
| 1 | 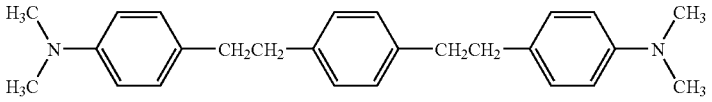 |
| 2 | 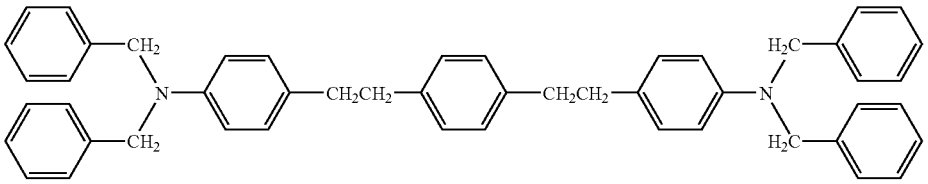 |
| 3 | 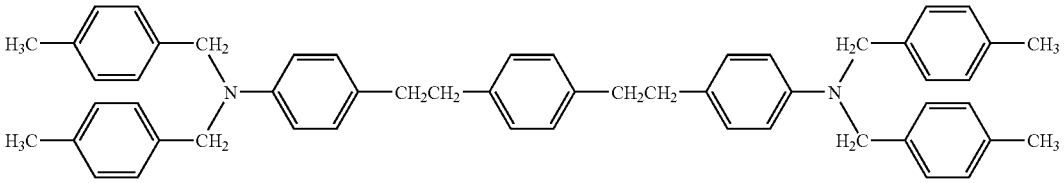 |
| 4 | 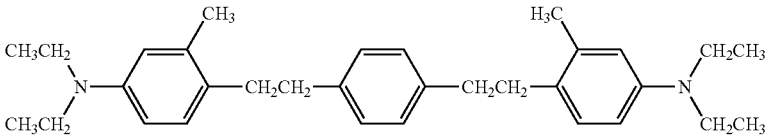 |
| 5 | 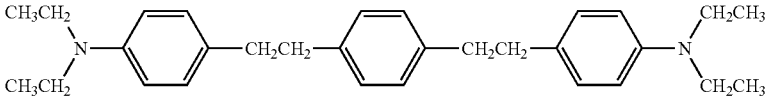 |
| 6 | 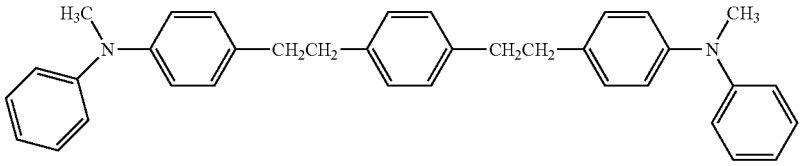 |

TABLE A-continued

| Compound No. | Structural Formula |
|---|---|
| 7 | 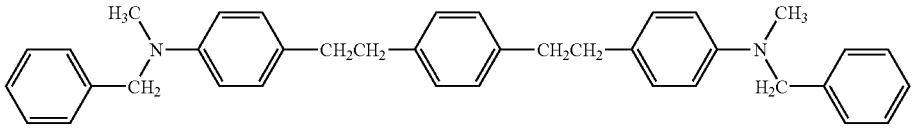 |

TABLE B

| Compound No. | Structural Formula |
|---|---|
| 8 | 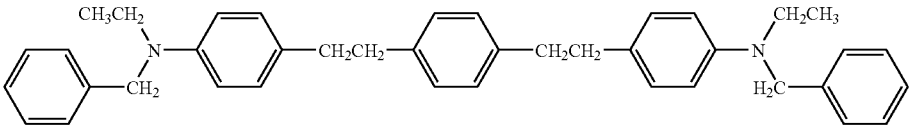 |
| 9 | 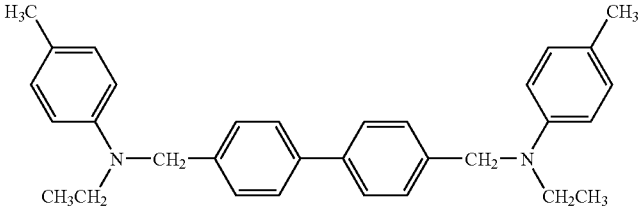 |
| 10 | 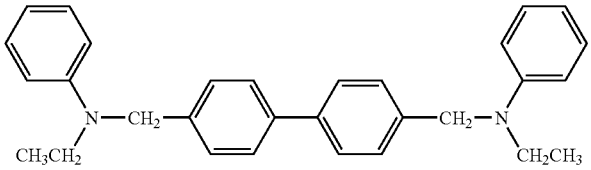 |
| 11 | 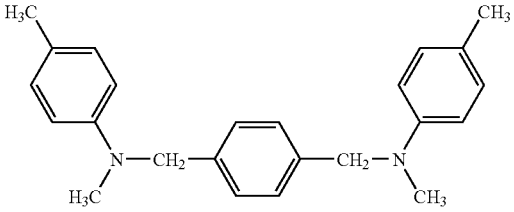 |
| 12 | 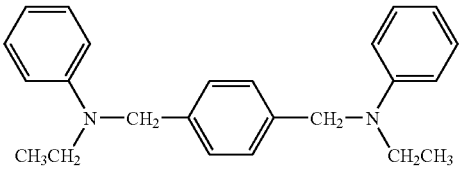 |
| 13 | 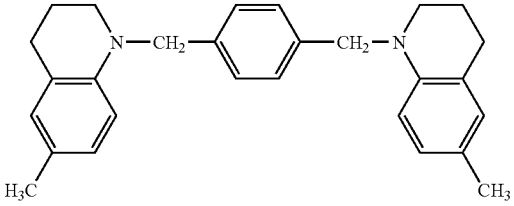 |

The amount of the compound represented by any one of General Formulas (1) and (2) contained in the surface protective layer is preferably 1% by mass to 60% by mass, and more preferably 2% by mass to 50% by mass.

In a composition prepared with the compound represented by any one of General Formulas (1) and (2) in combination with the organic compound having an acid value of 10 mgKOH/g to 700 mgKOH/g, when it is necessary to store the coating liquid, it is preferable that a specific antioxidant be contained in the coating liquid for the purpose of suppressing generation of salt by mutual interaction. The generation of salt may cause not only discoloration of the coating liquid but also problems such as an increase in residual potential in the resulting electrophotographic photoconductor.

As the antioxidant usable in the electrophotographic photoconductor of the present invention, after-mentioned general antioxidants can be used. Of these, hydroquinone compounds and hindered amine compounds are particularly preferred. It should be noted that the antioxidants used in the present invention is added for protection of the compound represented by any one of General Formulas (1) and (2) in the coating liquid, differently from the addition purpose described below. Therefore, it is preferable that the antioxidant be contained in the coating liquid before the compound represented by any one of General Formulas (1) and (2) is added to the coating liquid. To obtain satisfactory temporal storage stability of the coating liquid, the additive amount of the antioxidant is preferably 0.1 parts by mass to 200 parts by mass relative to 100 parts by mass of the organic compound having an acid value of 10 mgKOH/g to 700 mgKOH/g.

As the charge transporting material used in the surface protective layer, it is possible to suppress the occurrence of image blurring as long as the material has an oxidation potential higher than that of a charge transporting material contained in the photosensitive layer and represented by any one of General Formulas (3) and (4).

A difference in oxidation potential between the charge transporting material contained in the surface protective layer and the charge transporting material contained in the photosensitive layer (surface protective layer−photosensitive layer) is preferably 0.01 V or higher, and more preferably 0.02 V to 0.20 V Here, the following explains the measurement method of the oxidation potential, i.e., a primary oxidation half wave potential of the charge transporting materials. In to a material to be measured, a specific amount of methylene chloride and a non-related salt (supporting electrolyte) such as perchloric acid tetrabutyl ammonium, and perchloric acid tetraethyl ammonium are added and dissolved to prepare a subject liquid. The subject liquid is analyzed by an electrochemical analysis method, such as polarography, and cyclic voltammetry, thereby making it possible to measure the oxidation potential of the intended material. The electrochemical analysis is described in detail in "Electrochemical Methods" written by A. J. Bard, L. R. Faulkner, published by Wiley in 1980. The oxidation potential can be measured by a potential scanning method using a potentiostat in which as a working electrode, a dropping mercury electrode is used, as a counter electrode, a precious metal such as platinum and gold is used, as a reference electrode, a saturated calomel electrode (SCE) is used.

The oxidation potential of the charge transporting material in the surface protective layer is preferably 0.76 V to 0.90 V (vs SCE). When the oxidation potential is lower than 0.76 V, image blur easily occurs, and when higher than 0.90 V, the barrier to charge injection between the photosensitive layer and the surface protective layer becomes large, which may lead to an increase in residual potential.

The charge transporting material contained in the surface protective layer is not particularly limited, as long as it has an oxidation potential higher than that of the compound contained in the photosensitive layer and represented by any one of General Formulas (3) and (4), as mentioned above. For example, compounds each represented by any one of the following General Formulas (a) to (r) are exemplified.

Also, as described above, in order to suppress cracks readily occurring at the interface between the photosensitive layer and the surface protective layer, it is preferable to select a charge transporting material having a melting point of 170° C. or lower as the charge transporting material of the surface protective layer. The melting point of the charge transporting material contained in the surface protective layer is more preferably 160° C. or lower. With this, the prevention effect of cracks is improved.

General Formula (a)

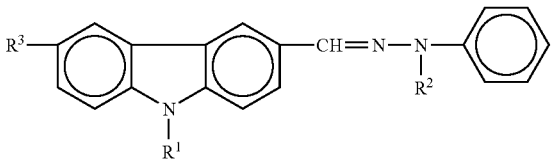

In General Formula (a), $R^1$ represents a methyl group, an ethyl group, 2-hydroxyethyl group or 2-chlorethyl group; $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group.

General Formula (b)

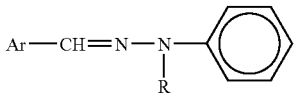

In General Formula (b), Ar represents a naphthalene ring, an anthracene ring, a pyrene ring, substitution product thereof or a pyridine ring, a furan ring, or a thiophene ring; and R represents an alkyl group, a phenyl group or a benzyl group.

General Formula (c)

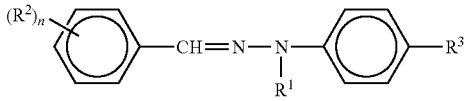

In General Formula (c), $R^1$ represents an alkyl group, a benzyl group, a phenyl group or a naphthyl group; $R^2$ represents a hydrogen atom, an alkyl group having 1 to 3 carbon atoms, an alkoxy group having 1 to 3 carbon atoms, a dialkylamino group, a diaralkylamino group or a substituted or unsubstituted diarylamino group; n is an integer of 1 to 4, when the n is an integer of 2 or more, plural $R^2$ may be identical to or different from each other; and $R^3$ represents a hydrogen atom or a methoxy group.

General Formula (d)

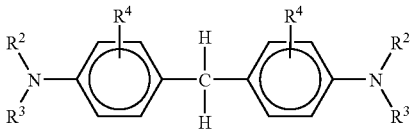

In General Formula (d), $R^1$ represents an alkyl group having 1 to 11 carbon atoms, a substituted or unsubstituted phenyl group or heterocyclic ring group; $R^2$ and $R^3$ may be identical to or different from each other, and each represent a hydrogen atom, an alkyl group having 1 to 4 carbon atoms, a hydroxyalkyl group having 1 to 4 carbon atoms, a chloroalkyl group or a substituted or unsubstituted aralkyl group, and $R^2$ and $R^3$ may be bonded to each other to form a heterocyclic ring containing a nitrogen atom; and plural $R^4$ may be identical to or different from each other, and each represent a hydrogen atom, an alkyl group having 1 to 4 carbon atoms, an alkoxy group having 1 to 4 carbon atoms or a halogen atom.

General Formula (e)

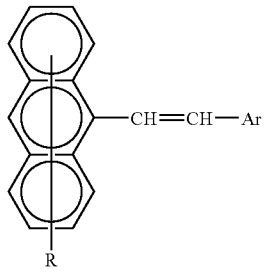

In General Formula (e), R represents a hydrogen atom or a halogen atom; Ar represents a substituted or unsubstituted phenyl group, naphthyl group, anthryl group or carbazolyl group.

General Formula (f)

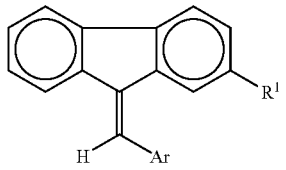

In General Formula (f), $R^1$ represents a hydrogen atom, a halogen atom, a cyano group, an alkoxy group having 1 to 4 carbon atoms or an alkyl group having 1 to 4 carbon atoms; and Ar represents a substituent having any one of the following structural formulas.

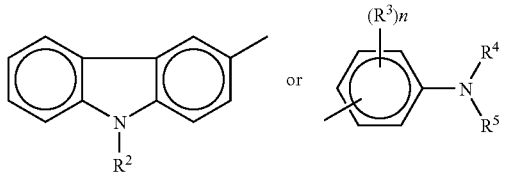

In the structural formulas, $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms or a dialkylamino group having 1 to 4 carbon atoms; n is an integer of 1 or 2, and when n is 2, plural $R^3$ may be identical to or different from each other; $R^4$ and $R^5$ each represent a hydrogen atom, a substituted or unsubstituted alkyl group having 1 to 4 carbon atoms or a substituted or unsubstituted benzyl group.

General Formula (g)

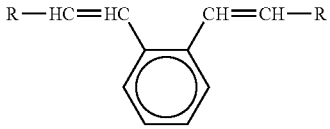

In General Formula (g) R represents a carbazolyl group, a pyridyl group, a thienyl group, an indolyl group, a furyl group, or each represent a substituted or unsubstituted phenyl group, styryl group, naphthyl group or a substituted or anthryl group, and each of these substituents is a group selected from dialkylamino group, alkyl group, alkoxy group, carboxy group or esters thereof, a halogen atom, cyano group, aralkylamino group, group, N-alkyl-N-aralkylamino group, amino group, nitro group and acetylamino group.

General Formula (h)

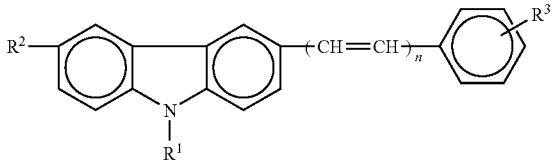

In General Formula (h), $R^1$ represents a lower alkyl group, a substituted or unsubstituted phenyl group or benzyl group; $R^2$ and $R^3$ each represent a hydrogen atom, a lower alkyl group, a lower alkoxy group, a halogen atom, a nitro group, an amino group or an amino group substituted with a lower alkyl group or a benzyl group; and n is an integer of 1 or 2.

General Formula (i)

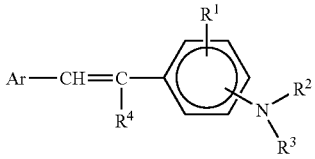

In General Formula (i), $R^1$ represents a hydrogen atom, an alkyl group, an alkoxy group or a halogen atom; $R^2$ and $R^3$ each represent a substituted or unsubstituted aryl group; $R^4$ represents a hydrogen atom, a lower alkyl group or a substituted or unsubstituted phenyl group; and Ar represents a substituted or unsubstituted phenyl group or naphthyl group.

General Formula (j)

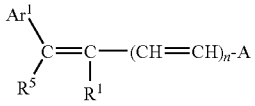

In General Formula t), n is an integer of 0 or 1; $R^1$ represents a hydrogen atom, an alkyl group or a substituted or unsubstituted phenyl group; $Ar^1$ represents a substituted or unsubstituted aryl group; $R^5$ represents an alkyl group including substituted alkyl group or a substituted or unsubstituted aryl group; when m is 2 or more, plural $R^2$ may be identical to or different from each other; when n is zero, A and $R^1$ may together form a ring; A represents a substituent represented by the following structural formula, 9-anthryl group or a substituted or unsubstituted carbazolyl group.

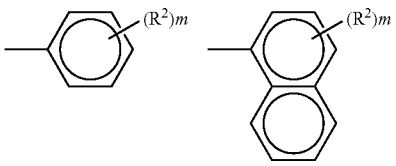

In the structural formula, $R^2$ represents a hydrogen atom, an alkyl group, an alkoxy group, a halogen atom or a substituent having the following structural formula.

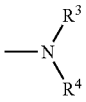

In the structural formula, $R^3$ and $R^4$ each represent a substituted or unsubstituted aryl group, $R^3$ and $R^4$ may be identical to or different from each other, and $R^4$ may form a ring.

General Formula (k)

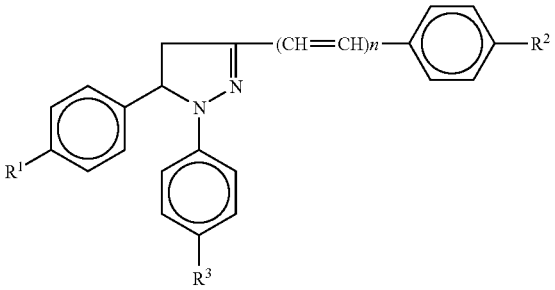

In General Formula (k), $R^1$, $R^2$ and $R^3$ each represent a hydrogen atom, a lower alkyl group, a lower alkoxy group, a halogen atom, or a dialkylamino group; and n is an integer of 0 or 1.

General Formula (l)

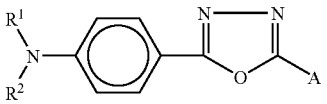

In General Formula (l), $R^1$ and $R^2$ each represent an alkyl group including substituted alkyl group or an unsubstituted aryl group; A represents a substituted amino group or an unsubstituted aryl group or allyl group.

General Formula (m)

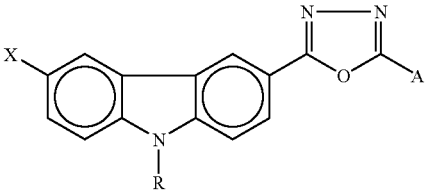

In General Formula (m), X represents a hydrogen atom, a lower alkyl group or a halogen atom; R represents a substituted or unsubstituted aryl group; and A represents a substituted amino group or a substituted or unsubstituted aryl group.

General Formula (n)

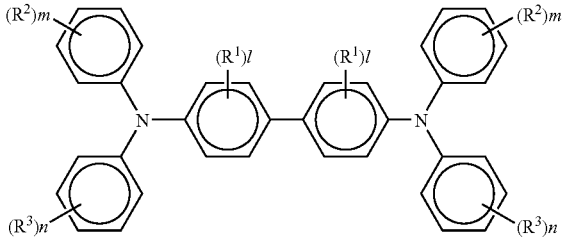

In General Formula (n), $R^1$ represents a lower alkyl group, a lower alkoxy group or a halogen atom; $R^2$ and $R^3$ may be identical to or different from each other, and represent a hydrogen atom, a lower alkyl group, a lower alkoxy group or a halogen atom; and l, m and n are an integer of 0 to 4.

General Formula (o)

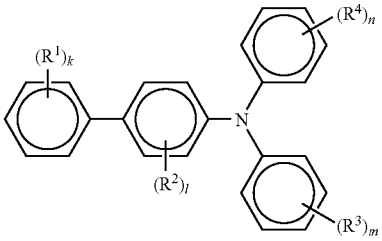

In General Formula (o), $R^1$, $R^3$ and $R^4$ each represent a hydrogen atom, an amino group, an alkoxy group, a thioalkoxy group, an aryloxy group, a methylenedioxy group, a substituted or unsubstituted alkyl group, a halogen atom or a substituted or unsubstituted aryl group; $R^2$ represents a hydrogen atom, an alkoxy group, a substituted or unsubstituted alkyl group or a halogen atom. Note that when k, l, m and n are an integer of 1, 2, 3 or 4 and each of them is an integer of 2, 3 or 4, $R^1$, $R^2$, $R^3$ and $R^4$ may be identical to or different from each other, except that when all the $R^1$, $R^2$, $R^3$ and $R^4$ are hydrogen atoms.

General Formula (p)

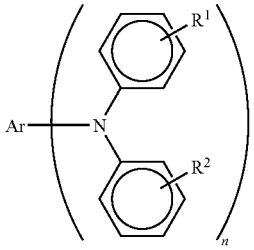

In General Formula (p), Ar represents a condensed polycyclic hydrocarbon group having carbon atoms of 18 or less, which may have a substituent; $R^1$ and $R^2$ each represent a hydrogen atom, a halogen atom, a substituted or unsubstituted alkyl group, alkoxy group or a substituted or unsubstituted phenyl group, $R^1$ and $R^2$ may be identical to or different from each other; and n is an integer of 1 or 2.

A-CH═CH—Ar—CH═CH-A General Formula (q)

In General Formula (q), Ar represents a substituted or unsubstituted aromatic hydrocarbon group; and A represents a substituent group having the following structural formula.

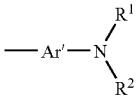

In the above structural formula, Ar' represents a substituted or unsubstituted aromatic hydrocarbon group; $R^1$ and $R^2$ each represent a substituted or unsubstituted alkyl group or a substituted or unsubstituted aryl group.

General Formula (r)

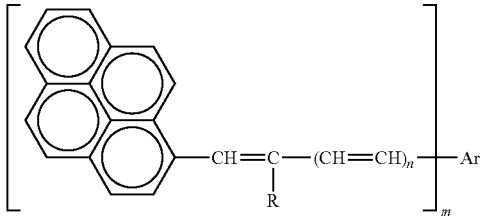

In General Formula (r), Ar represents a substituted or unsubstituted aromatic hydrocarbon group; R represents a hydrogen atom, a substituted or unsubstituted aryl group; n is an integer of 0 or 1; m is an integer of 1 or 2; when n is 0 and m is 1, Ar and R may together form a ring.

Examples of the compound represented by General Formula (a) include 9-ethylcarbazole-3-aldehyde-1-methyl1-phenylhydrazone, 9-ethylcarbazole-3-aldehyde1-benzyl-1-phenylhydrazone, 9-ethylcarbazole-3-aldehyde1,1-diphenylhydrazone.

Examples of the compound represented by General Formula (b) include 4-diethylaminostyryl-β-aldehyde-1-methyl-1-phenylhydrazone, and 4-methoxynaphthalene-1-aldehyde-1-benzyl-1-phenylhydrazone.

Examples of the compound represented by General Formula (c) include 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminozenzaldehyde-1,1-diphenylhydrazone.

Examples of the compound represented by General Formula (d) include 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)-triphenylmethane.

Examples of the compound represented by General Formula (e) include 9-(4-diethylaminostyryl)anthracene, and 9-bromine-10-(4-diethylaminostyryl)anthracene.

Examples of the compound represented by General Formula (f) include 9-dimethylaminobenzilidene)fluorene, and 3-(9-fluorenylidene)-9-ethylcarbazole.

Examples of the compound represented by General Formula (g) include 1,2-bis(4-diethylaminostyryl)benzene, and 1,2-bis(2,4-dimethoxystyryl)benzene.

Examples of the compound represented by General Formula (h) include 3-styryl-9-ethylcarbazole, and 3-(4-methoxystyryl)-9-ethylcarbazole.

Examples of the compound represented by General Formula (i) include 4-diphenylaminostilbene, 4-dibenzylaminostilbene, 4-ditolylaminostilbene, aminostilbene, and 1-(4-diphenylaminostyryl)naphthalene.

Examples of the compound represented by General Formula (j) include 4'-diphenylamino-α-phenylstilbene, and 4'-bis (4-methylphenyl) amino-α-phenylstilbene.

Examples of the compound represented by General Formula (k) include 1-phenyl-3-(4-diethylaminostyryl)-5-(4-diethylaminophenyl)pyrazolne.

Examples of the compound represented by General Formula (l) include 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Examples of the compound represented by General Formula (m) include 2-N,N-diphenylamino-5-(N-ethylcarbazole-3-yl)-1,3,4-oxadiazole, and 2-(4-diethylaminophenyl)-5-(N-ethylcarbazole-3-yl)-1,3,4-oxadiazole.

Examples of the benzidine compound represented by General Formula (n) include N,N'-diphenyl-N,N'-bis(3-methylphenyl)-[1,1'-biphenyl]-4,4'-diamine, 3,3'-dimethyl-N,N,N', and N'-tetrakis(4-methylphenyl)-[1,1'-biphenyl]-4,4'-diamine.

Examples of the biphenylamine compound represented by General Formula (o) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N bis(3,4-dimethylphenyl)-[1,1'-biphenyl]-4-amine.

Examples of the triarylamine compound represented by General Formula (p) include N,N-diphenyl-pyrene-1-amine, N,N-di-p-tolyl-1-naphthylamine, N,N-di(p-tolyl)-1-phenanthrylamine, 9,9-dimethyl-2-(di-p-tolylamino)fluorene, N,N,N',N'-tetrakis(4-methylphenyl)-phenanthrene-9,10-diamine, N,N,N',N'-tetrakis(3-methylphenyl)-m-phenylenediamine.

Examples of the diolefin aromatic compound represented by General Formula (q) include 1,4-bis(4-diphenylaminostyryl)benzene, 1,4-bis[4-di(p-tolyl)aminostyryl]benzene.

Examples of the styrylpyrene compound represented by General Formula (r) include 1-(4-diphenylaminostyryl) pyrene, and 1-(N,N-di-p-tolyl-4-aminostyryl)pyrene.

—Binder Resin—

The binder resin contained in the surface protective layer is not particularly limited and may be suitably selected in accordance with the intended use. Examples thereof include AS resin, ABS resin, ACS resin, olefin-vinyl monomer copolymers, chlorinated polyether resin, allyl resin, phenol resin, polyacetal resin, polyamide resin, polyamideimide resin, polyacrylate resin, polyallyl sulfone resin, polybutylene resin, polybutylene terephthalate resin, polycarbonate resin, polyether sulfone resin, polyethylene resin, polyethylene terephthalate resin, polyimide resin, acrylic resin, polymethyl pentene resin, polypropylene resin, polyphenylene oxide resin, polysulfone resin, polyurethane resin, polyvinyl chloride resin, polyvinylidene chloride resin, and epoxy resin.

Note that addition of addition of an after-mentioned low-molecular weight charge transporting material or high-molecular weight charge transporting material into the surface protective layer is effective and useful to reduce the residual potential and to improve the image quality.

The method of forming the surface protective layer is not particularly limited and may be suitably selected in accordance with the intended use. Examples thereof include dip-coating method, spray-coating method, bead-coating method, nozzle-coating method, spinner-coating method, and ring-coating method. Of these, from the viewpoint of the uniformity of a coated film, spray-coating method is particularly preferred. The surface protective layer can be formed with a required thickness by coating at a time, however, it is more preferred to perform coating treatment two or more times so as to form a surface protective layer in multilayered structure, from the perspective of the filler uniformity in the surface protective layer. With this, further effects of reducing the residual potential, improving the resolutions and abrasion resistance can be obtained.

The thickness of the surface protective layer is preferably 0.1 μm to 10 μm, and more preferably 2.0 μm to 8.0 μm. The addition of the organic compound having an acid value of 10 mgKOH/g to 700 mgKOH/g can drastically reduce the residual potential, and thus it is possible to freely set the thickness of the surface protective layer. However, when the thickness of the surface protective layer is significantly increased, it is recognized that the image quality slightly degrades. Thus, the thickness of the surface protective layer is preferably set to a minimum thickness.

<Support>

The support is not particularly limited as long as it has the conductivity of a volume resistance of $10^{10}$ Ω·cm or lower, and may be suitably selected in accordance with the intended use. For example, the support may be prepared by coating a film-shaped or cylinder-shaped plastic or paper with a metal such as aluminum, nickel, chrome, nichrome, copper, gold, silver, and platinum; or the support may be a plate of aluminum, aluminum alloy, nickel or stainless steel, or a plate formed into a tube by extrusion or drawing and surface-treating by cut, finish and polish, etc. An endless nickel belt and an endless stainless steel belt such as those disclosed in JP-A No. 52-36016 may also be employed as a support. Further, nickel foils having a thickness of 50 μm to 150 μm, and those obtained by subjecting a surface of a polyethylene terephthalate film having a thickness of 50 μm to 150 μm to a conductive treatment such as aluminum deposition may be used.

In addition to the support described above, those obtained by dispersing conductive powers in suitable binder resin and applying the binder resin over the support may be used as the support of the present invention.

Examples of conductive fine particles include metal powders such as carbon black, acetylene black, aluminum, nickel, iron, nichrome, copper, zinc and silver, and metal oxide fine particles such as of conductive tin oxide and ITO. Examples of simultaneous use binder resins include polystyrene, styrene acrylonitrile copolymer, styrene butadiene copolymer, styrene maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl-cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

The conductive layer can be prepared by dispersing these conductive fine particles and the binder resin into a suitable solvent, for example, tetrahydrofuran, dichloromethane, methyl ethyl ketone, toluene, etc and by applying this coating solution.

Furthermore, supports which are prepared by forming a conductive layer on a suitable cylindrical base with a thermal-contractive inner tube made of suitable materials such as polyvinyl chloride, polypropylene, polyester, polystyrene, polyvinylidene chloride, polyethylene, chlorinated rubber, Teflon™, etc. containing conductive fine particles may also be used as the conductive support in the present invention.

<Photosensitive Layer>

—Multi-Layered Photosensitive Layer—

The multi-layered photosensitive layer has a charge generating layer and a charge transporting layer, and as described above, and a charge transporting material contained in the layer has an oxidation potential lower than that of the charge transporting material contained in the surface protective layer. The charge transporting material represented by any one of General Formulas (3) and (4) is contained in the charge transporting layer.

—Charge Generating Layer—

The charge generating layer contains at least a charge generating material, may also contain a binder resin and other components in accordance with the necessity.

The charge generating layer is a layer which contains a charge generating material as the main component. Conventionally known charge generating materials can be used therein. Examples thereof include azo pigments such as monoazo pigments, disazo pigments, asymmetrical disazo pigments, triazo pigments, azo pigments having a carbazole skeleton (JP-A No. 53-95033), azo pigments having distyrylbenzene skeleton (JP-A No. 53-133445), azo pigments having a triphenyl amine skeleton (JP-A No. 53-132347), azo pigments having a diphenylamine skeleton (JP-A No. 54-21728), azo pigments having a fluolenon skeleton (JP-A No. 54-22834), azo pigments having an oxadiazole skeleton (JP-A No. 54-12742), azo pigments having a bisstilbene skeleton (JP-A No. 54-17733), azo pigments having a distyryl oxadiazole skeleton (JP-A No. 54-2129), and azo pigments having a distyrylcarbazole skeleton (JP-A No. 54-14967); azulenium salt pigments, squaric acid methine pigment, perylene pigments, anthraquinone or polycyclic quinone pigments, quinone imine pigments, diphenylmethane or triphenylmethane pigments, benzoquinone or naphthoquinone pigments, cyanine or azomethine pigments, indigoido pigments, bisbenzimidazole pigments or phthalocyanine pigments such as metal phthalocyanine represented by the following General Formula (A), and metal-free phthalocyanine pigments.

General Formula (A)

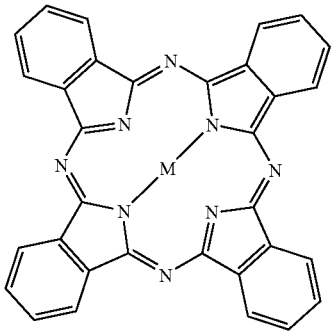

In General Formula (A), M (central metal) represents a metal element or metal-free (hydrogen) element.

The central metal M is not particularly limited and may be suitably selected in accordance with the intended use. For example, the central metal M consists of two or more elements selected from simple substances or oxides, chlorides, fluorides, hydroxides, and bromides of H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Th, Dy, Ho, Er, Tm, Yb, Lu, Th, Pa, U, Np, and Am.

The charge generating material having a phthalocyanine skeleton is not particularly limited as long as it has at least a basic skeleton of General Formula (A). Those having a polymer structure such as dimer, and trimer, those having a further higher polymer structure, and those having various substituents in their basic skeletons may be used therefor. Of these various phthalocyanines, titanyl phthalocyanine having TiO in its central metal, metal-free phthalocyanine, chlorogallium phthalocyanine, hydroxygallium phthalocyanine, etc. are particularly preferable in terms of photoconductor properties. Further, it is known that these phthalocyanines have various crystals. For instance, titanyl phthalocyanines have α-crystal, β-crystal, γ-crystal, and m-crystal forms; and Y-type copper phthalocyanines have various crystal forms of α-type, β-type, γ-type etc. In phthalocyanines having the same central metals, various physical properties vary depending on the change of the crystal form. It is reported that physical properties of photoconductors using phthalocyanine pigments having these crystal forms vary depending on the crystal form (Journal of the Electrophotography Society of Japan Vol. 29 No. 4 (1990)). According to the report, it is very important to select the crystal form of phthalocyanine, from the viewpoint of photoconductor properties.

Among these phthalocyanine pigments, titanyl phthalocyanines have a maximum diffraction peak at least at a Bragg angle (2θ±0.2°) of 27.2° toward CuKα characteristic X-ray (wavelength: 1.541 angstrom) and have particularly high photosensitivity. Because the titanyl phthalocyanine allows speeding up the image forming operation, it is effectively used in the present invention. Among these titanyl phthalocyanines, a titanyl phthalocyanine crystal having an X-ray diffraction spectrum by a CuKα characteristic X-ray with a wavelength of 1.541 angstrom, having a maximum diffraction peak at a Bragg angle (2θ±0.2°) of 27.2°, further having main diffraction peaks at Bragg angles of 9.4°, 9.6° and 24.0° and a diffraction peak at the smallest Bragg angle of 7.3°, and having no diffraction peaks at Bragg angles between 7.3° and 9.4° and at 26.3° can be remarkably effectively used in the present invention because it is high in charge generating efficiency, superior in electrostatic properties and is hardly cause background smear, etc. These charge generating materials may be used alone or in combination.

It is effective to reduce the particle size of the charge generating materials because the above-noted effects may be increased. In particular, the average particle size of a phthalocyanine pigment is preferably 0.25 μm or smaller, and more preferably 0.2 μm or smaller. The following explains a production method of such a phthalocyanine pigment. In order to control the particle size of a charge generating material to be contained in the photosensitive layer, the charge generating material is dispersed, and then particles larger in size than 0.25 μm are removed. Here, the term of the average particle size means a volume average particle size and is found by a ultracentrifuge type automatic particle size distribution measuring meter, CAPA-700 (manufactured by HORIBA Ltd.), and is calculated as a particle diameter (Median diameter) equivalent to 50% of the cumulative distribution. However, a trace quantity of coarse particles may not be detected by this method. To measure the detailed average particle size, it is important to directly observe a charge generating material powder or a dispersion liquid by an electron microscope.

Next, the following explains a method of removing coarse particles after a dispersion treatment of the charge generating material. Specifically, after preparation of a dispersion liquid in which particles are made as fine as possible, the dispersion liquid is filtered through an appropriate filter. The dispersion liquid is produced by a common dispersing method, and can be obtained by dispersing the charge generating material together with a binder resin as necessary in an appropriate solvent by use of a ball mill, atrighter, sand mill, bead mill, ultrasonic waves or the like. On this occasion, the binder resin is selected in view of the electrostatic properties of the resulting photoconductor, the wettability of the solvent to the pigment, and the dispersibility of the pigment.

This method is very effective also in that a trace quantity of coarse particle residues that could not be observed by naked eye (or could not be detected in particle size measurement) can be removed, and the particle size distribution is made uniform. Specifically, the dispersion liquid produced as described as above is filtered through a filter having an effective pore diameter of 5 μm or smaller, more preferably 3 μm or smaller, thereby preparing a dispersion liquid. This method also allows the preparation of a dispersion liquid containing only a charge generating material having small particle size (0.25 μm or smaller, preferably 0.2 μm or smaller), thereby making it possible to improve the electrostatic properties such as photosensitivity and chargeability, to maintain the effects, and to increase the effects of the present invention.

When the particle size of the dispersion liquid to be filtered is excessively large and the particle size distribution is excessively wide, the filtration loss may increase and clogging of the filter may occur, resulting in impossibility of filtration. For this reason, the dispersion liquid before filtration is preferably subjected to a dispersion treatment until the average particle size thereof reaches 0.3 μm or smaller and the standard deviation reaches 0.2 μm or smaller. When the average particle size of the dispersion liquid is 0.3 μm or larger, the filtration loss increases. When the standard deviation is 0.2 μm or larger, there may be a problem that the filtration time is greatly prolonged.

The charge generating material has extremely strong intermolecular hydrogen bonding force which is a characteristic of a charge generating material exhibiting high-photosensitivity. Therefore, the interaction between particles of the pigment dispersed is very strong. As a result, the possibility that particles of the charge generating material dispersed by a dispersing device reaggregate due to dilution of the dispersion liquid. The agglomerate can be removed by filtration using a filter having a pore diameter smaller than the specific size. On this occasion, since the dispersion liquid is in a thixotropy state, even particles smaller in size than the effective pore diameter of a filter used are removed. Alternatively, the state of the dispersion liquid exhibiting structural viscosity can be changed in a state close to Newtonian viscosity by filtering. By removing coarse particles of the charge generating material, the effects of the present invention can be further increased.

Further, in the above-mentioned azo pigments, azo pigments each represented by the following General Formula (b) are effectively used. In particular, symmetrical azo pigments in which $Cp_1$ is different from $Cp_2$, is high in carrier generating efficiency, and effective in speeding up of operation, and thus they are preferably used as the charge generating material of the present invention.

General Formula (B)

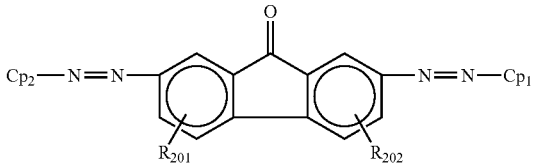

In General Formula (B), $Cp_1$ and $Cp_2$ each represent a coupler residue; $R_{201}$ and $R_{202}$ each represent a hydrogen atom, a halogen atom, an alkyl group, an alkoxy group, or a cyano group and may be identical to or different from each other; and $Cp_1$ and $Cp_2$ are each represented by the following structural formula.

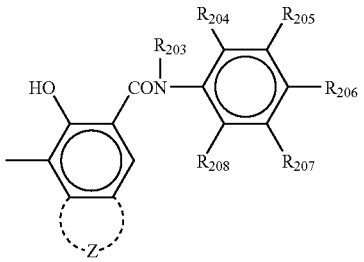

In the structural formula, $R_{203}$ represents a hydrogen atom, an alkyl group such as methyl group and ethyl group, or an aryl group such as phenyl group; $R_{204}$, $R_{205}$, $R_{206}$, $R_{207}$, and $R_{208}$ each represent a hydrogen atom, a nitro group, a cyano group; a halogen atom such as fluorine, chlorine, bromine, and iodine; a halogenated alkyl group such as trifluoromethyl group; an alkyl group such as methyl group and ethyl group; an alkoxy group such as methoxy group and ethoxy group; a dialkylamino group or a hydroxyl group; Z represents a group of atoms required to form a substituted or unsubstituted aromatic carbon ring having a carbocyclic aromatic group or a substituted or unsubstituted aromatic heterocyclic ring having a heterocyclic aromatic group.

The binder resin used as necessary in the charge generating layer is not particularly limited and may be suitably selected in accordance with the intended use. Examples thereof include polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, polyacrylamide, polyvinyl benzal, polyester, phenoxy resins, vinyl chloride-vinyl acetate copolymers, polyvinyl acetate, polyphenylene oxides, polyvinyl pyridine, cellulose resins, casein, polyvinyl alcohol, and polyvinyl pyrrolidone. Of these, polyvinyl butyral is particularly preferable. These binder resins may be used alone or in combination.

Examples of the solvent include commonly used organic solvents such as isopropanol, acetone, methylethylketone, cyclohexanone, tetrahydrofuran, dioxane, ethyl Cellosolve, ethyl acetate, methyl acetate, dichloromethane, dichloroethane, monochlorobenzene, cyclohexane, toluene, xylene, and ligroin. Of these, it is preferred to use a ketone solvent, an ester solvent or an ether solvent. These solvents may be used alone or in combination.

A coating liquid of the charge generating layer can be obtained by dispersing a charge generating material together with a binder resin as necessary in a solvent using a known dispersing method such as a ball mill, atrighter, sand mill, and ultrasonic waves. Note that the binder resin may be added before or after the dispersion treatment. The coating liquid of the charge generating layer contains a charge generating material, a solvent and a binder resin as main components, and may contain additives such as a sensitizer, dispersant, surfactant, silicone oil. In some instances, the after-mentioned charge generating material can also be added into the charge generating layer. The additive amount of the binder resin is preferably 500 parts by mass or less, and more preferably 10 parts by mass to 300 parts by mass relative to 100 parts by mass of the charge generating material.

The charge generating layer can be formed by applying the coating liquid onto a conductive support, an undercoat layer or the like and drying the applied liquid. As the coating method, it is possible to use conventionally known methods such as dip-coating method, spray-coating method, bead-coating method, nozzle-coating method, spinner-coating method, and ring-coating method. The thickness of the charge generating layer is preferably 0.01 μm to 5 μm, and more preferably 0.1 μm to 2 μm. The applied coating liquid is heat dried by means of an oven, etc. The drying temperature of the charge generating layer is preferably 50° C. to 160° C., and more preferably 80° C. to 140° C.

—Charge Transporting Layer—

The charge transporting layer is formed for the purpose of maintaining charged electric charge and for transferring electric charge that has been generated in and separated from the charge generating layer by exposure of light so as to be bound to the charged electric charge. In order to achieve the purpose of maintaining charged electric charge in the layer, the electric resistance is required to be high. Further, in order to achieve the purpose of obtaining a high surface potential with the charged electric charge, the charge transporting layer is required to have a low dielectric constant and superior charge transfer properties.

The charge transporting layer contains a charge transporting material and a binder resin as main components. As the charge transporting material, low-molecular weight charge transporting material such as a hole transporting material and an electron transporting material, is used, and further, a high-molecular weight (polymer) charge transporting material can be added as necessary.

Examples of the electron transporting materials (electron acceptable materials) include chloranil, bromanil, tetracyanoethylene, tetracyanoquinodimethan, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. These electron transporting materials may be used alone or in combination.

Examples of the hole transporting materials (electron donating materials) include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives.

Among these hole transporting materials, compounds containing a distyryl structure are effective in suppressing an increase in residual potential, and those having an oxidation potential of 0.76 V (vs SCE) or lower are preferably used. Among these compounds, a compound represented by the following General Formula (3) is remarkably effective in high-quality image, speeding up of operation, downsizing of apparatus, and shortening the image outputting time because the use of such a compound can reduce the initial residual potential and suppress the increase in residual potential during repetitive use of the resulting photoconductor.

General Formula (3)

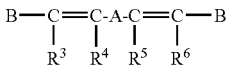

In General Formula (3), $R^3$ to $R^6$ each represent a hydrogen atom, an alkyl group having 1 to 4 carbon atoms, an alkoxy group having 1 to 4 carbon atoms, or a phenyl group that may have a substituent; A is an allylene group that may have a substituent or a substituent having the following Structural Formula (3-1).

Structural Formula (3-1)

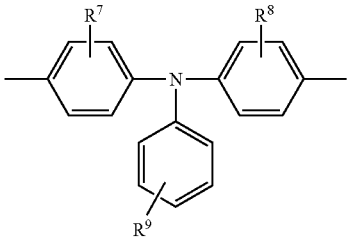

In Structural Formula (3-1), $R^7$, $R^8$, and $R^9$ each represent a hydrogen atom, an alkyl group having 1 to 4 carbon atoms, an alkoxy group having 1 to 4 carbon atoms, or a phenyl group, the phenyl group may be further substituted with a substituent; and B represents an aryl group that may have a substituent or a substituent having the following Structural Formula (3-2).

Structural Formula (3-2)

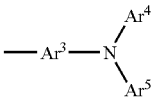

In Structural Formula (3-2), $Ar^3$ represents an allylene group that may have a substituent; and $Ar^4$ and $Ar^5$ each represent an aryl group that may have a substituent.

Of these compounds, a distyrylbenzene derivative represented by the following General Formula (4) is, in particular, highly effective in the present invention, and very useful.

General Formula (4)

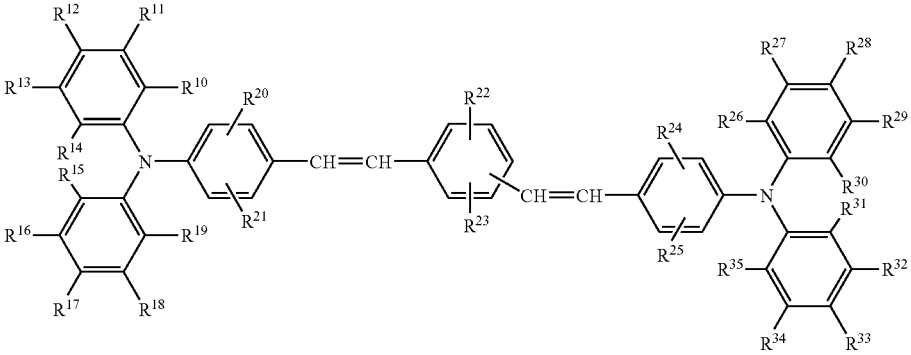

In General Formula (4), $R^{10}$ to $R^{35}$ may be identical to or different from each other, and each represent a hydrogen atom, an alkyl group having 1 to 4 carbon atoms, an alkoxy group having 1 to 4 carbon atoms, or a phenyl group that may have a substituent.

The high mobility of these compounds is considered to be a factor of achieving the above-mentioned effects. Compounds each represented by General Formula (3), in particular, distyrylbenzene derivatives each represented by General Formula (4) are greatly effective materials in obtaining the effects. These are characterized by having large-size molecules whose structure is straight-chain, and also having extended n-conjugated system which is extended to the overall molecules. It is considered that due to the characteristics, the rate of intramolecular transfer becomes higher than the rage of intermolecular transfer, and the dependency of the mobility on the strength of electric field is reduced with an increase of the mobility.

In order to reduce the initial residual potential and suppress an increase in residual potential during repetitive use of the photoconductor, a compound represented by any one of General Formulas (3) and (4), the hole transporting material or the after-mentioned polymer charge transporting material may be contained in combination in the photosensitive layer.

The charge transporting material represented by any one of General Formulas (3) and (4) has a melting point of 170° C. to 240° C., a largely extended molecule structure in which n-electron conjugated system is extended to the overall molecules, and also has high crystallinity. Thus, when a surface protective layer is provided in the photoconductor, cracks may occur at the interface between the photosensitive layer and the surface protective layer. It is preferable to prevent the occurrence of cracks at the interface because there is a concern that serious cracks may appear on an image, and the surface protective layer of the photoconductor may peel off during repetitive use of the photoconductor. The occurrence of interface cracks is presumed primarily attributable to a difference in plasticity, caused by a difference of thermal properties of the charge transporting materials, between the photosensitive layer and the surface protective layer. Such interface cracks can be suppressed by improving the plasticity of the photosensitive layer or the surface protective layer. In order to suppress such interface crack, it is preferable to set the additive amount of the charge transporting material in the photosensitive layer to 65 parts by mass or more relative to 100 parts by mass of the resin used therein, or it is more preferable to add a low-molecular weight additive having a melting point of 150° C. or lower in an amount of 2.5 parts by mass to 10 parts by mass relative to 100 parts by mass of the charge transporting material contained in the photosensitive layer. Further, by incorporating, as a low-molecular weight additive, at least one of compounds having a melting point of 150° C. or lower and each represented by any one of the following Structural Formulas (1) to (3), in the photosensitive layer, not only a preventive effect of the occurrence of interface cracks, but also the occurrence of image blurring can be reduced, thereby a long lived photoconductor can be achieved.

Structural Formula (1)

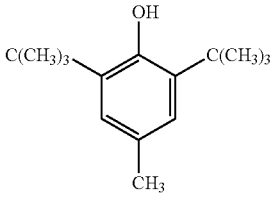

-continued

Structural Formula (2)

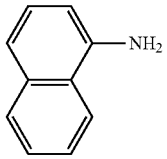

Structural Formula (3)

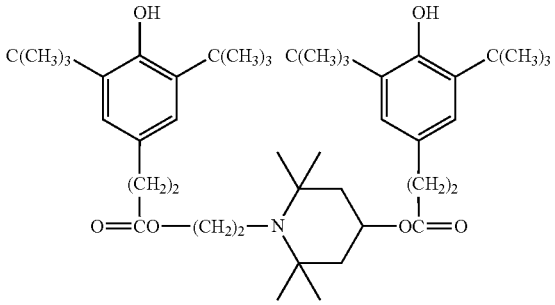

The preventive effect of the occurrence of interface cracks can be more increased by using, as a charge transporting material for the surface protective layer, a charge transporting material whose oxidation potential is higher than that of a charge transporting material used for the photosensitive layer and further, by selecting a charge transporting material having a melting point of 170° C. or lower, for the surface protective layer.

The following are specific examples of the charge transporting material represented by any one of General Formulas (3) and (4). Note that the following are just examples, and the charge transporting materials of the present invention are not limited to the disclosed specific examples.

No. 1

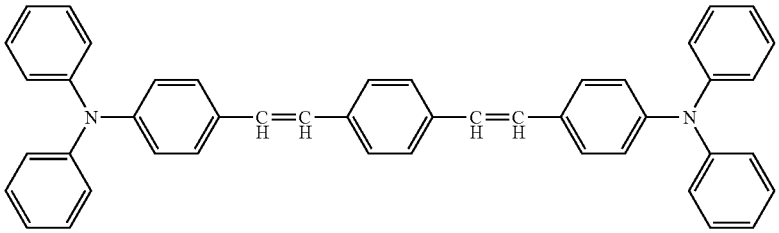

No. 2

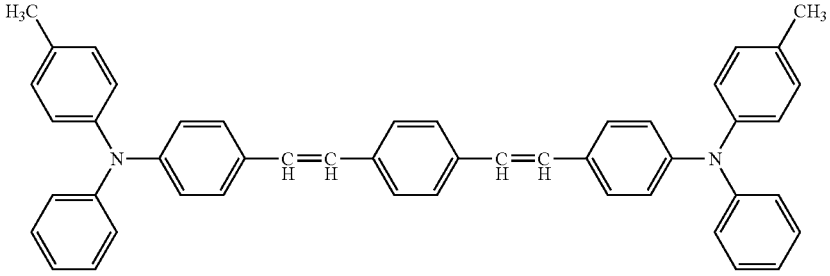

-continued
No. 3
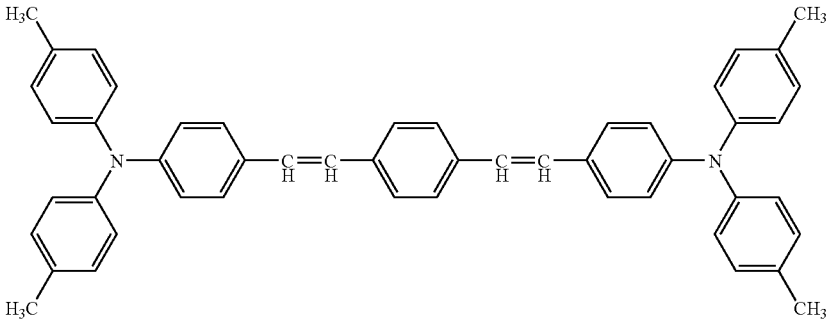
No. 4
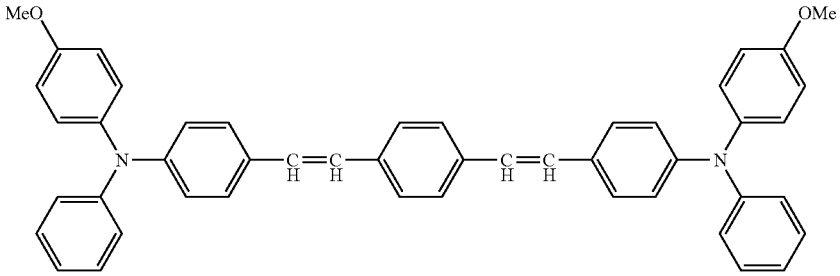
Me represents a methyl group.
No. 5
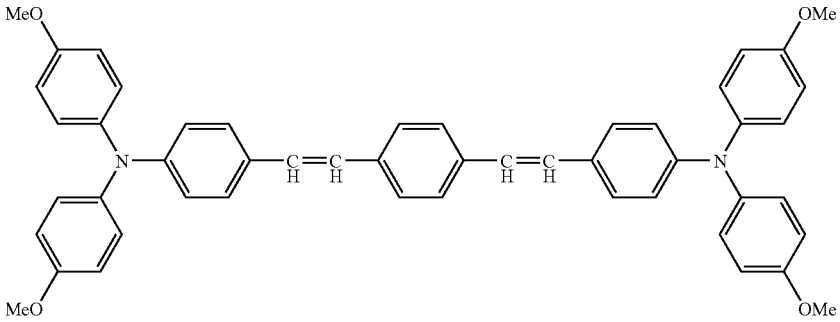
Me represents a methyl group.
No. 6
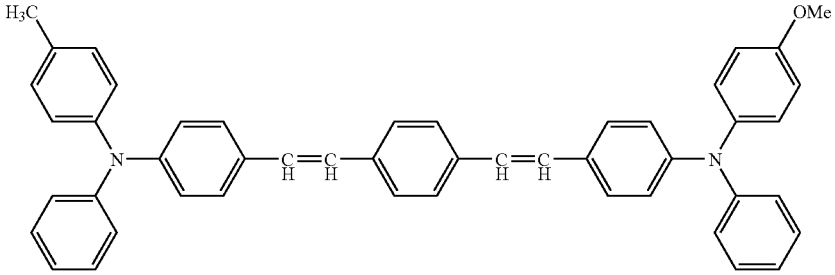
Me represents a methyl group.

-continued
No. 7
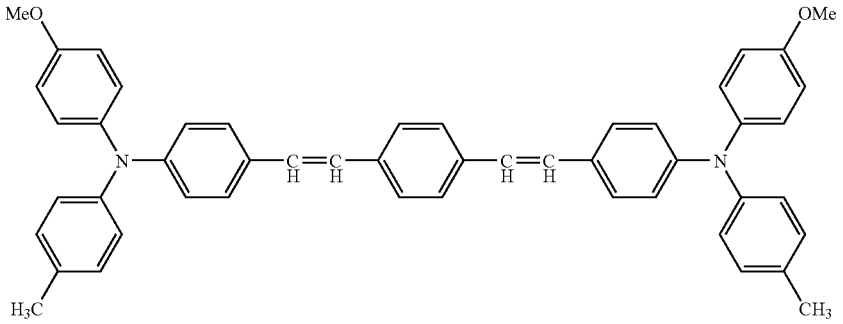
Me represents a methyl group.
No. 8
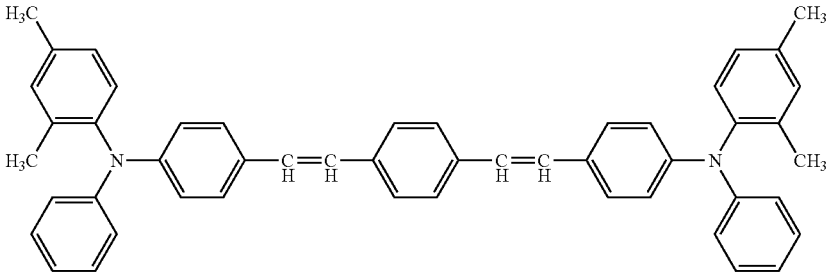
No. 9
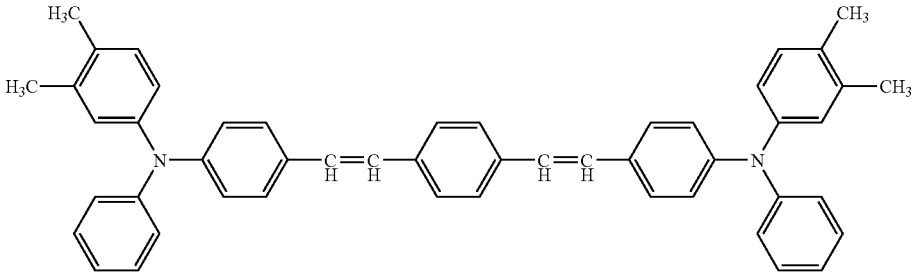
No. 10
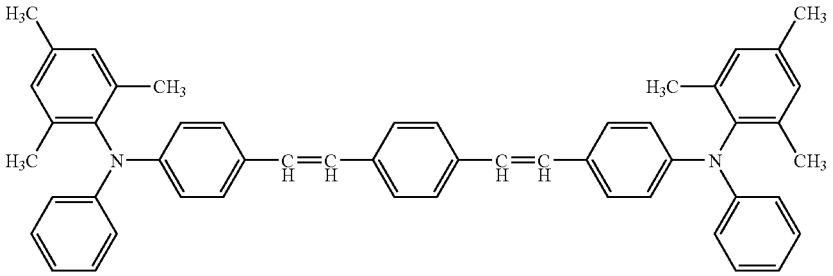
No. 11
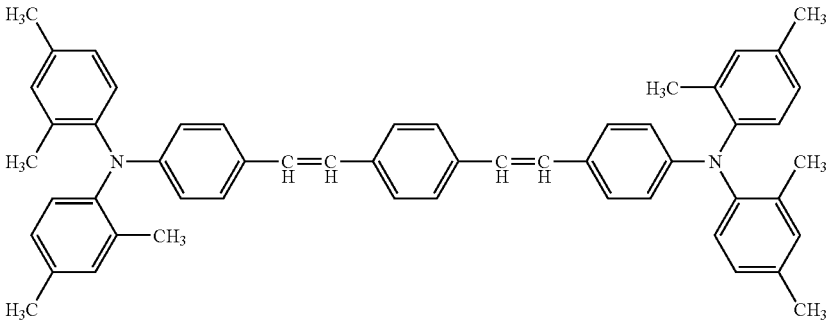

-continued
No. 12
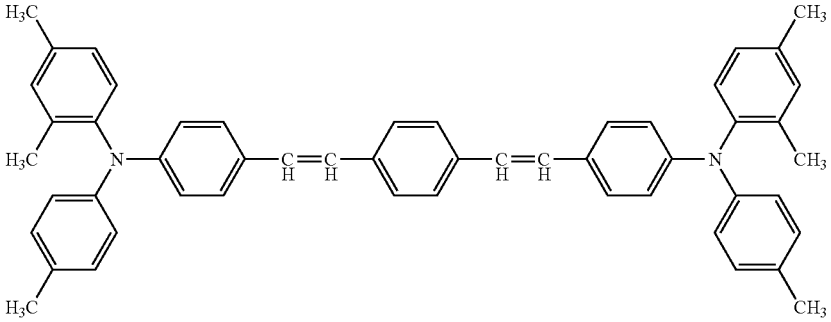
No. 13
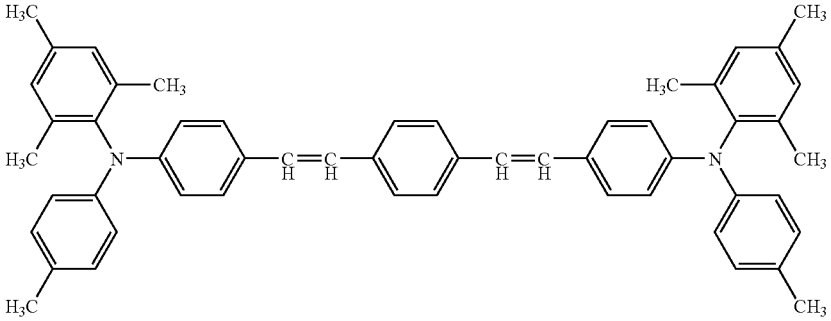
No. 14
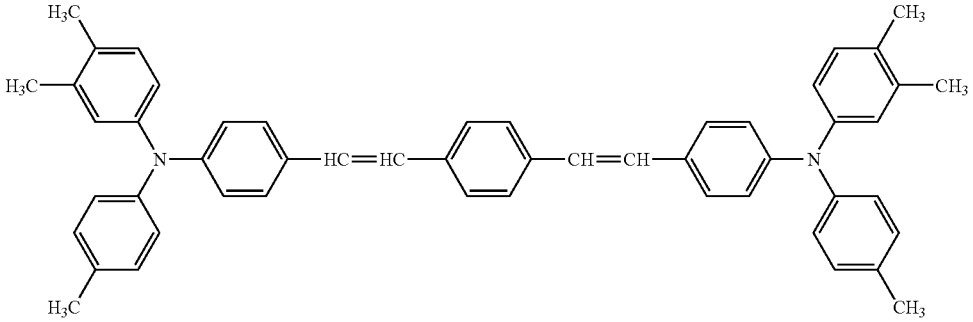
No. 15
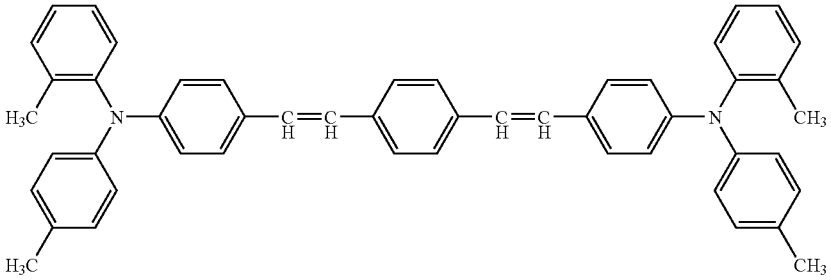
No. 16
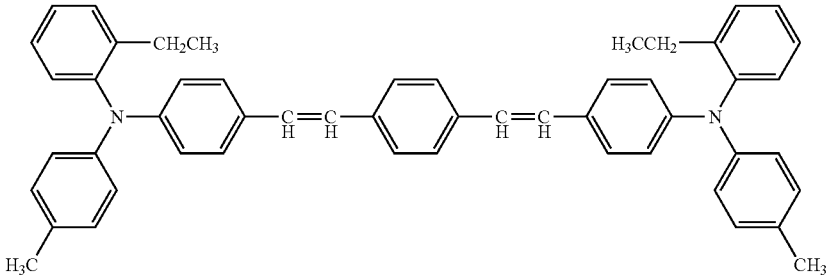

-continued
No. 17
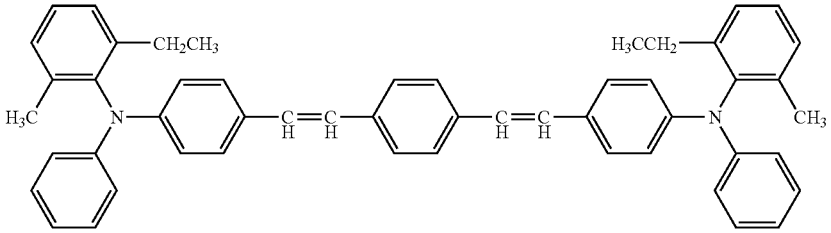
No. 18
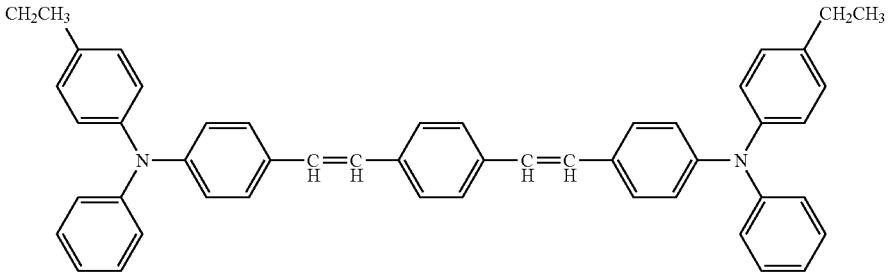
No. 19
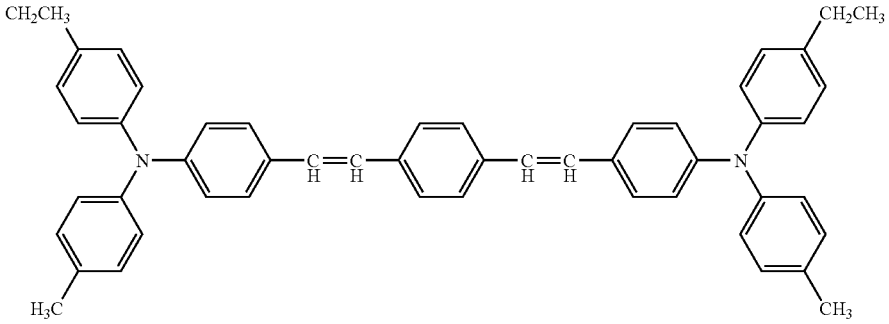
No. 20
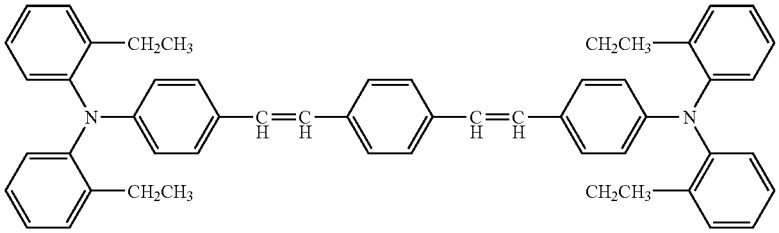
No. 21
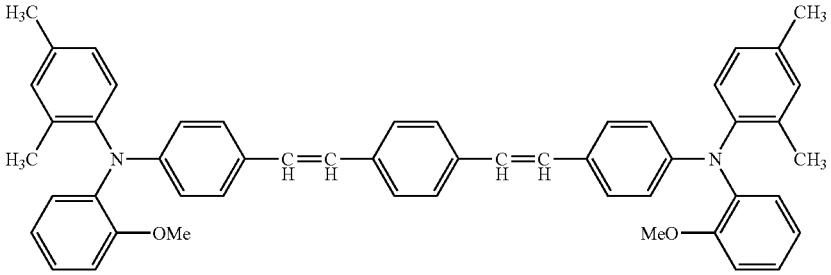
Me represents a methyl group.

-continued
No. 22
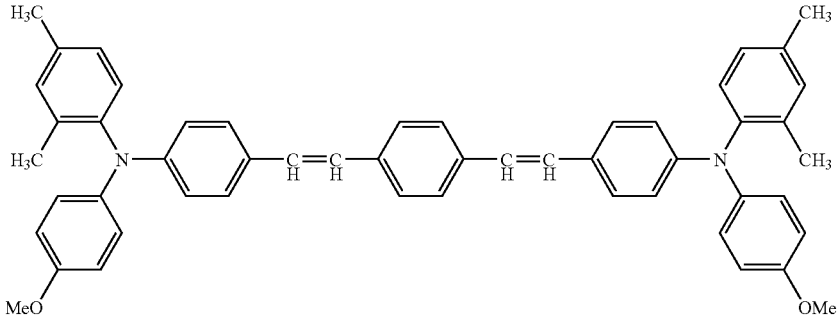
Me represents a methyl group.
No. 23
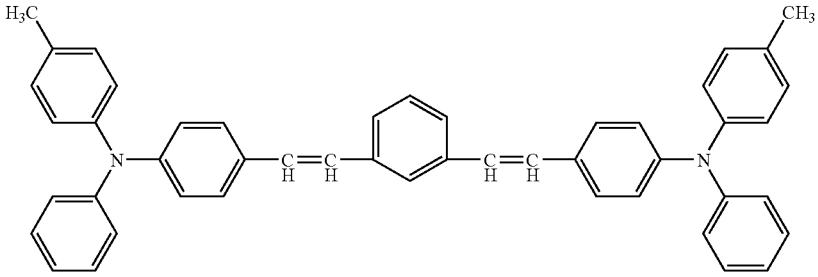
No. 24
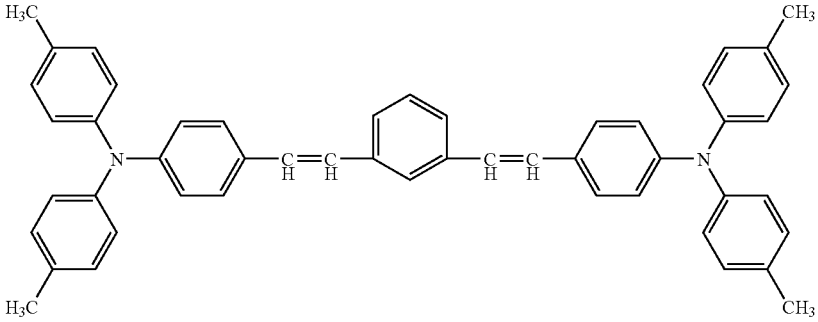
No. 25
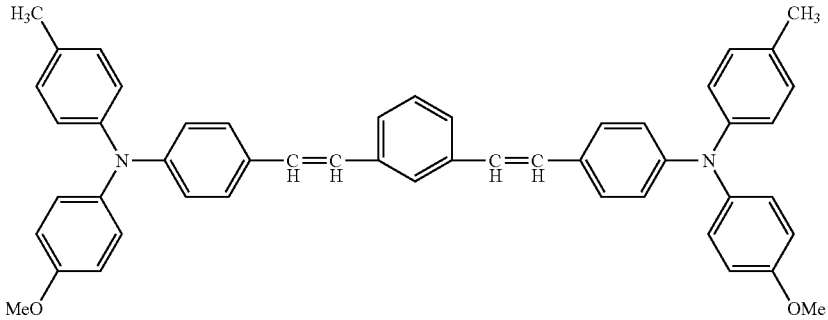
Me represents a methyl group.

-continued
No. 26
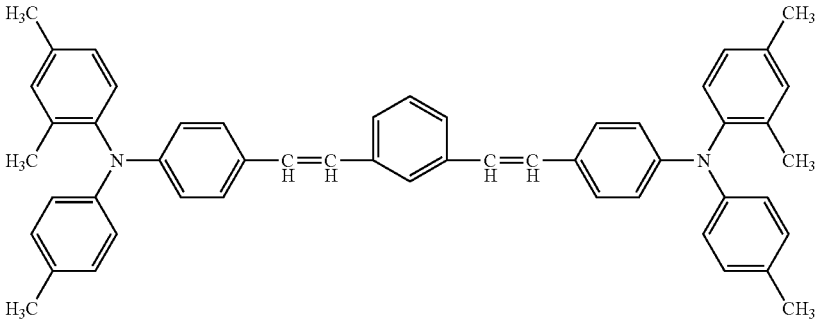
No. 27
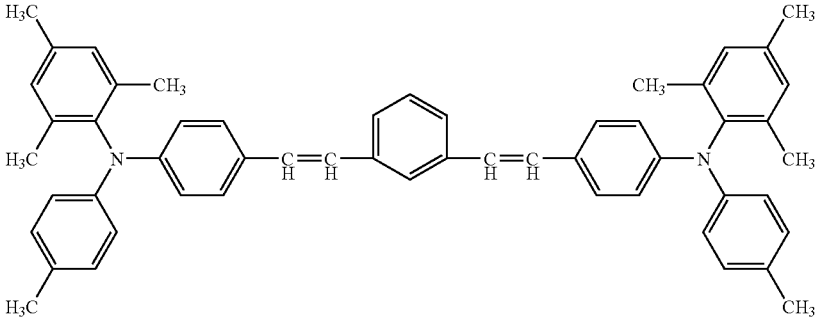
No. 28
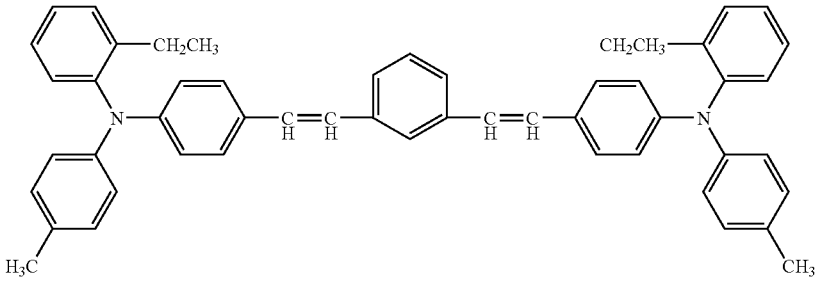
No. 29
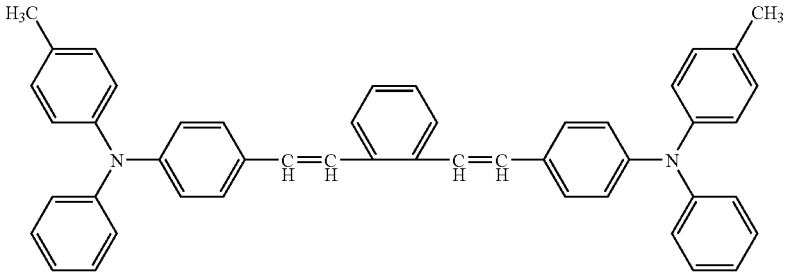
No. 30
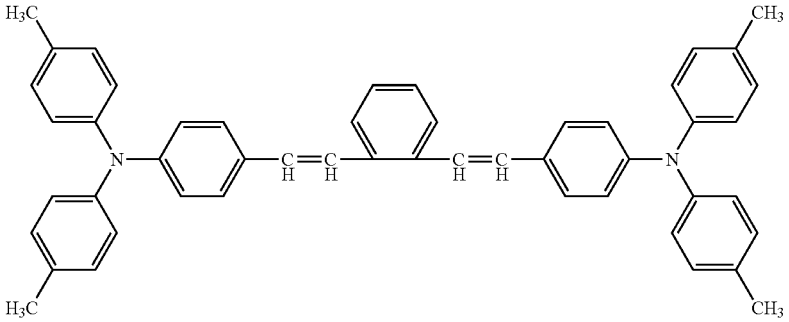

-continued
No. 31
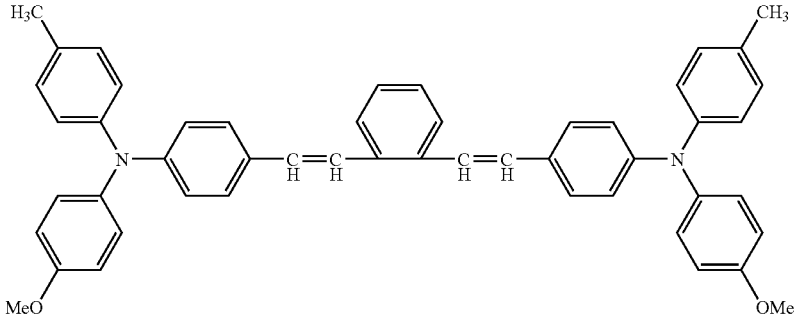
Me represents a methyl group.
No. 32
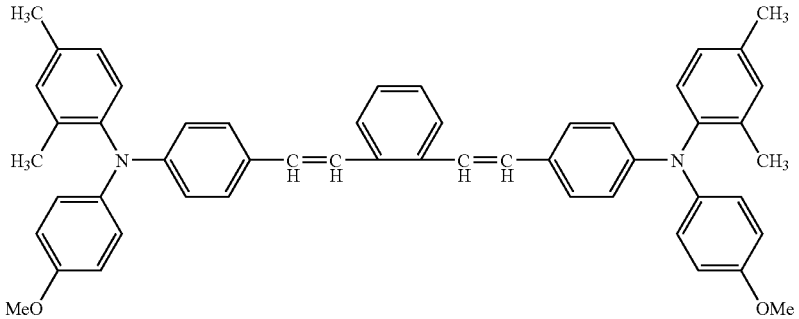
Me represents a methyl group.
No. 33
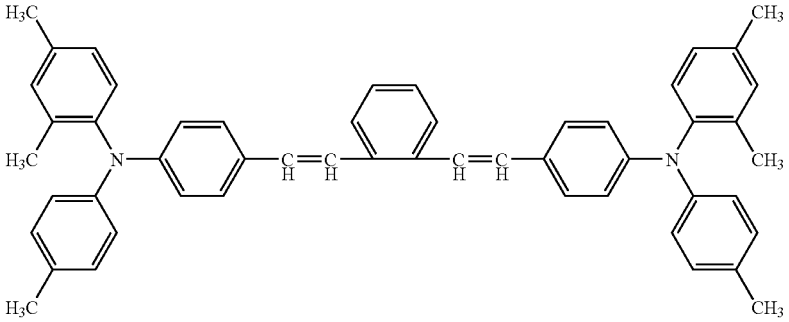
No. 34
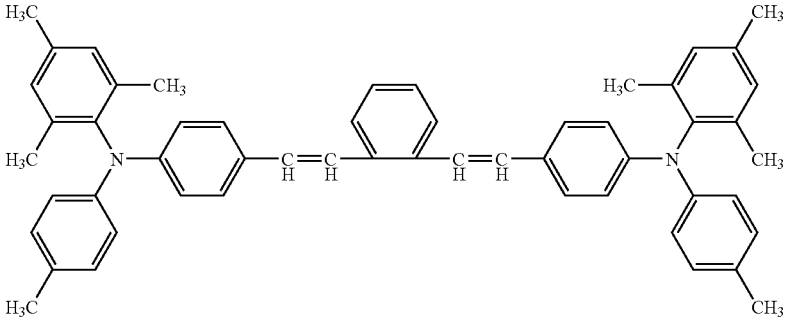
No. 35
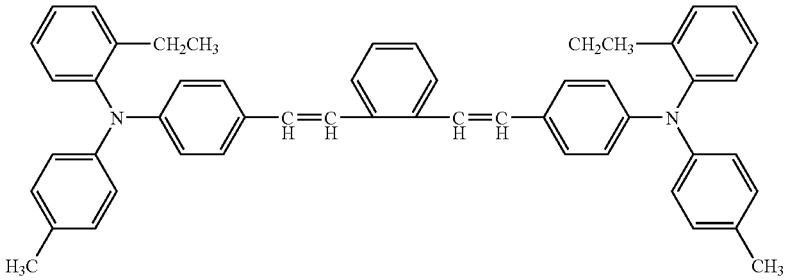

-continued
No. 36
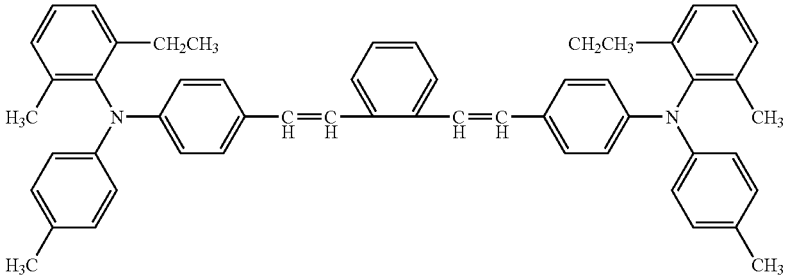
No. 37
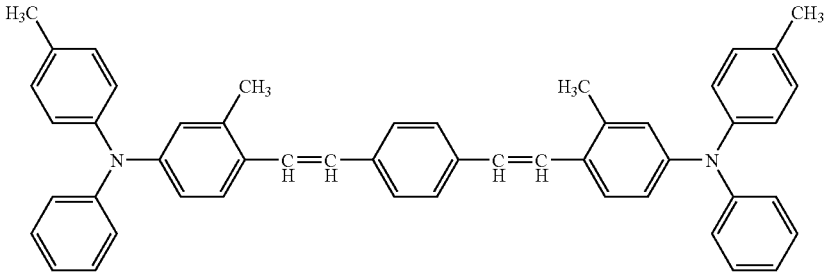
No. 38
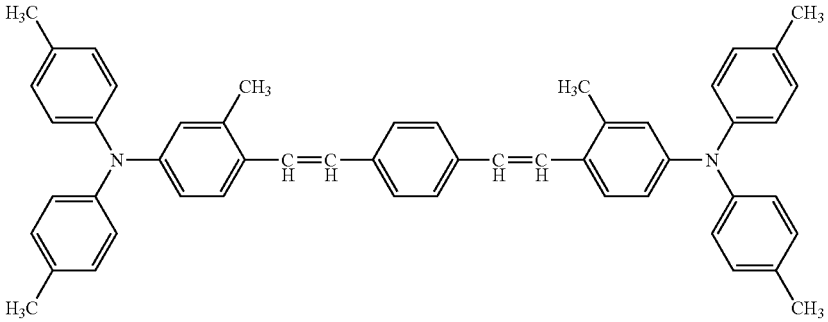
No. 39
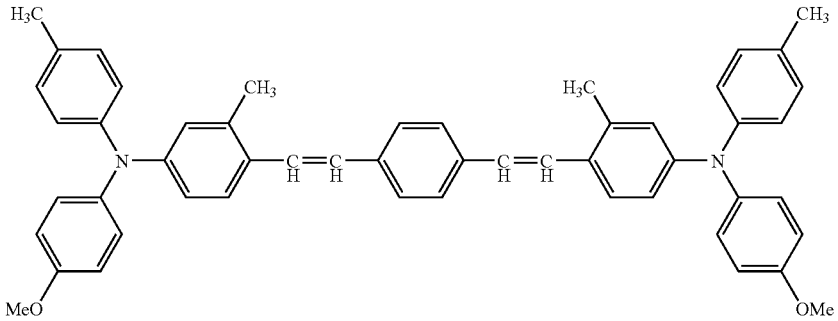
Me represents a methyl group.
No. 40
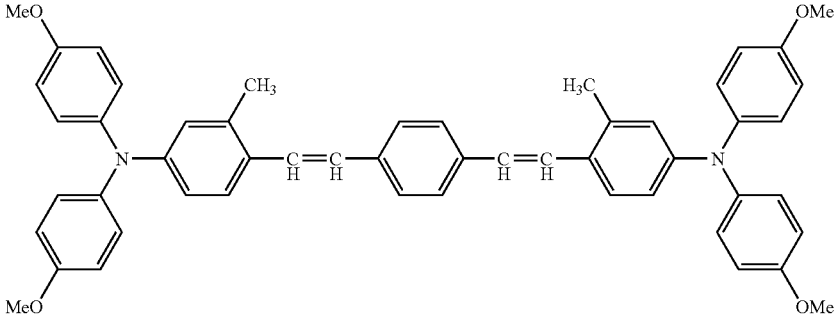
Me represents a methyl group.

-continued
No. 41
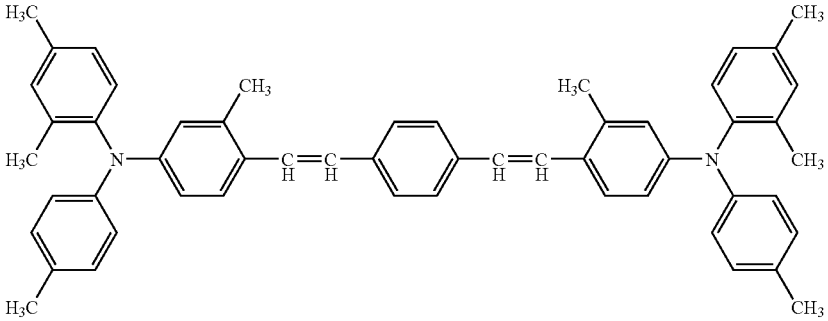
No. 42
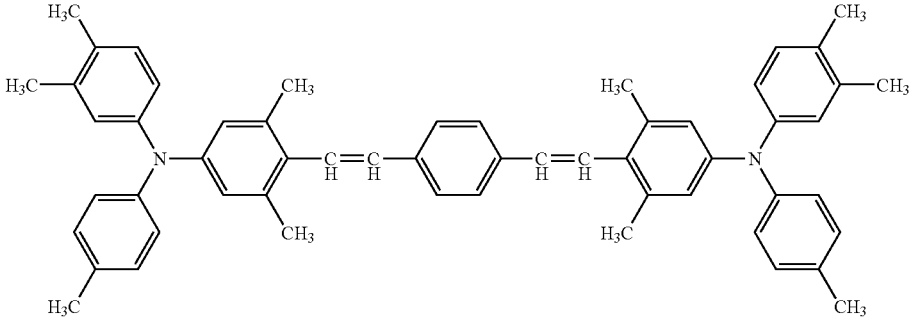
No. 43
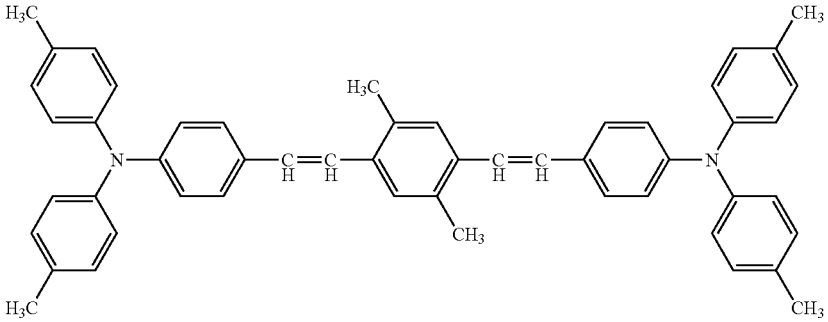
No. 44
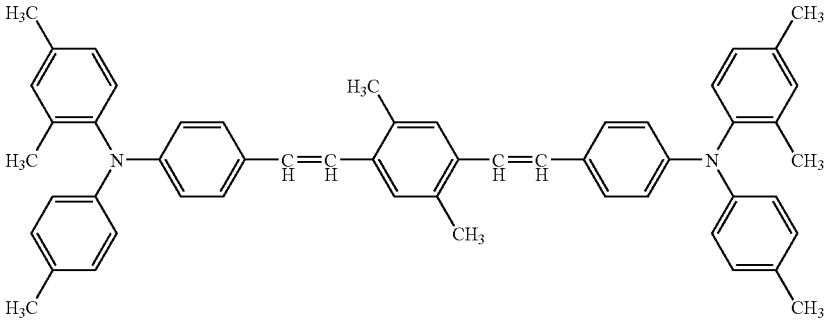
No. 45
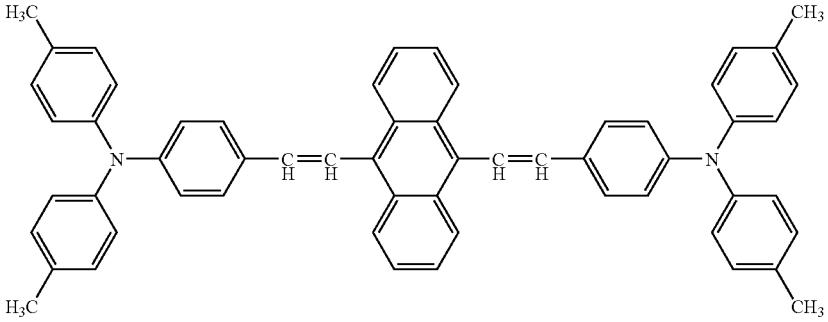

-continued
No. 46
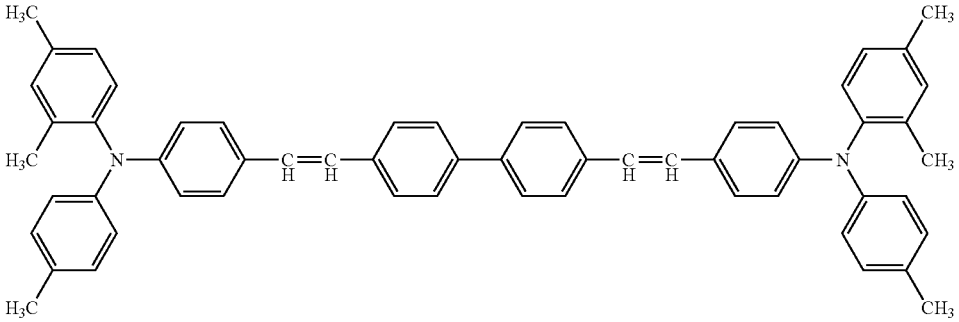
No. 47
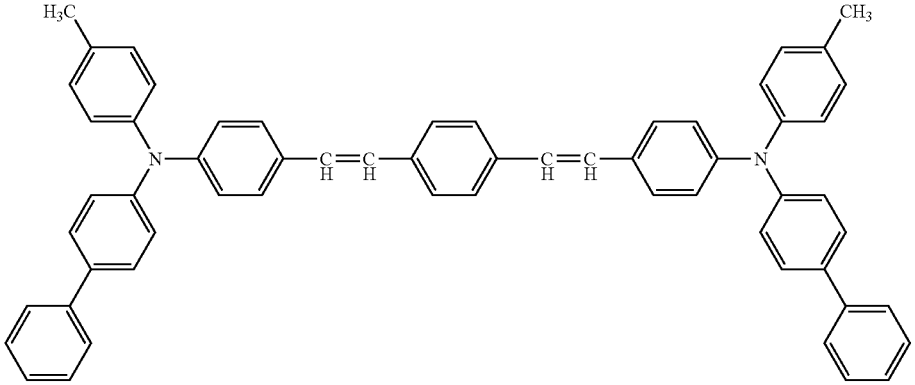
No. 48
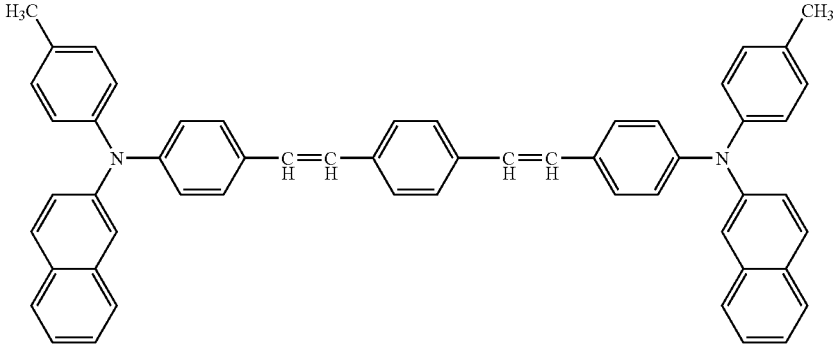
No. 49
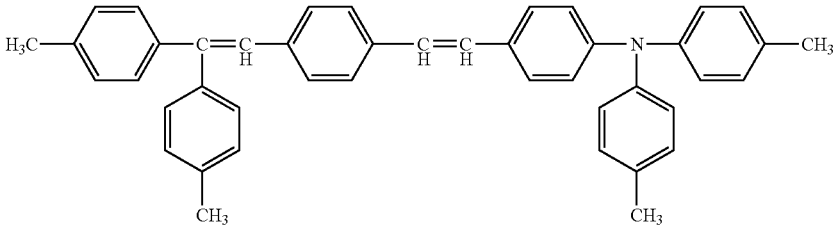
No. 50
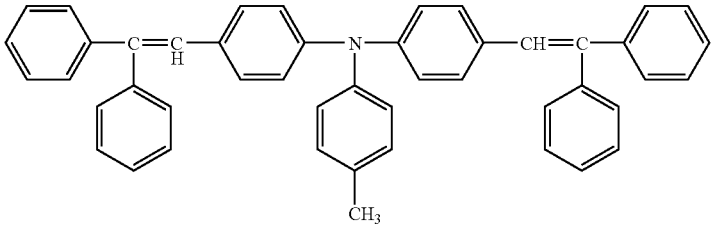

-continued
No. 51
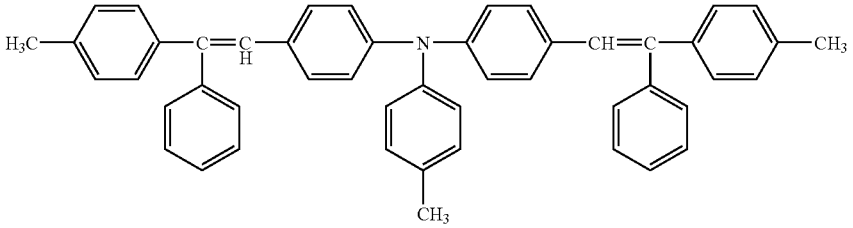
No. 52
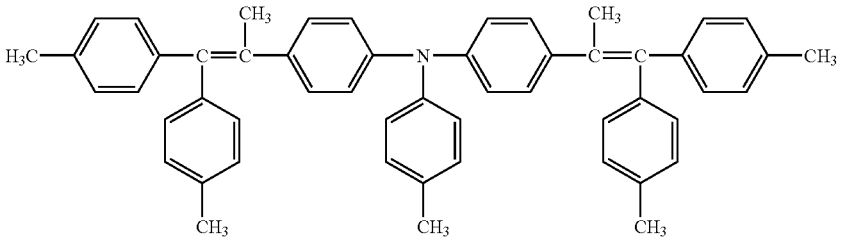
No. 53
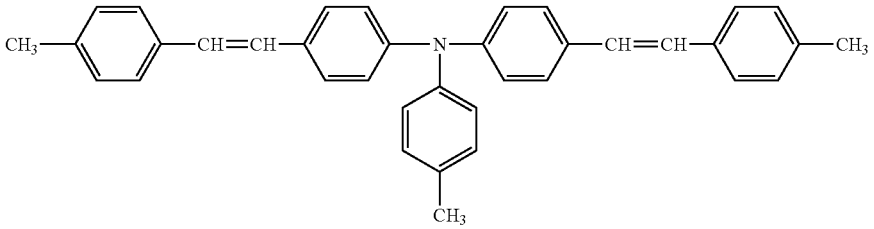
No. 54
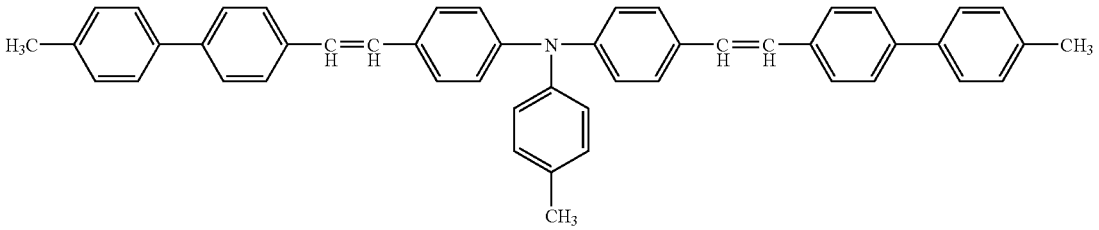
No. 55
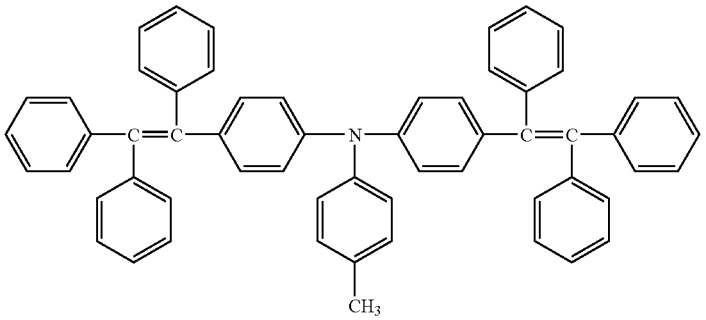

-continued

No. 56

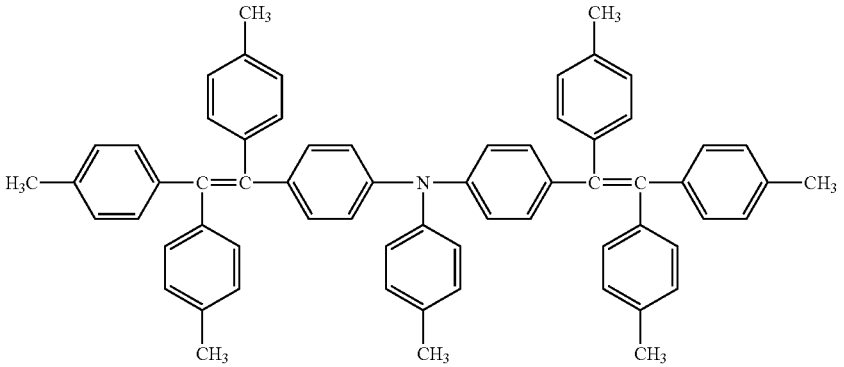

No. 57

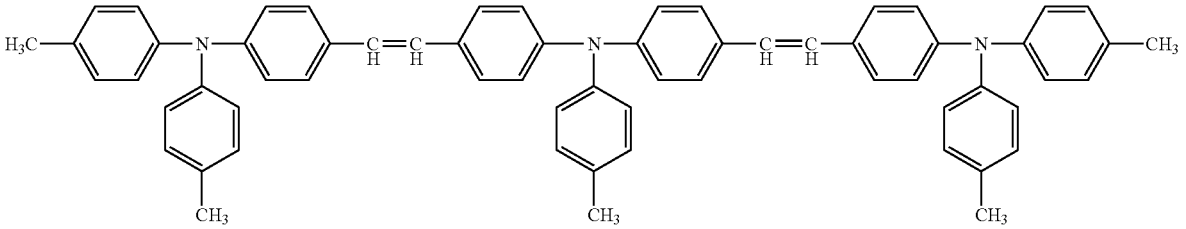

No. 58

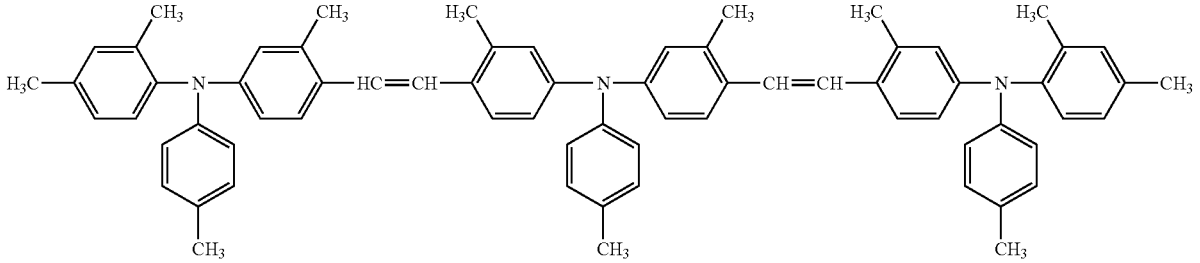

As the polymer charge transporting material, those having the following structures are exemplified.

(a) As a polymer having a carbazole ring, for example, poly-N-vinylcarbazole, and the compounds disclosed in Japanese Patent Application Laid-Open (JP-A) Nos. 50-82056, 54-9632, 54-11737, 4-175337, 4-183719, and 6-234841 are exemplified.

(b) As a polymer having a hydrazone structure, for example, the compounds disclosed in Japanese Patent Application Laid-Open (JP-A) Nos. 57-78402, 61-20953, 61-296358, 1-134456, 1-179164, 3-180851, 3-180852, 3-50555, 5-310904, and 6-234840.

(c) As a polysilylene polymer, for example, the compounds disclosed in Japanese Patent Application Laid-Open (JP-A) Nos. 63-285552, 1-88461, 4-64130, 4-264131, 4-264132, 4-264133, and 4-289867.

(d) As a polymer having a triarylamine structure, for example, N,N-bis(4-methylphenyl)-4-aminopolystyrene, and the compounds disclosed in Japanese Patent Application Laid-Open (JP-A) Nos. 1-134457, 2-282264, 2-304456, 4-133065, 4-133066, 5-40350, and 5-202135.

(e) As other polymers, for example, formaldehyde condensates of nitropyrene, and the compounds disclosed in Japanese Patent Application Laid-Open (JP-A) Nos. 51-73888, 56-150749, 6-234836, and 6-234837.

Besides, examples of the polymer charge transporting material include polycarbonate resins having a triarylamine structure, polyurethane resins having a triarylamine structure, polyester resins having a triarylamine structure, and polyether resins having a triarylamine structure; and the compounds disclosed in Japanese Patent Application Laid-Open (JP-A) Nos. 64-1728, 64-13061, 64-19049, 4-11627, 4-225014, 4-230767, 4-320420, 5-232727, 7-56374, 9-127713, 9-222740, 9-265197, 9-211877, and 9-304956.

Further, as a polymer having an electron-donating group, besides the above-mentioned polymers, copolymers with known monomers, block polymers, graft polymers, star polymers, and further, the crosslinked polymers having an electron-donating group as disclosed in Japanese Patent Application Laid-Open (JP-A) No. 3-109406 can also be used.

Examples of the binder resin include polystyrene, styrene-acrylonitrile copolymers, styrene-butadiene copolymers, styrene-maleic anhydride copolymers, polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, and phenoxy resins. These binder resins may be used alone or in combination.

The charge transporting layer may also contain a copolymer between a crosslinkable binder resin and a crosslinkable charge transporting material.

The amount of the charge transporting material is preferably 65 parts by mass to 200 parts by mass, and more preferably 70 parts by mass to 150 parts by mass relative to 100 parts by mass of the binder resin.

The charge transporting layer can be formed by dissolving and/or dispersing the charge transporting material and binder resin in an appropriate solvent to prepare a coating liquid, applying the coating liquid and drying the applied coating liquid. Besides the charge transporting material and the binder resin, additives such as plasticizer, antioxidant, and leveling agent can be further added to the charge transporting layer, as necessary.

The thickness of the charge transporting layer is preferably 40 μm or thinner from the viewpoint of the resolution and the responsiveness. The lower limit value of the thickness varies depending on the system used, in particular, depending on the charge potential, etc., however, it is preferably 15 μm or thicker.

—Single-Layer Type Photosensitive Layer—

The single-layer type photosensitive layer can be formed by dissolving and/or dispersing the charge generating material, a charge transporting material having an oxidation potential lower than that of a charge transporting material contained in the surface protective layer and represented by any one of General Formula (3) and (4), a binder resin, etc. in an appropriate solvent to prepare a coating liquid, applying the coating liquid onto a conductive support or an undercoat layer, and drying the applied coating liquid.

As to details of the charge generating material and the charge transporting material (charge transporting material and hole transporting material), materials exemplified in the above-noted charge generating layer and the charge transporting layer can be used. As the binder resin, in addition to the resins mentioned in the above-noted charge transporting layer, the resin mentioned in the charge generating layer may be used in the form of a mixture. As other components, for example, a plasticizer, fine particles, a variety of additives may be contained. Note that as the binder resin, the above-noted polymer charge transporting material can also be suitably used.

The amount of the charge generating material is preferably 5 parts by mass to 40 parts by mass, and more preferably 10 parts by mass to 30 parts by mass relative to 100 parts by mass of the binder resin. The amount of the charge transporting material is preferably 190 parts by mass or less, and more preferably 50 parts by mass to 150 pats by mass relative to 100 parts by mass of the binder resin.

The single-layer type photosensitive layer can be formed by dissolving and/or dispersing the charge generating material, the binder resin, and the charge transporting material in a solvent, such as tetrahydrofuran, dioxane, dichloroethane, cyclohexanone, toluene, methylethylketone, and acetone, to prepare a coating liquid, and applying the coating liquid by dip-coating, spray-coating, bead-coating, or ring-coating. As necessary, various additives such as a plasticizer, leveling agent, antioxidant, and lubricant can be added.

The thickness of the single-layer photosensitive layer is preferably 5 μm to 25 μm. The single-layer photosensitive layer has a shorter distance of charge transportation to the surface of an image bearing member than that of a photoconductor having a multilayered structure, but because of the structure in which a charge generating material is dispersed, the charge-transfer variation is large. Therefore, the effect of reducing the residual potential is not necessarily high. It is effective to employ a single-layer structure, but in the present invention, a multilayered structure is suitable because it is superior in exhibiting the effect to the single-layer structure.

The thickness of the single-layer type photosensitive layer is not particularly limited and may be suitably selected in accordance with the intended use. It is preferably 10 μm to 40 μm.

—Undercoat Layer—

As necessary, an undercoat layer may be provided between the support and the photosensitive layer. The undercoat layer is provided for the purpose of improving the adhesiveness, preventing moiré, improving the coating property of the upper layer, and reducing the residual potential, etc.

The undercoat layer contains at least a resin and a fine powder and further contains other components in accordance with the necessity.

Examples of the resin include water-soluble resins such as polyvinyl alcohol resins, and casein; alcohol-soluble resins such as copolymer nylons, and methoxymethylated nylons; and curable resins forming a three-dimensional net structure, such as polyurethane resins, melamine resins, alkyd-melamine resins, and epoxy resins.

Examples of the fine powder include metal oxides such as titanium oxide, silica, alumina, zirconium oxide, tin oxide, and indium oxide; metal sulfides, or metal nitrides.

Further, as the undercoat layer, those containing a silane coupling agent, a titanium coupling agent, a chrome coupling agent, or the like may also be used. Furthermore, as the undercoat layer, those formed using $Al_2O_3$ by anodization, and those formed using an organic material such as polyparaxylylene (parylene) or an inorganic material such as $SiO_2$, $SnO_2$, $TiO_2$, ITO, $CeO_2$ by vacuum thin film deposition can also be used.

The thickness of the undercoat layer is not particularly limited and may be suitably selected in accordance with the intended use. It is preferably 0.1 μm to 10 μm, and more preferably 1 μm to 5 μm.

In the photoconductor, an intermediate layer may be provided on the support as necessary, for the purpose of improving the adhesiveness, and the charge blocking property. The intermediate layer mainly contains a resin, however, in consideration of applying the photosensitive layer on the resin with a solvent, the resin is preferably highly resistant to organic solvents. The resin can be suitably selected from those used in the undercoat layer.

—Additives—

In the electrophotographic photoconductor of the present invention, for the purpose of improving the environmental resistance, in particular, for the purpose of preventing the reduction of photosensitivity and the increase in residual potential, an antioxidant, plasticizer, lubricant, ultraviolet ray absorber, low-molecular weight charge transporting material and leveling agent can be added to each layer of the charge generating layer, the charge transporting layer, the undercoat layer, the surface protective layer, and the single-layer type photosensitive layer.

Further, as described above, to prevent cracks which are liable to occur at the interface between the photosensitive layer and the surface protective layer, it is preferable that a low-molecular weight additive having a melting point of 150° C. or lower be added in the surface protective layer in an amount of 2.5% by mass to 10% by mass relative to the additive amount of the charge transporting material contained in the photosensitive layer. It is particularly preferable to incorporate, as a low-molecular weight additive, at least one of compounds having a melting point of 150° C. or lower and each represented by any one of the following Structural Formulas (1) to (3), in the photosensitive layer, because not only a preventive effect of the occurrence of interface cracks, but also the occurrence of image blurring can be reduced, thereby a long lived photoconductor can be achieved.

Structural Formula (1)

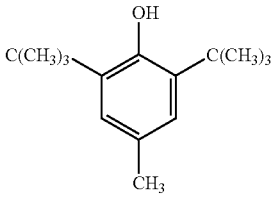

Structural Formula (2)

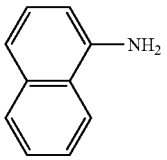

Structural Formula (3)

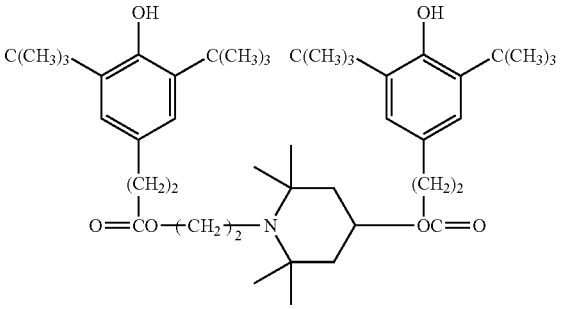

Examples of the antioxidant include phenol compounds, paraphenylene diamines, organic sulfur compounds, and organic phosphorus compounds.

Examples of the phenol compounds include 2,6-di-t-butyl-p-cresol, butylated hydroxyanisole, 2,6-di-t-butyl-4-ethylphenol, stearylβ-(3,5-di-t-butyl-4-hydroxyphenyl)propionate, 2,2'-methylene-bis-(4-methyl-6-t-butylphenol, 2,2'-methylene-bis-(4-ethyl-6-t-butylphenol), 4,4'-thiobis-3-methyl-6-t-butylphenol), 4,4'-butyridenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[metylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Examples of the paraphenylene diamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl-5-methylhydroquinone.

Examples of the organic sulfur compounds include dilauryl-3,3'-thiodipropyonate, distearyl-3,3'-thiodipropyonate, and ditetradecyl-3,3'-thiodipropyonate.

Examples of the organic phosphorous compounds include triphenylphosphine, tri(nonylphenyl)phosphine, tri(dinonylphenyl)phosphine, tricresyl phosphine, and tri(2,4-dibutylphenoxy)phosphine.

These compounds are known as antioxidants for rubbers, plastics, and oils and are commercially available.

The additive amount of the antioxidant is preferably 0.01% by mass to 10% by mass relative to the total mass of a layer to which the antioxidant is added.

The plasticizer that can be added to each layer is not particularly limited and may be suitably selected in accordance with the intended use. Examples thereof include phosphoric acid ester plasticizers, phthalic acid ester plasticizers, aromatic carboxylic acid ester plasticizers, aliphatic dibasic acid ester plasticizers, fatty acid ester derivatives, oxy acid ester plasticizers, epoxy plasticizers, divalent alcohol ester plasticizers, chlorine-containing plasticizers, polyester plasticizers, sulfonic acid derivatives, citric acid derivatives, and other plasticizers.

Examples of the phosphoric acid ester plasticizers include triphenyl phosphate, tricresyl phosphate, trioctyl phosphate, octyl diphenyl phosphate, trichloroethylene phosphate, cresyl diphenyl phosphate, tributyl phosphate, tri-2-ethylhexyl phosphate, and triphenyl phosphate.

Examples of the phthalic acid ester plasticizers include dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dichlohexyl phthalate, butylbenzyl phthalate, butyl lauryl phthalate, methyl oleyl phthalate, octyldecyl phthalate, dibutyl phthalate, and dioctyl phthalate.

Examples of the aromatic carboxylic acid ester plasticizers include trioctyl trimellitic acid, tri-n-octyl trimellitic acid, and octyl oxybenzoate.

Examples of the aliphatic dibasic acid ester plasticizers include dibutyl adipate, di-n-hexyl adipate, di-2-ethylhexyl adipate, di-n-octyl adipate, n-octyl-n-decyl adipate, diisodecyl adipate, dicaprylic adipate, di-2-ethylhexyl azelate, dimethyl sebacate, diethyl sebacate, dibutyl sebacate, di-n-octyl sebacate, di-2-ethylhexyl sebacate, 2-ethoxyethyl sebacate, dioctyl succinate, diisodecyl succinate, dioctyl tetrahydrophthalate, and di-n-octyl tetrahydrophthalate.

Examples of the fatty acid ester derivatives include butyl oleate, glycerine monoleate ester, acetyl methyl ricinoleate, pentaerythritol ester, dipentaerythritol hexa ester, tri acetine, and tributyrin.

Examples of the oxy acid ester plasticizers include acetyl methyl ricinoleate, acetyl butyl ricinoleate, butyl phthalyl butyl glycolate, and acetyl tributyl citrate.

Examples of the epoxy plasticizers include epoxylated soybean oil, epoxylated linseed oil, epoxy butyl stearate, epoxy decyl stearate, epoxy octyl stearate, epoxy benzyl stearate, epoxy dioctyl hexahydrophthalate, and epoxy dodecyl hexahydrophthalate.

Examples of the dibasic alcohol ester plasticizers include diethylene glycol dibenzoate, and triethylene glycol di-2-ethyl butyrate.

Examples of the chlorine-containing plasticizers include chlorinated paraffin, chlorinated diphenyl, chlorinated methyl fatty acid, and methoxychlorinated methyl fatty acid.

Examples of the polyester plasticizers include polypropylene adipate, polypropylene sebacate, polyester, and acetylated polyester.

Examples of the sulfonic acid derivatives include p-toluenesulfoneamide, o-toluenesulfoneamide, p-toluenesulfone ethylamide, o-toluenesulfone ethylamide, toluenesulfone-N-ethylamide, and p-toluenesulfone-N-cyclohexylamide.

Examples of the citric acid derivatives include triethyl citrate, triethyl acetyl citrate, tributyl citrate, tributyl acetyl citrate, tri-2-ethylhexyl acetyl-citrate, and acetyl-n-octyldecyl citrate.

Examples of the other plasticizers include tarphenyl, partially hydrogenerated tarphenyl, camphor, 2-nitrodiphenyl, dinonyl naphthalene, and methyl abietate.

The lubricant that can be added to each layer is not particularly limited and may be suitably selected in accordance with the intended use. Examples thereof include hydrocarbon compounds, fatty acid compounds, fatty acid amide compounds, ester compounds, alcohol compounds, metal soaps, natural waxes, and other lubricants.

Examples of the hydrocarbon compounds include liquid paraffin, paraffin waxes, micro waxes, and low polymer polyethylenes.

Examples of the fatty acid compounds include lauric acid, myristic acid, palmitic acid, stearic acid, arachidic acid, and behenic acid.

Examples of the fatty acid amide compounds include stearyl amide, palmityl amide, oleinamide, methylene bis stearoamide, and ethylene bis stearoamide.

Examples of the ester compounds include lower alcohol esters of fatty acids, polyvalent alcohol esters of fatty acids, and fatty acid polyglycol esters.

Examples of the alcohol compounds include cetyl alcohols, stearyl alcohols, ethylene glycols, polyethylene glycols, and polyglycerols.

Examples of the metal soaps include lead stearate, cadmium stearate, barium stearate, calcium stearate, zinc stearate, and magnesium stearate.

Examples of the natural waxes include carnauba wax, candelilla wax, bees wax, whale wax, privet wax, and montan wax.

Examples of the other lubricants include silicone compounds, and fluorine compounds.

The ultraviolet absorbers that can be added to each layer is not particularly limited and may be suitably selected in accordance with the intended use. Examples thereof include benzophenone ultraviolet absorbers, salicylate ultraviolet absorbers, benzotriazole ultraviolet absorbers, cyanoacrylate ultraviolet absorbers, quencher (metal complex) ultraviolet absorbers, and HALS (hindered amine).

Examples of the benzophenone ultraviolet absorbers include 2-hydroxybenzophenone, and 2,4-dihydroxybenzophenone, 2,2',4-trihydroxybenzophenone, 2,2',4,4'-tetrahydroxybenzophenone, and 2,2'-dihydroxy-4-methoxy benzophenone.

Examples of the salicylate ultraviolet absorbers include phenyl salicylate, and 2,4-di-t-butylphenyl-3,5-t-butyl-4-hydroxybenzoate.

Examples of the benzotriazole ultraviolet absorbers include (2'-hydroxyphenyl)benzotriazole, (2'-hydroxy-5'-methylphenyl)benzotriazole, (2'-hydroxy-5'-methylphenyl) benzotriazole, and (2'-hydroxy-3'-tertiary butyl-5'-methylphenyl)5-chlorobenzotriazole.

Examples of the cyanoacrylate ultraviolet absorbers include ethyl-2-cyano-3,3-diphenyl acrylate, and methyl-2-carbomethoxy-3(paramethoxy)acrylate.

Examples of the quencher (metal complex) ultraviolet absorbers include nickel(2,2'thiobis(4-t-octyl)phenolate)normal butyl amine, nickel dibutyldithio carbamate, cobalt dicyclohexyl dithio phosphate.

Examples of the HALS (hindered amine) include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propyonyloxy]ethyl]-4-[3-(3,5-di-t-butyl-4-hydroxyphenylpropyonyloxy)-2,2,6,6-tetramethylpyridine, 8-benzyl-7,7,9,9-tetramethyl-3-octyl-1,3,8-triazaspiro [4,5] undecane-2,4-dione, and 4-benzoyloxy-2,2,6,6-tetramethyl piperidine.

(Image Forming Apparatus and Image Forming Method)

The image forming apparatus of the present invention has at least an electrophotographic photoconductor, a charging unit, an exposing unit, a developing unit, a transfer unit and a fixing unit, and further has other units suitably selected in accordance with the necessity, for example, a cleaning unit, a charge eliminating unit, a lubricant dispensing unit, a recycling unit, a controlling unit, etc.

The electrophotographic photoconductor is the above-explained electrophotographic photoconductor of the present invention.

The image forming method used in the present invention includes at least a charging step, an exposing step, a developing step, a transferring step, and a fixing step, and further includes other steps suitably selected in accordance with the necessity, for example, a cleaning step, a charge eliminating step, a lubricant dispensing step, a recycling step, a controlling step, etc.

The image forming method used in the present invention can be favorably carried out by the image forming apparatus of the present invention. Specifically, the charging step can be performed by the charging unit; the exposing step can be performed by the exposing unit; the developing step can be performed by the exposing unit; the transferring step can be performed by the transfer unit; the fixing step can be performed by the fixing unit; the cleaning step can be performed by the cleaning unit; and the other steps can be performed by the other units.

—Charging Step and Charging Unit—

The charging step is a step of charging a surface of an electrophotographic photoconductor and performed by the charging unit.

The charging unit is not particularly limited, as long as it can uniformly charge a surface of the electrophotographic photoconductor by applying a voltage, and may be suitably selected in accordance with the intended use.

As a non-contact type charging unit, for example, a non-contact charger utilizing a corona discharge, a needle electrode device, and a solid discharging device; a conductive or semiconductive charge roller provided with a minute gap with a latent electrophotographic photoconductor exemplified. Of these, a corona discharge type charger is particularly preferable.

The corona discharge method is a non-contact charging method which gives positive or negative ions generated by corona discharge in air to a surface of an electrophotographic photoconductor, and there are the following two types of corona discharging devices: a corotron charger having properties capable of giving a constant charge amount to an electrophotographic photoconductor, and a scorotron charger having properties capable of giving a constant potential to an electrophotographic photoconductor.

The corotron charger is composed of a casing electrode which occupies a half space around a discharge wire which is placed nearly a center of the charger.

The scorotron charger has a structure similarly to the corotron charger, except that it further has a grid electrode, and the grid electrode is arranged at the position which is 1.0 mm to 2.0 mm away from a surface of an electrophotographic photoconductor.

—Exposing Step and Exposing Unit—

The exposure can be carried out, for example, by image-wise exposing a surface of the electrophotographic photoconductor using the exposing unit.

Optical systems used for the exposure may be broadly classified into analogue optical systems and digital optical systems. The analogue optical systems are those projecting directly an original image onto a surface of an electrophotographic photoconductor, and the digital optical systems are those where image information is input as electric signals, the electric signals are then converted into optical signals, and the electrophotographic photoconductor is exposed to form an image.

The exposing unit is not particularly limited, as long as being capable of image wise exposing a surface of an electrophotographic photoconductor that has been charged by the charging unit. Examples of the exposing unit include various exposure systems such as optical reproducing systems, rod-lens-eye systems, optical laser systems, optical liquid crystal shutter systems, and LED optical systems. Of these, a semiconductor laser (LD) or a light emitting diode (LED) which is capable of digitally writing a latent electrostatic image on a surface of the electrophotographic photoconductor is particularly preferable.

Further, a light source incorporating a multi-beam writing head where a plurality of the above-noted semiconductor laser (LD) elements are arrayed in a main scanning direction or a sub-scanning direction of a photoconductor may be used.

Figure 12:
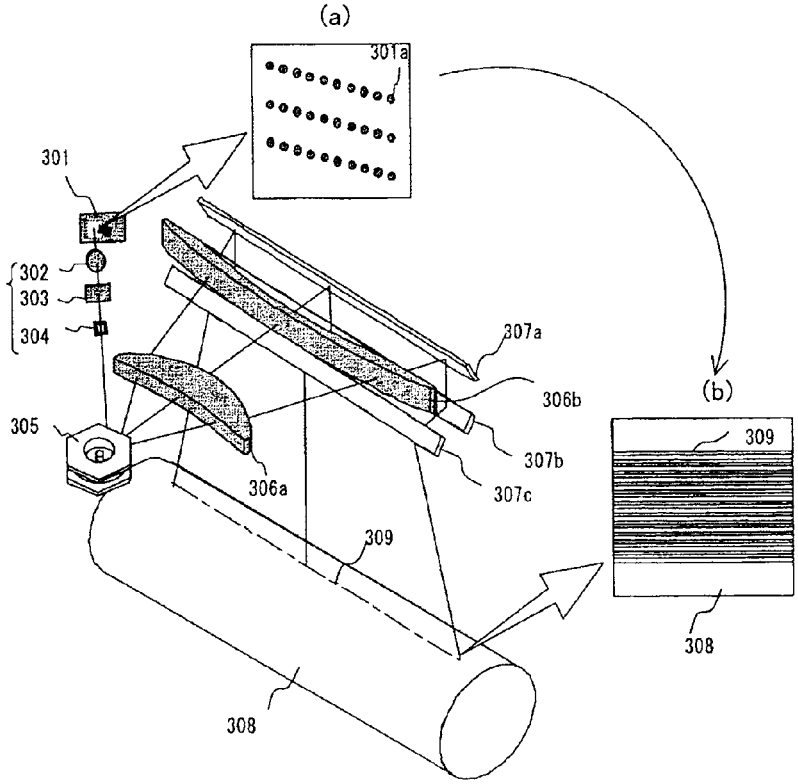
FIG. 12 is a schematic diagram showing one example of a multi-beam exposing device used in the present invention.

Hereinbelow, an example of a multi-beam exposing unit used in the present invention is illustrated in FIG. 12. In FIG. 12, (a) is an enlarged diagram showing an optical source used in the multi-beam exposing device; and (b) is an enlarged scanning line diagram of the optical source.

A plurality of laser beams emitted from an optical source 301 where a plurality of luminous spots 301*a* are one-dimensionally or two-dimensionally arranged are collimated or substantially collimated by a collimated lens 302 and then polarized in a main scanning direction by a polygon mirror 305 via a cylindrical lens 303 and an aperture 304. The laser beams polarized by the polygonal mirror 305 is converged into a convergence light beam by a first scanning lens 306*a* and a second scanning lens 306*b*, formed into an image on a surface of a photoconductor 308 via a first reflecting mirror 307*a*, a second reflecting mirror 307*b* and a third reflecting mirror 307*c*, and scanned in a main scanning direction onto the photoconductor.

As the optical source of the multi-beam exposing unit, an end-face emitting laser and a plane-emitting laser can be used. In particular, a plane-emitting laser makes it possible to form a laser array in which luminous spots are two-dimensionally arranged and is effective in achieving speed-up and downsizing of an image forming apparatus and improving the resolution of images.

In the present invention, a backlight system may be employed for the exposure, in which the electrophotographic photoconductor is imagewise-exposed from the back side thereof.

—Developing Step and Developing Unit—

The developing step is a step of developing the latent electrostatic image using a toner and/or a developer to form a visible image.

Formation of the visible image can be performed, for example, by developing the latent electrostatic image using the toner and/or a developer and can be performed by the developing unit.

The developing unit is not particularly limited and may be suitably selected from among known developing devices, as long as being capable of developing a latent electrostatic image using, for example, a toner and/or a developer. A developing system is preferably exemplified which has at least a developing unit capable of housing the toner and/or developer therein and supplying the toner and/or developer to the latent electrostatic image in a contact or non-contact manner.

The developing unit may employ a dry developing process or a wet developing process. Further, the developing unit may be a monochrome developing unit or a multi-color developing unit. Preferred are, for example, a developing unit having a stirrer that can frictionally stir the toner and/or developer so as to be charged, and a rotatable magnet roller.

In the developing unit, for example, the toner and a carrier are mixed and agitated, which causes a friction to charge the toner and maintains the charted toner in a state of being held vertically on a surface of the rotating magnet roller to form a magnetic brush thereon. The magnet roller is set near the electrophotographic photoconductor (photoconductor), therefore, a part of the toner constituting the magnetic brush formed on the surface of the magnetic roller transfers to a surface of the electrophotographic photoconductor by electrical attraction. As a result, the electrostatic image is developed with the toner, and a visible image formed of the toner is then formed on the surface of the electrophotographic photoconductor.

The developer to be housed in the developing unit is a developer containing the toner, and may be a one-component developer or a two-component developer.

—Transferring Step and Transfer Unit—

The transferring step is a step of transferring the visible image onto a recording medium. A preferred aspect of the transferring step is that a visible image is primarily transferred onto an intermediate transfer member, and the visible image is secondarily transferred onto a recording medium. A more preferred aspect of the transferring step includes primarily transferring a visible image onto an intermediate transfer member to form a composite transfer image, and secondarily transferring the composite transfer image onto a recording medium.

The visible-image transfer may be carried out, for example, by charging the electrophotographic photoconductor using a transfer charger, which may be performed by the transfer unit. A preferred aspect of the transfer unit includes a primary transfer unit configured to primarily transfer a visible image onto an intermediate transfer member so as to form a composite transfer image, and a secondary transfer member configured to secondarily transfer the composite transfer image onto a recording medium.

The intermediate transfer member is not particularly limited and may be suitably selected from among known transfer members in accordance with the intended use. For example, a transfer belt, or the like is preferably exemplified.

The transfer unit, i.e., the primary transfer unit and the secondary transfer unit, preferably has at least a transferer that is configured to charge the electrostatic photoconductor so as to separate the visible image formed thereon and to transfer the visible image onto a recording medium. Examples of the transferer include corona transferers utilizing corona discharge, transfer belts, transfer rollers, pressure-transfer rollers, and adhesion transferers.

As the recording medium, a typical recording medium is regular paper, however, it is not particularly limited as long as being capable of receiving a transferred-unfixed image after developing, and may be suitably selected in accordance with the intended use. PET bases for OHP may also be used therefor.

—Fixing Step and Fixing Unit—

The fixing step is a step of fixing the transferred visible image on the recording medium using a fixing unit. The fixing step may be carried out for each color toner at every transfer of a visible image onto a recording medium, or may be carried out for color toner images all together in a state where all the color toners are superimposed.

The fixing unit is not particularly limited and may be suitably selected in accordance with the intended use, however, a fixing device having fixing members and a heat source for heating the fixing members is preferably used.

Examples of the fixing members include a combination of an endless belt and a roller, and a combination of a roller and a roller. In view of shorter warm-up period and energy saving, a combination of an endless belt and a roller or induction heating where the transferred image is heated from surfaces of the fixing members, is preferably employed.

The charge eliminating step is a step of applying a discharge bias to the electrophotographic photoconductor to discharge it, and can be preferably carried out by a charge eliminating unit.

The charge eliminating unit is not particularly limited as long as being capable of applying a discharge bias to the electrophotographic photoconductor, and may be suitably selected from among known charge eliminating devices. Preferred examples thereof are discharge lamps.

The cleaning step is a step of removing a toner remaining on the electrophotographic photoconductor and preferably carried out by the cleaning unit. Note that a method can also be employed in which the polarity of charge of the residual toner is uniformed with a rubbing member, without using a cleaning unit, so as to be collected by a developing roller.

The cleaning unit is not particularly limited, as long as being capable of removing a residual toner remaining on the electrophotographic photoconductor, and may be suitably selected from among known cleaners. Preferred examples thereof include magnetic brush cleaners, electrostatic brush cleaners, magnetic roller cleaners, blade cleaners, brush cleaners, and web cleaners.

—Lubricant Dispensing Step and Lubricant Dispensing Unit—

The lubricant dispensing step is a step of dispensing a lubricant to a surface of the electrophotographic photoconductor, and carried out by a lubricant dispensing unit. The lubricant dispensing unit is preferably set downstream from the cleaning unit in the rotational direction of the electrophotographic photoconductor.

The lubricant dispensing unit has a lubricant supplying unit configured to supply a lubricant onto the electrophotographic photoconductor, and a lubricant applying unit configured to apply the supplied lubricant to the surface of the electrophotographic photoconductor.

As the lubricant applying unit, a coating blade is preferable.

Material of the coating blade is not particularly limited, and may be suitably selected from known materials for cleaning blade in accordance with the intended use. Examples of the materials include urethane rubber, hydrin rubber, silicone rubber, and fluorine rubber. These materials may be used alone or in combination. These blades may be coated with or dipped in a low-friction coefficient material on its portion in contact with an electrophotographic photoconductor. Further, in order to adjust the hardness of an elastic body thereof, a filler, such as an organic filler and an inorganic filler, may be dispersed in the material.

The coating blade is fixed to a blade support by an arbitrarily selected method such as bonding or fusing, so that its end portion can be pressed in contact with a photoconductor surface. The thickness of the blade is not unequivocally defined due to the tradeoff between the forth applied by pressing the blade and the thickness, however, it is preferably 0.5 mm to 5 mm, and more preferably 1 mm to 3 mm.

Further, the length of the blade which allows itself to be projected from the support and to bend, so-called free length, cannot also be unequivocally defined due to the tradeoff between the forth applied by pressing the blade and the free length, however, it is preferably 1 mm to 15 mm, and more preferably 2 mm to 10 mm.

As other constructions of the blade, a coating layer formed of a resin, rubber, elastomer, etc. is formed on a surface of an elastic metal blade such as a spring board, via a coupling agent, a primer component, etc. as necessary, by coating, dipping or other method, and when necessary, the coating layer is thermally cured, and further when necessary, may be subjected to a surface polishing treatment.

The coating layer contains at least a binder resin and a filler, and further contains other components in accordance with the necessity.

The binder resin is not particularly limited and may be suitably selected in accordance with the intended use. Examples thereof include fluorine resins such as PFA, PTFE, FEP, and PVdF; fluorine rubbers, and silicone elastomers such as methylphenyl silicone elastomers.

The thickness of the elastic metal blade is preferably 0.05 mm to 3 mm, and more preferably 0.1 mm to 1 mm. In order to prevent distortion of the elastic metal blade, the blade may be subjected to a treatment, such as bending, after being attached to a spindle, in a direction substantially parallel to the spindle.

As the pressing forth to the photoconductor by the coating blade, a sufficient forth is that the lubricant spreads to form a layer thereby. The pressure of the spring is preferably 1.0N to 10N, and more preferably 2.0N to 8.0N.

The lubricant supplying unit is preferably a brush roller that rotates in contact with an electrophotographic photoconductor and rubs and scrapes off a lubricant so as to supply a lubricant to the surface of the electrophotographic photoconductor.

In this case, to reduce the mechanical stress to the photoconductor surface, a brush fiber having pliability is preferably used. Material of the pliable brush finer is not particularly limited, and may be suitably selected in accordance with the intended use. Examples thereof include polyolefin resins (e.g. polyethylene, and polypropylene); polyvinyl resins or polyvinylidene resins (e.g. polystyrene, acrylic resins, polyacrylonitrile, polyvinyl acetate, polyvinyl alcohol, polyvinyl butyral, polyvinyl chloride, polyvinyl carbazole, and polyvinyl ether, polyvinyl ketone); vinyl chloride-vinyl acetate copolymers; styrene-acrylic acid copolymers; styrene-butadiene resins; fluorine resins (e.g. polytetrafluoroethylene, polyvinyl fluoride, polyvinylidene fluoride, and polychlorotrifluoroethylene); polyesters; nylons; acryls; rayons; polyurethanes; polycarbonates; phenol resins; amino resins (e.g. urea-formaldehyde resins, melamine resins, benzoguanamine resins, urea resins, and polyamine resins).

In order to adjust the bending degree, diene rubber, styrene-butadiene rubber (SBR), ethylene propylene rubber, isoprene rubber, nitrile rubber, urethane rubber, silicone rubber, hydrin rubber, norbornene rubber, etc. may be compounded.

As a support of the lubricant supplying unit, there are fixed type roll-shaped supplying members and rotatable roll-shaped supplying members. Examples of the roll-shaped supplying member include a roll brush prepared by spirally winding a pile fabric tape formed from a brush-fiber around a metal cored bar. As for the brush fiber, the fiber diameter is preferably about 10 μm to 500 μm, the brush length is preferably 1 mm to 15 mm, and the brush density is preferably 10,000/square inch to 300,000/square inch ($1.5\times10^7$/square meter to $4.5\times10^8$/square meter).

It is preferably to use a lubricant supplying unit having high brush density, and to prepared a brush by forming a fiber into several fine filaments to several hundreds fine filaments, from the perspective of the supplying uniformity and the supplying stability. For example, like 333 decitex=6.7 decitex×50 filaments (300 denier=6 denier×50 filaments), it is preferred to bundle 50 filaments of 6.7 decitex (6 denier) fine fiber and to plant it as one fiber.

Further, for the sake of stabilizing the surface profile of the brush, the environmental stability etc., a coating layer may be formed on a surface of the brush. As a component constituting the coating layer, it is preferable to use a component which is deformable in accordance with the bend of the brush fiber. The component of the coating layer is not particularly limited, as long as being capable of maintaining the pliability, and may be suitably selected in accordance with the intended use. Examples of such a component include polyolefin resins such as polyethylene, polypropylene, chlorinated polyethylene, and chlorosulfonated polyethylene; polyvinyl or polyvinylidene resins such as polystyrene, acryls (e.g. polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; silicone resins formed by organo siloxane bonding or modified products thereof (modified products such as alkyd resins, polyester resins, epoxy resins, and polyurethane resins); fluorine resins such as perfluoroalkyl-ether, polyfluorovinyl, polyfluorovinylidene, and polychlorotrifluoroethylene; polyamides; polyesters; polyurethanes; polycarbonates; amino resins such as urea-formaldehyde resin; epoxy resins, or composite resins thereof.

As the lubricant, metal soap is preferably used. Examples of the metal soap include zinc stearic acid, barium stearic acid, lead stearic acid, iron stearic acid, nickel stearic acid, cobalt stearic acid, copper stearic acid, strontium stearic acid, calcium stearic acid, cadmium stearic acid, magnesium stearic acid, zinc oleate, manganese oleate, iron oleate, cobalt oleate, lead oleate, magnesium oleate, copper oleate, palmitic acid, zinc palmitic acid, cobalt palmitic acid, copper palmitic acid, magnesium palmitic acid, aluminum palmitic acid, calcium palmitic acid, lead caprylate, lead caproate, zinc linolenic acid, cobalt linolenic acid, calcium linolenic acid, cadmium linolenic acid, Candelilla wax, carnauba wax, rice wax, haze wax, jojoba oil, bees wax, and lanolin. These metal soaps may be used alone or in combination. Among these, particularly preferred are zinc stearic acid, aluminum stearic acid, and calcium stearic acid.

As a method of molding the lubricant into a certain shape, for example, prism shape or cylindrical shape, a known molding method for solid material can be used. Examples of the molding method include fusion molding method, powder molding method, heat press method, cold isostatic press (CIP) method, and hot isostatic press (HIP) method.

The recycling step is a step of recycling the toner that has been removed by the cleaning step to the developing unit, and is suitably carried out by a recycling unit. The recycling unit is not particularly limited. Examples thereof include known conveyance units.

The controlling step is a step of controlling each of the above-mentioned steps, and is suitably carried out by a controlling unit.

The controlling unit is not particularly limited, as long as being capable of controlling the performance of each unit, and may be suitably selected in accordance with the intended use. Examples thereof include equipment such as sequencers, and computers.

Figure 4:
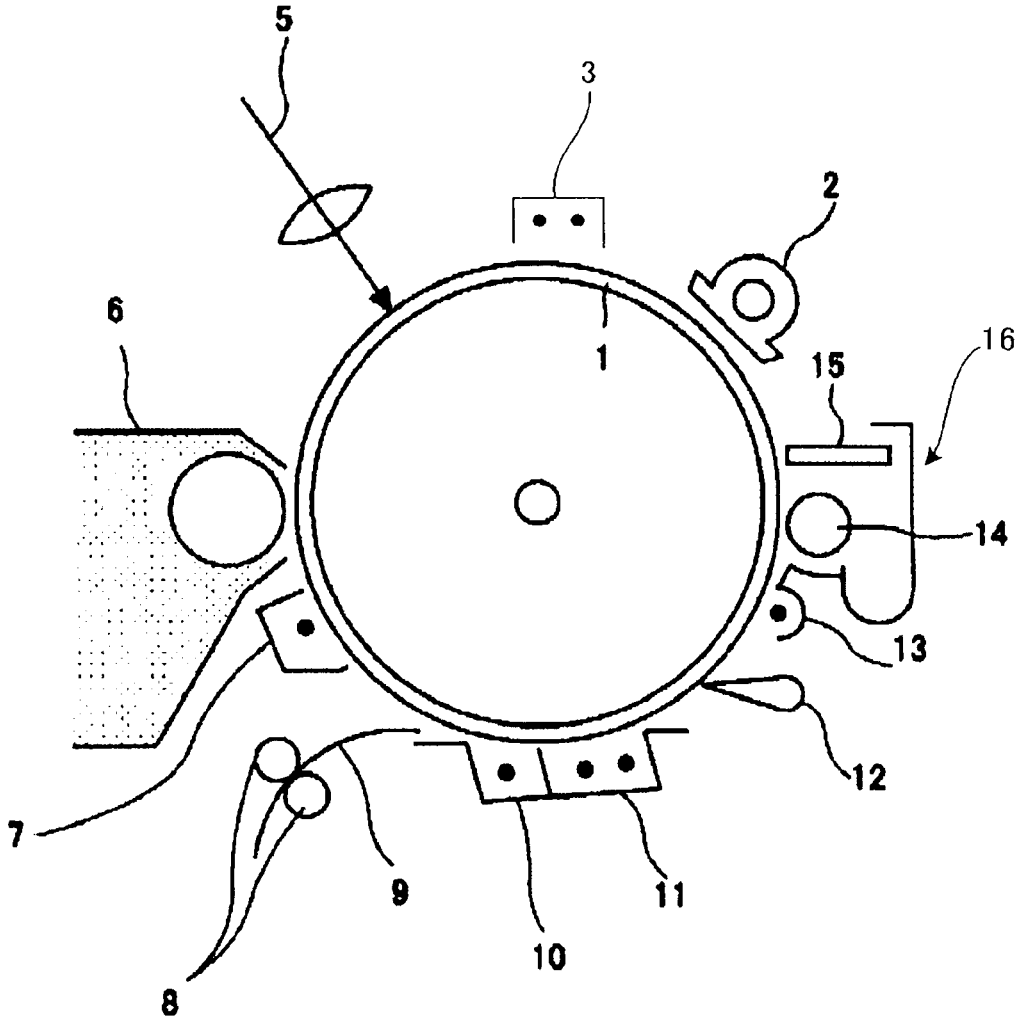
FIG. 4 is a schematic diagram showing one example of an image forming apparatus according to the present invention.

FIG. 4 is a schematic diagram showing one example of an image forming apparatus according to the present invention. In FIG. 4, an electrophotographic photoconductor 1 is the above-explained electrophotographic photoconductor of the present invention. Note that the electrophotographic photoconductor 1 is drum-shaped, but it may be formed in a sheet-shape or an endless-shape.

As a charger 3, a pre-transfer charger 7, a transfer charger 10, a separation charger 11, and a pre-cleaning charger 13, non-contact type corona discharge-charging units, such as solid state chargers, are used.

As the transfer charger, the above-mentioned charger can be generally used, however, as shown in FIG. 4, a transfer charger serving as the transfer charger 10 and the separation charger 11 is effectively used.

Further, as optical sources used for an exposing unit 5 and a charge eliminating lamp 2, etc., it is possible to use overall light-emitting sources such as fluorescent light, tungsten lamp, halogen lamp, mercury lamp, sodium lamp, light emitting diode (LED), semiconductor laser (LD), and electroluminescence (EL). In order to apply only light having a desired wavelength to a photoconductor surface, a variety of filters, such as a sharp-cut filer, a band pulse filter, a near-infrared cut filter, a dichroic filter, an interference filter, and a color temperature conversion filter, can also be used.

As for optical sources, by providing a transfer step, a charge eliminating step, a cleaning step or a pre-exposing step in which irradiation of light is additionally used, besides the steps shown in FIG. 4, the electrophotographic photoconductor 1 can be irradiated with a light beam.

Next, a toner image that has been developed on the electrophotographic photoconductor 1 by a developing unit 6 is then transferred onto a recording medium 9, but the overall the toner is not transferred thereto, and some amount of toner is left on the surface of the electrophotographic photoconductor. Such a residual toner is removed from the electrophotographic photoconductor by a cleaning unit 16 composed of a fur brush 14 and a blade 15. The cleaning of the surface can be performed by only a cleaning brush. As the cleaning brush, a known cleaning brush including fur brush, magnet fur brush, is used.

When the electrophotographic photoconductor 1 is positively or negatively charged, and imagewise exposed, a positively (negatively) charged latent electrostatic image is formed on the surface of the electrophotographic photoconductor. When the latent electrostatic image is developed with a toner having a negative (positive) polarity (electroscopic particles), a positive image can be obtained. When it is developed with a toner having a positive (negative) polarity, a negative image can be obtained. As the developing unit, a known developing device is used.

The wavelength of the charge eliminating lamp 2 serving as a charge eliminating unit is within a wavelength range in which the electrophotographic photoconductor can exhibit its photosensitivity. A charge eliminating lamp having a longer wavelength in a practical photosensitivity wavelength range of the electrophotographic photoconductor is preferably used.

As various conditions of the cleaning blade, the blade contact angle is preferably within the range of 10 degrees to 30 degrees, the contact pressure is preferably in the range of 0.3 g/mm to 4 g/mm, the hardness of a rubber used as a blade is preferably within the range of 60 degrees to 70 degrees, the rebound resilience is preferably within the range of 30% to 70%, the Young's modulus of elasticity is preferably within the range of 30 kgf/cm$^2$ to 60 kgf/cm$^2$, the thickness is preferably within the range of 1.5 mm to 3.0 mm, the free length is preferably within the range of 7 mm to 12 mm, and the bite amount of the blade edge against the electrophotographic photoconductor is preferably within the range of 0.2 mm to 2 mm. As a material satisfying the above physical properties, a blade made of urethane rubber is particularly preferable.

Figure 5:
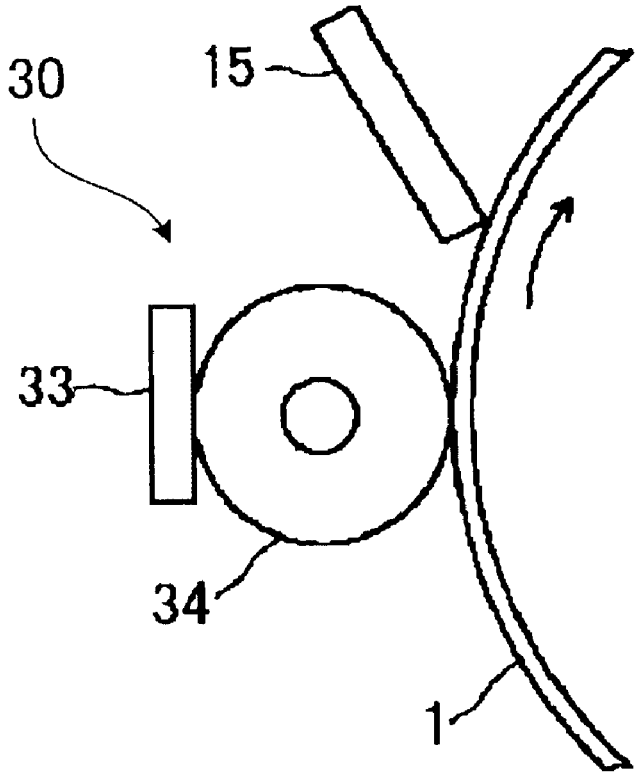
FIG. 5 is a schematic diagram showing one example of a conventional lubricant applying device.

The following explains a conventional lubricant dispensing unit. In order to improve the transfer efficiency and the removability of untransferred toner remaining on a surface of a photoconductor 1, as shown in FIG. 5, a lubricant dispenser 30 that dispenses a lubricant to the photoconductor 1 is provided within a toner removing unit 16 of FIG. 4. In the lubricant dispenser 30, a solid lubricant 33 is disposed near the photoconductor 1, and a brush roller 34 is provided so as to contact with both the photoconductor 1 and the solid lubricant 33. During the supply of the solid lubricant 33, the lubricant dispenser 30 is designed to rotate the brush roller 34 and scrape off the solid lubricant 33 with the brush roller 34 so as to apply an appropriate amount of the solid lubricant 33 attached on the brush roller 34 to a surface of the photoconductor 1.

The lubricant dispenser 30 shown in FIG. 5 is to apply a lubricant on a surface of a photoconductor on which a residual toner is left without being removed. On that occasion, in portions corresponding to character portions in an image carried by the surface of the photoconductor, a large amount of residual toner is present even after the toner is transferred onto a recording medium, and in portions other than the character portions, substantively, no residual toner is present. Then, from a portion having an adhesion amount of residual toner, a large amount of a lubricant is scraped off together with the residual toner by the brush roller and the cleaning blade, etc. at a cleaning position, and thus the coating amount of the lubricant at a surface of the photoconductor that has passed through the cleaning position is likely to vary. Particularly when a same image is continuously output, portions having a large amount of residual toner always remain same on the photoconductor surface. Therefore, the variance in coating amount may sometimes be conspicuous. Furthermore, because a residual toner adheres to a coating member such as a brush roller, the brush roller is contaminated, so that it becomes easily difficult to continue to uniformly apply a lubricant for a long period of time. When a uniform lubricant layer cannot be formed on the photoconductor surface, the static friction coefficient (μ) of the photoconductor surface varies, and a low static friction coefficient enough to transfer a toner may not be obtained to cause transfer nonuniformity, resulting in an abnormal image such as character dropout, moth-eaten image, image blur, and thin spots. Therefore, it is necessary to strongly press the solid lubricant to the brush roller so that the amount of the lubricant supplied to the photoconductor is increased.

When the cleaning blade 15 shown in FIG. 5 is provided upstream, in a rotational direction of the photoconductor, of the brush roller 34 and a lubricant applied after cleaning the photoconductor surface, the occurrence of defects that could be caused in a configuration of cleaning after application of a lubricant can be prevented, because the applied lubricant on the brush roller and the cleaning blade is not scraped off. However, when the photoconductor surface coated with the lubricant moves in a transfer position and an image is transferred, an abnormal image occurs, even though the static friction coefficient (μ) is within an appropriate range. This is because particles of the lubricant are not so fine to be a uniform layer after just being applied, and nonuniformity of the layer thickness is caused on the photoconductor surface, and so that this affects the transferability of toner. When a uniform lubricant layer cannot be formed on a photoconductor surface, the static friction coefficient (μ) of the photoconductor surface varies, and a low static friction coefficient enough to transfer a toner may not be obtained to cause transfer nonuniformity, resulting in an abnormal image such as character dropout, moth-eaten image, image blur, and thin spots.

Figure 6:
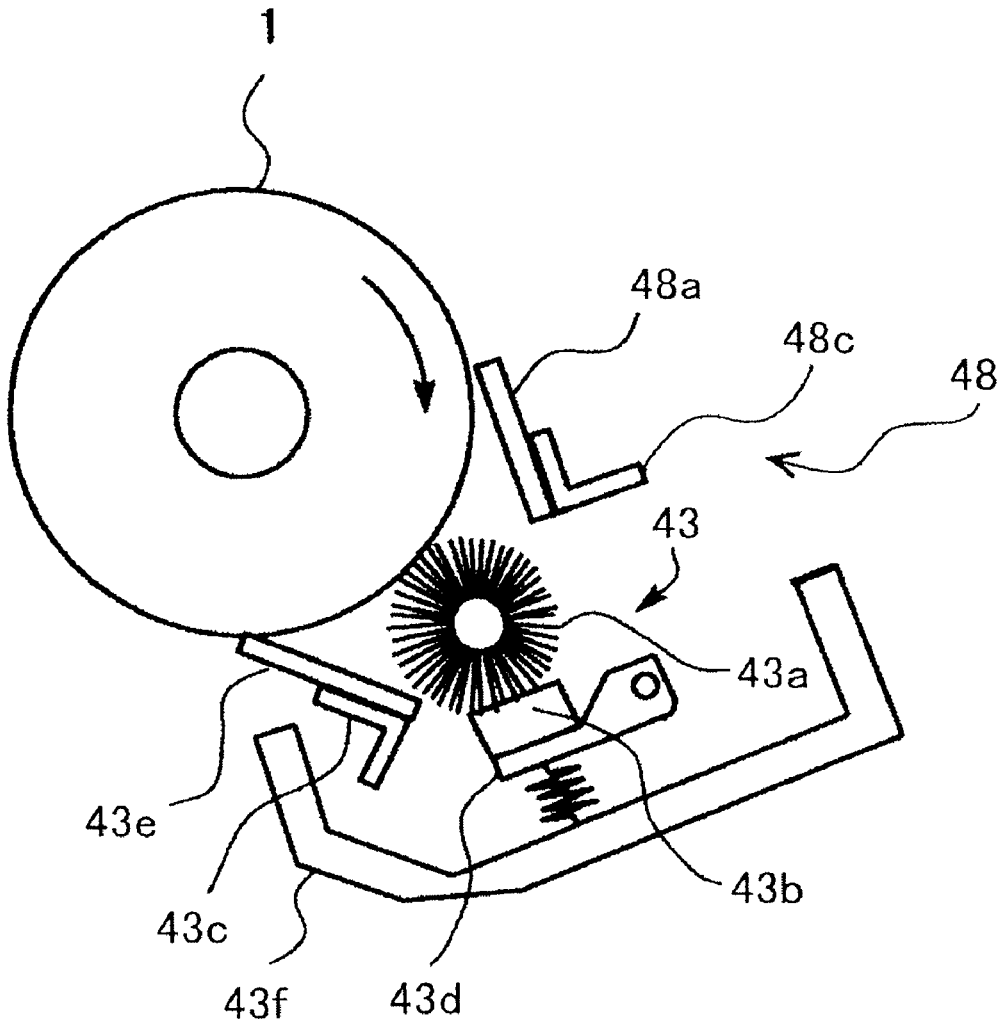
FIG. 6 is a schematic diagram showing one example of a lubricant applying unit according to the present invention.

Next, the following explains a structure of a cleaning device 48 of the present invention, shown in FIG. 6. The cleaning device 48 is equipped with a cleaning blade 48*a* and a supporting member 48*c*. The cleaning blade 48*a* is formed of a rubber, such as urethane rubber, and silicone rubber, in the form of sheet, is set so that the edge makes contact with a surface of the photoconductor 1, and is configured to remove a toner remaining on the surface of the photoconductor 1 after transfer.

The cleaning blade 48*a* is attached to and supported by the supporting member 48*c* made of metal, plastic, ceramic, etc. and set at an angle shown in FIG. 6 to the surface of the photoconductor 1.

A lubricant dispenser 43 is externally disposed downstream of the cleaning device 48 so that the cleaning blade 48*a* is disposed upstream, in the moving direction, of the photoconductor 1, and a lubricant applying blade 43*e* is disposed downstream, in the moving direction, of the photoconductor 1. Residual toner is removed by the cleaning blade 48*a*. Then, a lubricant applied by the lubricant dispenser 43 on a surface of the photoconductor 1 in a clean state is spread by rubbing the lubricant against the surface of the photoconductor 1, by means of a lubricant applying blade 43*e*, thereby a thin layer of lubricant can be formed on the surface of the photoconductor 1.

The lubricant applying blade 43*e* is attached to and supported by a supporting member 43*c* made of metal, plastic, ceramic, etc. and set at an angle shown in FIG. 6 to the surface of the photoconductor 1.

It should be noted that in FIG. 6, the lubricant applying blade 43*e* comes into contact with the photoconductor 1 in a trail direction, but it may contact the photoconductor 1 in a counter direction.

The following explains the details of the lubricant dispenser 43 shown in FIG. 6. The lubricant dispenser 43 is externally disposed downstream of the photoconductor cleaning device 48, and is equipped with a solid lubricant 43*b*, and a brush roller 43*a* serving as a brush member for applying the solid lubricant 43*b* onto the photoconductor 1.

The solid lubricant 43*b* is produced by dissolving a lubricant additive containing zinc stearic acid as a main component, solidifying the dissolved lubricant additive with cooling, and then molding into bar-shape. The solid lubricant 43*b* is held by a lubricant holding member 43*d* and is pressed toward the brush roller 43*a* via the lubricant holding member 43*d* by a pressurizing spring attached to a housing 43*f* of the lubricant dispenser 43. The brush roller 43*a* is disposed so as to contact a surface of the photoconductor 1 and is configured to scrape the solid lubricant 43*b* toward the brush roller 43*a* by the rotation of the brush roller 43*a*. Some amount of the lubricant attached to the brush roller 43*a* is then attached to a surface of the photoconductor 1 from the contact portion where the brush roller 43 comes into contact with the photoconductor 1. Subsequently, the lubricant is uniformly smoothed by the lubricant applying blade 43*e*. The amount of the lubricant supplied to the photoconductor can be controlled by the applied pressure of the pressuring spring that is pressed against the brush roller 43*a* by the solid lubricant.

A lubricant can be uniformly applied in a thin layer with a small supply amount of lubricant by a lubricant dispenser as shown in FIG. 6.

As the solid lubricant 43*b*, a dry-solid hydrophobic lubricant can be used. Preferred examples of the solid hydrophobic lubricant are zinc stearic acid, aluminum stearic acid, and calcium stearic acid, etc.

Figure 7:
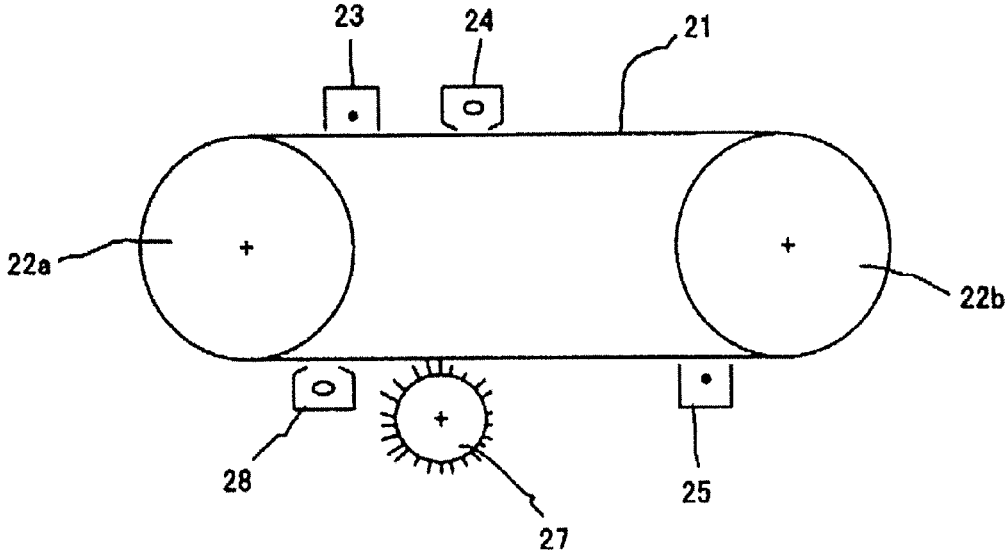
FIG. 7 is a schematic diagram showing another example of an image forming apparatus of the present invention.

Next, FIG. 7 is a schematic diagram showing one example of an electrophotographic process according to the present invention. A photoconductor 21 has at least a photosensitive layer and contains a compound represented by any one of General Formulas (1) and (2), and a filler. The photoconductor 21 is driven by drive rollers 22*a* and 22*b*, is charged by a charger 23, is imagewise exposed by an optical source 24, developed (not shown), undergoes transfer operation using a transfer charger 25, is cleaned by a brush 27, and then undergoes elimination of charge by an optical source 28. These process steps are repeated on the photoconductor 21.

In the light exposure of the electrophotographic process shown in FIG. 7, imagewise exposure, pre-cleaning exposure, and charge-eliminating exposure are illustrated. Besides, the photoconductor may be irradiated with light by providing pre-transfer exposure, pre-exposure of imagewise exposure, and other known light exposing steps.

Figure 8:
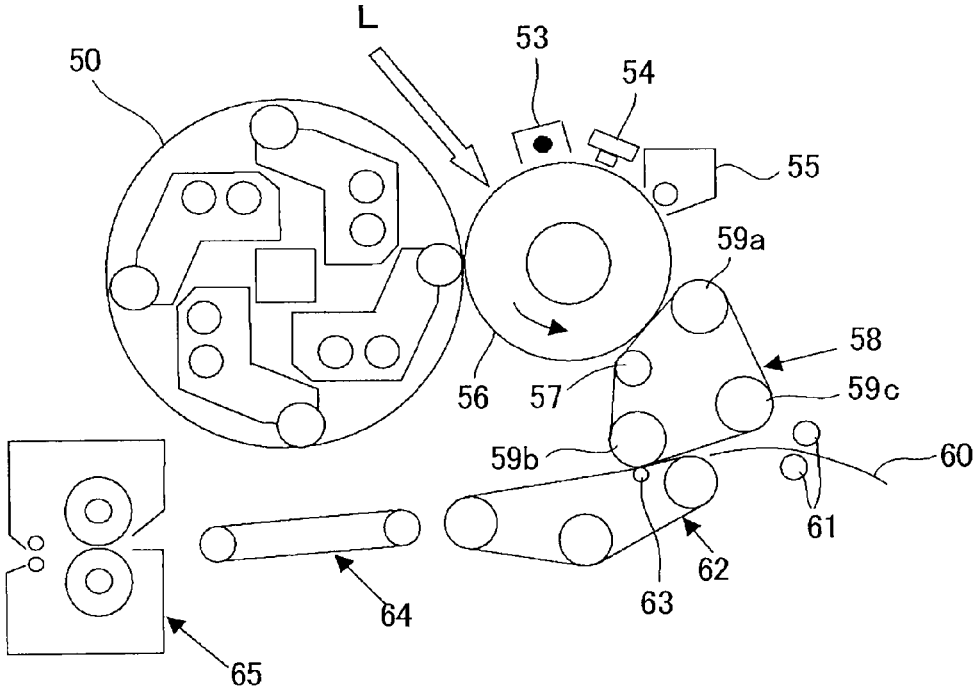
FIG. 8 is a schematic diagram showing still another example of an image forming apparatus according to the present invention.

FIG. 8 is a diagram showing one example of another embodiment of the image forming process of the present invention. In FIG. 8, a photoconductor drum 56 is uniformly charged on its surface by a charger 53 using corotron, scorotron, etc. while being driven to rotate in a counterclockwise direction in FIG. 8, and then scanted by a laser beam L emitted from a laser optical device (not shown) to carry a latent electrostatic image on its surface. The scanning is performed based on monochrome image information that a full-color image is broken down into color information of yellow, magenta, cyan, and black, and thus monochrome latent electrostatic images of yellow, magenta, cyan, and black are formed on the photoconductor drum 56. On the left side of the photoconductor drum 56 in the figure, a revolver type developing unit 50 is disposed. This developing unit has a yellow developing device, a magenta developing device, a cyan developing device and a black developing device in a rotatable drum-shaped housing, and sequentially moves the developing devices at respective developing positions facing the photoconductor drum 56, by the rotation. Note that the yellow developing device, the magenta developing device, the cyan developing device and the black developing device are respectively configured to develop each color latent electrostatic image by attaching each color of yellow toner, magenta toner, cyan toner, and black toner thereto.

On the photoconductor drum 56, latent electrostatic images for yellow, magenta, cyan, and black are sequentially formed. These latent electrostatic images are sequentially developed by each developing device in the developing unit 50 so as to be a yellow toner image, a magenta toner image, a cyan toner image, and a black toner image.

On the downstream side of rotation of the photoconductor drum 56, lower than the developing positions, an intermediate transfer unit is disposed, which moves endless an intermediate transfer belt 58 spanned over a span roller 59*a*, an intermediate transfer bias roller 57 serving as a transfer unit, a secondary transfer backup roller 59*b*, and a belt driving roller 59*c* in a clockwise direction in the figure, by the rotation driving of the belt driving roller 59*c*. The yellow toner image, magenta toner image, cyan toner image and black toner image that have been developed on the photoconductor drum 56 enter into an intermediate transfer nip at which the photoconductor drum 56 comes into contact with the intermediate transfer belt 58, and then intermediately transferred and superimposed on the intermediate transfer belt 58 while being affected by a bias from the intermediate transfer bias roller 57 to be a four-color composite toner image.

The surface of the photoconductor drum 56 that has passed an intermediate transfer nip in accordance with the rotation is cleaned by a drum cleaning unit 55 so that residual toner is removed. The cleaning unit 55 is configured to remove untransferred residual toner by a cleaning roller to which a cleaning bias is applied. Besides, the cleaning unit 55 may also employ a cleaning brush such as a fur brush, and a magnetic brush; or a cleaning blade.

The surface of the photoconductor drum 56 that the untransferred residual toner has been removed is then charge-eliminated by a charge eliminating lamp 54. As the charge eliminating lamp 54, fluorescent light, tungsten lamp, halogen lamp, mercury lamp, sodium lamp, light emitting diode (LED), semiconductor laser (LD), electro-luminescence (EL), etc. are used. Further, as an optical source for the laser optical device, a semiconductor laser is used. For these emitting light beams, only a desired wavelength range may be used by selecting from a variety of filters, such as a sharp-cut filer, a band pulse filter, a near-infrared cut filter, a dichroic filter, an interference filter, and a color temperature conversion filter.

Meanwhile, a pair of resist rollers 61 nipping the recording medium 60 sent from a paper feeding cassette (not shown) between the two rollers sends the recording medium 60 toward the secondary transfer nip at the timing that the recording medium 60 can be superimposed on a four-color composite toner image on the intermediate transfer belt 58. The four-color composite toner image on the intermediate transfer belt 58 is affected, inside the secondary transfer nip, by a secondary transfer bias from a paper-transfer bias roller 63 to be secondarily transferred onto the recording medium 60, at a time. A full-color image is formed on the recording medium 60 by this secondary transfer.

The recording medium 60 with a full-color image formed on its surface is sent to a paper conveyance belt 64 by a transfer belt 62. The conveyance belt 64 sends the recording medium to received from the transfer unit into a fixing device 65. The fixing device 65 conveys the received recording medium 60 while nipping it in a fixing nip formed by a contact between a heating roller and a backup roller. The full-color image on the recording medium 60 is affected by heat from the heating roller and an applied pressure in the fixing nip to be fixed on a transfer paper sheet 60.

It should be noted that a bias is applied to the transfer belt 62 and the conveyance belt 64 so as to adsorb the recording medium 60 thereto, although it is not illustrated in the figure. Further, a paper-charge eliminating charger for removing charge on the recording medium 60, and three belt-charge removing chargers for removing charge on belts (the intermediate belt 58, the transfer belt 62, and the conveyance belt 64) are placed. An intermediate transfer unit is also equipped with a belt cleaning unit having a similar configuration to that of the drum cleaning unit 55, thereby untransferred residual toner on the intermediate transfer belt 58 is removed.

Figure 9:
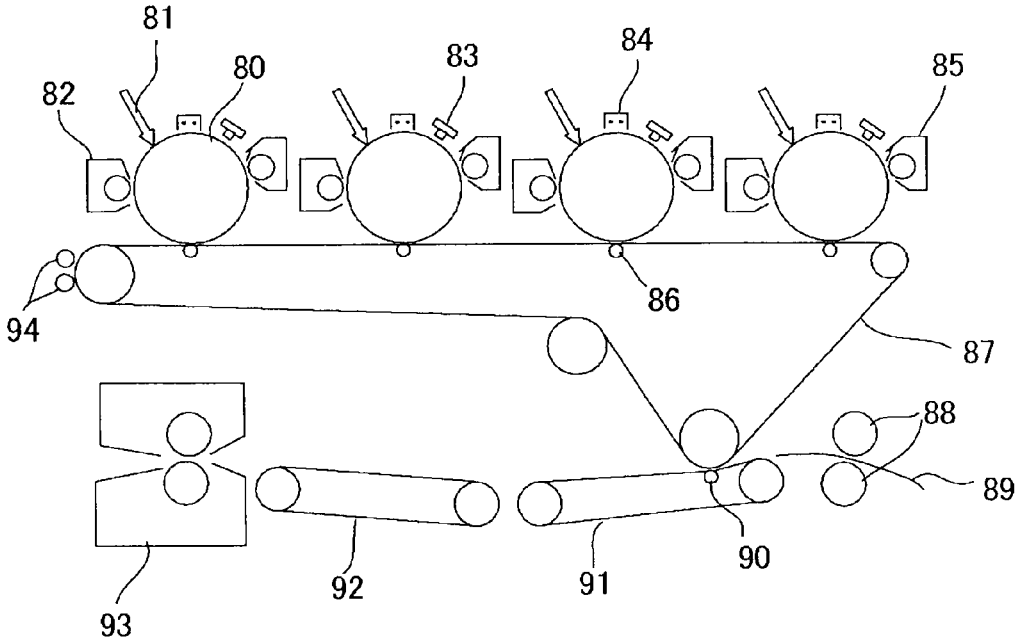
FIG. 9 is a schematic diagram showing one example of a tandem type image forming apparatus according to the present invention.

Next, FIG. 9 is a schematic diagram showing another embodiment of the image forming apparatus of the present invention. This image forming apparatus is a so-called tandem type printer and equipped with photoconductor drums of 80Y, 80M, 80C, 80Bk for four colors of cyan (C), magenta (M), yellow (Y), and black (K), instead of sharing a photoconductor drum 80 among these four colors. The image forming apparatus is also provided with drum cleaning units 85, charge eliminating lamps 83, chargers 84 for four colors of cyan (C), magenta (M), yellow (Y), and black (K).

The tandem type printer can perform formation of each four-color latent electrostatic image and developing thereof in parallel, and thus this type printer allows far higher speed image formation than in the revolver type image forming apparatus.

The above-explained image forming unit in the image forming apparatus may be incorporated in a fixed state in a copier, a facsimile, and a printer, and may be incorporated in the form of an after-mentioned process cartridge in an image forming apparatus.

(Process Cartridge)

The process cartridge of the present invention includes at least one selected from a charging unit, an exposing unit, a developing unit, a transfer unit, a cleaning unit, and a charge eliminating unit, and an electrophotographic photoconductor, and is detachably mounted to a main body of an image forming apparatus.

The electrophotographic photoconductor is the above-explained electrophotographic photoconductor of the present invention.

Figure 10:
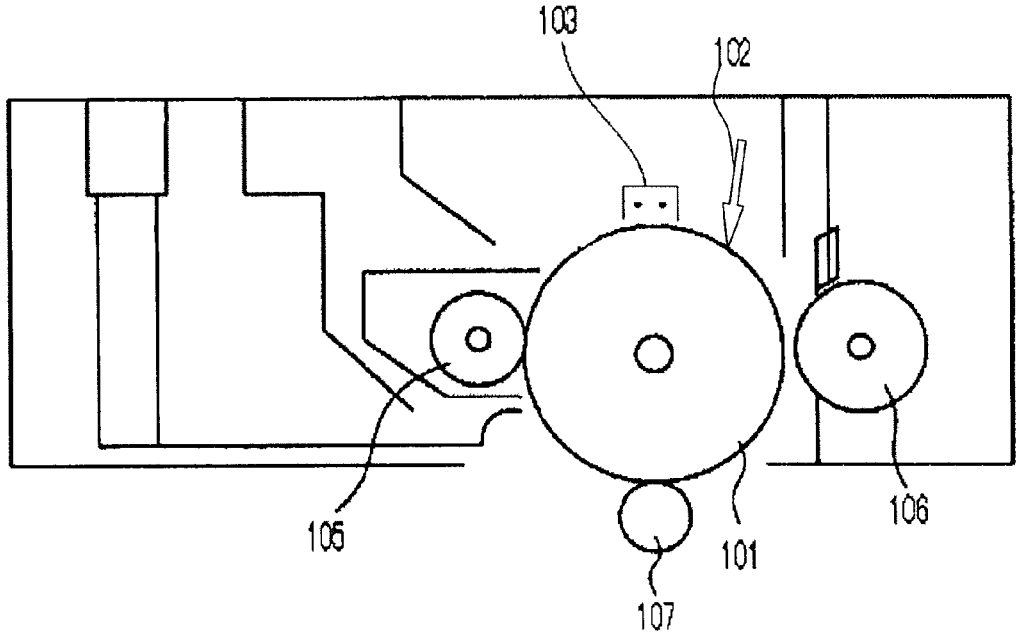
FIG. 10 is a schematic diagram showing one example of a process cartridge according to the present invention.

FIG. 10 is a schematic diagram showing a configuration of an image forming apparatus equipped with a process cartridge of the present invention.

A photoconductor 101 has at least a photosensitive layer and a surface protective layer over a support, and the surface protective layer contains a compound represented by any one of General Formulas (1) and (2), a filler, and a charge transporting material. A reference numeral 103 denotes a charging unit, a reference numeral 102 denotes a developing unit, a reference numeral 107 denotes a transfer unit, and a reference numeral 105 denotes a cleaning unit.

In the present invention, among the above-mentioned component elements such as the photoconductor 101, charging unit 103, developing unit 102 and cleaning unit 105, at least the photoconductor 101 and the developing unit 102 are integrally combined into a process cartridge. The process cartridge can be designed so as to be detachably mounted to a main body of an image forming apparatus such as a copier, and a printer.

With use of a configuration according to the present invention as described above, the initial residual potential of an electrophotographic photoconductor containing a filler in its surface protective layer can be reduced, and an image forming apparatus enabling higher speed operation can be achieved. It is also possible to provide an electrophotographic photoconductor of the present invention, which is capable of reducing the occurrence of image degradation due to image blur, suppressing an increase in residual potential, and stably forming a high-quality image even in repetitive use for a long period of time as well as an image forming apparatus, and a process cartridge each using the electrophotographic photoconductor.

EXAMPLES

Hereinafter, the present invention will be described in detail referring to specific Examples, however, the present invention is not limited to the disclosed Examples. On the contrary, the present invention is intended to cover various modifications and equivalent arrangements included within the spirit and scope of the appended claims.

Synthesis Example 1

Synthesis of Titanylphthalocyanine Crystal

The synthesis of titanylphthalocyanine crystal was carried out in accordance with the method described in Japanese Patent Application Laid-Open (JP-A) No. 2004-83859. Specifically, 292 g of 1,3-diminoisoindoline, and 1,800 g of sulfolane were mixed, and 20.4 g of titanium tetrabuthoxide was delivered by drops into the mixture under nitrogen gas stream. After completion of the dropping, the mixture was gradually raised in temperature to 180° C. and stirred for 5 hours while maintaining the reaction temperature from 170° C. to 180° C. so that the components were reacted. After completion of the reaction, the reaction product was left standing to cool, and then the precipitate was filtered and washed with chloroform until the powder turned blue. Next, the powder washed with methanol several times, further washed with 80° C. hot water several times, and the dried, thereby obtaining a coarse titanylphthalocyanine.

The coarse titanylphthalocyanine obtained was dissolved in 20 times its volume of concentrated sulfuric acid and then delivered by drops into 100 times its volume of iced water while stirring, and the precipitated crystal was filtered. Next, the filtered crystal was repeatedly washed with ion exchanged water (pH: 7.0, relative conductivity: 1.0 μS/cm) until the wash fluid was neutral, thereby obtaining a wet cake (water paste) of titanylphthalocyanine pigment. Note that the ion exchanged water after the washing treatment had a pH value of 6.8, and a relative conductivity of 2.6 μS/cm.

Forty grams of the obtained wet cake (water paste) was charged into 200 g of tetrahydrofuran, and strongly stirred at a speed of 2,000 rpm at the room temperature by a homomixer (model: MARK IIf, manufactured by KENIS Ltd.). When the color of the paste turned from navy blue to light blue (20 minutes past after the initial of stirring), the stirring was stopped, and immediately, the resulting paste was subjected to vacuum filtering, and thereby a crystal was obtained on the filter. The obtained crystal was washed with tetrahydrofuran, thereby obtaining a pigment wet cake. The pigment wet cake was dried at 70° C. under reduced pressure (5 mmHg) for 2 days to thereby obtain 8.5 parts by mass of titanylphthalocyanine crystal. This was taken as Pigment 1. The solids concentration of the wet cake was 15% by mass. A crystal conversion solvent in 33 times the mass ratio of the wet cake was used.

Figure 11:
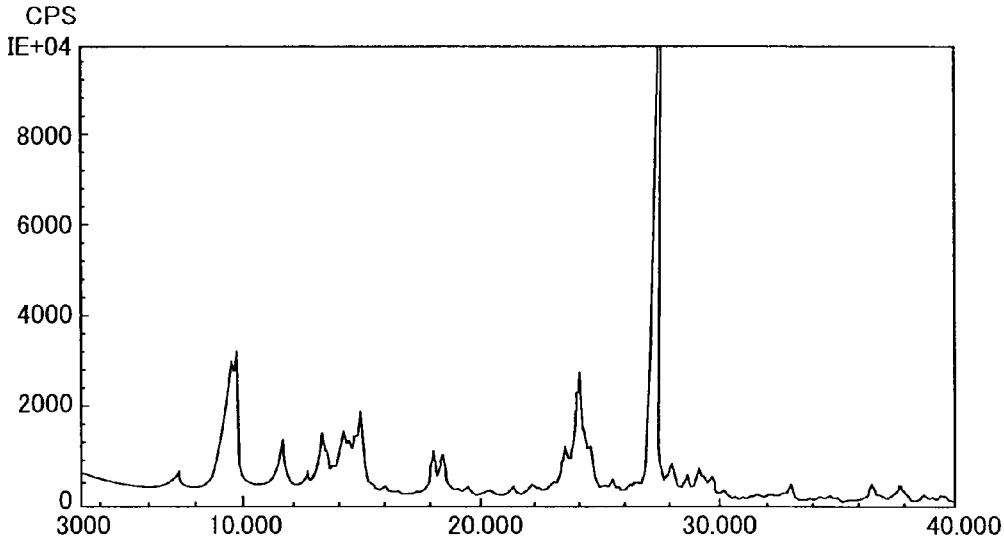
FIG. 11 is an X-ray diffraction spectrum pattern of a charge generating material used in Examples, in which the ordinate axis represents a count number (cps) per second, and the abscissa axis represents an angle (2θ).

Note that no halogen-containing compound was used in the starting materials of Synthesis Example 1. An X-ray diffraction spectrum of the obtained titanylphthalocyanine powder was measured under the following conditions. As a result, a titanylphthalocyanine powder having a maximum diffraction peak at a Bragg angle (2θ±0.2°) of 27.2°±0.2° and a diffraction peak at the smallest Bragg angle of 7.3°±0.2° toward CuKα characteristic X-ray (wavelength: 1.542 angstroms) and further having main diffraction peaks at Bragg angles of 9.4°±0.2°, 9.6°±0.2° and 24.0°±0.2° and having no diffraction peaks at Bragg angles between 7.3° and 9.4° and at 26.3° was obtained. FIG. 11 shows the measurement results.

<Measurement Conditions for X-Ray Diffraction Spectrum>

X-ray tube: Cu
voltage: 50 kV
current: 30 mA
scanning speed: 2°/min
scanned angle range: 3° to 40°
time constant: 2 seconds Next, in a commercially available bead mill dispersing device, a 2-butanone solution in which polyvinyl butyral had been dissolved, and the pigment were charged, and dispersed at 1,200 rpm of the rotor for 30 minutes, using a PSZ ball having a diameter of 0.5 mm to prepare a pigment dispersion liquid.

In the following Examples and Comparative Examples, the oxidation potential of each charge transporting material in a photosensitive layer and a surface protective layer were measured as follows.

<Oxidation Potential of Charge Transporting Material>

Into a charge transporting material to be measured, a predetermined amount of methylene chloride and indifferent salts (supporting electrolyte), such as tetrabutyl ammonium perchlorate, and tetraethyl ammonium perchlorate, were added and dissolved to prepare a test liquid. The test liquid was used to measure an oxidation potential of the target material by means of an electrochemical analysis method such as polarograph or cyclic voltammetry. The details of the electrochemical analysis method is found in "Electrochemical Methods" written by A. J. Bard, L. R. Faulkner, published by Wiley in 1980. In the Examples described below, oxidation potential values were measured by a potential scanning method using a potentiostat in which as a working electrode, a dropping mercury electrode was used, as a counter electrode, a precious metal such as platinum and gold was used, as a reference electrode, a saturated calomel electrode (SCE) was used.

Comparative Example 1

Production of Electrophotographic Photoconductor

Over an aluminum cylinder, an undercoat layer coating liquid having the following composition, a charge generating layer having the following composition and a charge transporting layer coating liquid having the following composition were applied in this order, each of the applied liquids were dried to thereby form an undercoat layer of 3.5 μm in thickness, a charge generating layer of 0.2 μm in thickness, and a charge transporting layer of 22 μm in thickness. As conditions for drying each of the layers, the undercoat layer was dried at 130° C. for 20 minutes, the charge generating layer was dried at 90° C. for 20 minutes, and the charge transporting layer was dried at 135° C. for 20 minutes.

<Composition of Undercoat Layer Coating Liquid>

| | |
|---|---|
| titanium dioxide powder | 400 parts by mass |
| melamine resin | 65 parts by mass |
| alkyd resin | 120 parts by mass |
| 2-butanone | 400 parts by mass |

<Composition of Charge Generating Layer Coating Liquid>

| | |
|---|---|
| titanylphthalocyanine (ionization potential: 5.27 eV) having an X-ray diffraction spectrum shown in FIG. 11 | 8 parts by mass |
| polyvinyl butyral | 5 parts by mass |
| 2-butanone | 400 parts by mass |

<Composition of Charge Transporting Layer Coating Liquid>

| | |
|---|---|
| polycarbonate (Z POLYCA, produced by TEIJIN CHEMICALS LTD.) | 10 parts by mass |
| charge transporting material having the following structural formula (oxidation potential: 0.89 V vs SCE, melting point: 93.5° C.) | 7 parts by mass |

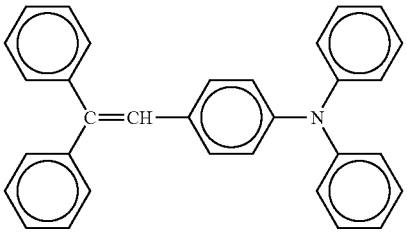

| | |
|---|---|
| silicone oil (100 cSt, produced by Shin-Etsu Chemical Co., Ltd.) | 0.002 parts by mass |
| tetrahydrofuran | 100 parts by mass |

Next, onto the charge transporting layer, a surface protective layer coating liquid having the following composition was applied by spray coating to thereby form a surface protective layer of 5.0 μm in thickness. As conditions for drying the surface protective layer, the applied liquid was dried at 150° C. for 20 minutes. With the above-mentioned procedure, an electrophotographic photoconductor of Comparative Example 1 was produced.

<Composition of Surface Protective Layer Coating Liquid>

| | |
|---|---|
| alumina filler (average primary particle diameter: 0.3 μm, SUMIKORANDOM AA-03, produced by Sumitomo Chemical Co., Ltd.) | 1 part by mass |
| unsaturated polycarboxylic acid polymer (acid value: 180 mgKOH/g, solids concentration: 50% by mass, BYK-P104, produced by BYK Chemie Co.) | 0.02 parts by mass |
| Compound No. 9 having the following structural formula | 0.6 parts by mass |

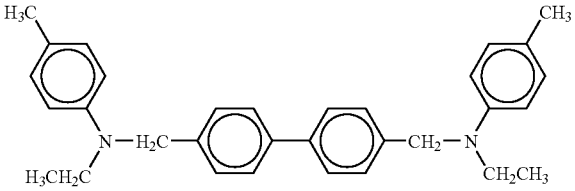

| | |
|---|---|
| charge transporting material having the following structural formula (oxidation potential: 0.89 V vs SCE, melting point 93.5° C.) | 3 parts by mass |

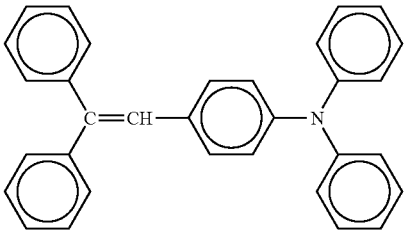

| | |
|---|---|
| polycarbonate (Z POLYCA, produced by TEIJIN CHEMICALS LTD.) | 5 parts by mass |
| tetrahydrofuran | 250 parts by mass |
| cyclohexanone | 70 parts by mass |

Comparative Example 2

Production of Electrophotographic Photoconductor

An electrophotographic photoconductor of Comparative Example 2 in a similar manner to that described in Comparative Example 1, except that the surface protective layer coating liquid was changed to a surface protective layer coating liquid having the following composition.

<Composition of Surface Protective Layer Coating Liquid>

| | |
|---|---|
| alumina filler (average primary particle diameter: 0.3 μm, SUMIKORANDOM AA-03, produced by Sumitomo Chemical Co., Ltd.) | 1 part by mass |
| unsaturated polycarboxylic acid polymer (acid value: 180 mgKOH/g, solids concentration: 50% by mass, BYK-P104, produced by BYK Chemie Co.) | 0.02 parts by mass |
| Compound No. 2 having the following structural formula | 1.8 parts by mass |

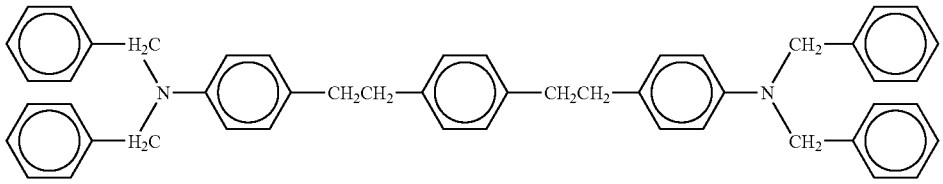

| | |
|---|---|
| charge transporting material having the following structural formula (oxidation potential: 0.89 Vvs SCE, melting point: 93.5° C.) | 1.8 parts by mass |

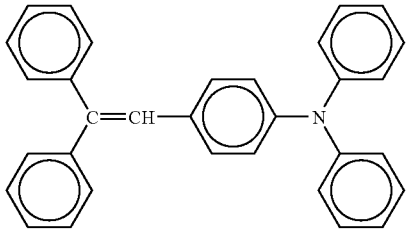

| | |
|---|---|
| polycarbonate (Z POLYCA, produced by TEIJIN CHEMICALS LTD.) | 5 parts by mass |
| tetrahydrofuran | 250 parts by mass |
| cyclohexanone | 70 parts by mass |

Comparative Example 3

Production of Electrophotographic Photoconductor

An electrophotographic photoconductor of Comparative Example 3 was produced in a similar manner to that described in Comparative Example 1, except that the charge transporting material for the charge transporting layer and the surface protective layer was changed to a charge transporting material having the following structural formula (oxidation potential: 0.80V vs SCE, melting point: 139.5° C.).

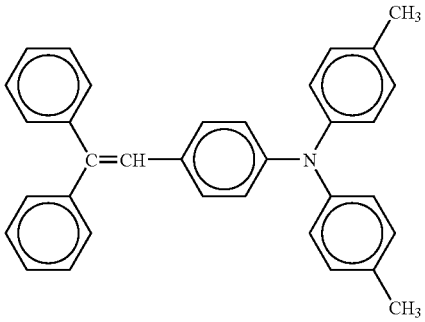

Comparative Example 4

Production of Electrophotographic Photoconductor

An electrophotographic photoconductor of Comparative Example 4 was produced in a similar manner to that described in Comparative Example 2, except that the charge transporting material for the charge transporting layer and the surface protective layer was changed to a charge transporting material having the following structural formula (oxidation potential: 0.80V vs SCE, melting point: 139.5° C.).

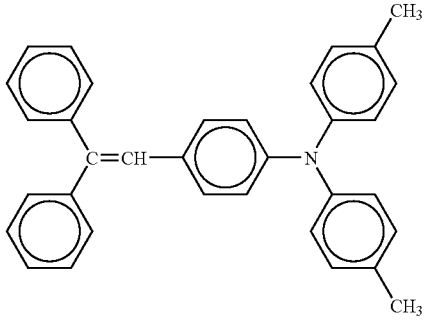

Comparative Example 5

Production of Electrophotographic Photoconductor

An electrophotographic photoconductor of Comparative Example 5 was produced in a similar manner to that described in Comparative Example 1, except that the charge transporting material for the charge transporting layer and the surface protective layer was changed to a charge transporting material having the following structural formula (oxidation potential: 0.76V vs SCE, melting point: 165.5° C.).

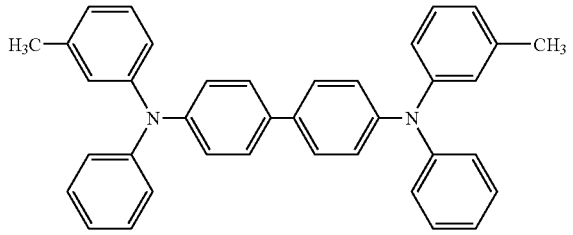

Comparative Example 6

Production of Electrophotographic Photoconductor

An electrophotographic photoconductor of Comparative Example 6 was produced in a similar manner to that described in Comparative Example 2, except that the charge transporting material for the charge transporting layer and the surface protective layer was changed to a charge transporting material having the following structural formula (oxidation potential: 0.76V vs SCE, melting point: 165.5° C.).

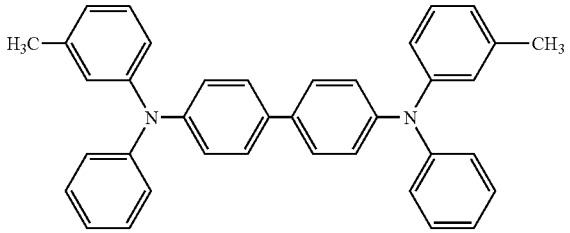

Comparative Example 7

Production of Electrophotographic Photoconductor

An electrophotographic photoconductor of Comparative Example 7 was produced in a similar manner to that described in Comparative Example 1, except that the charge transporting material for the charge transporting layer and the surface protective layer was changed to a charge transporting material No. 52 having the following structural formula (oxidation potential: 0.75V vs SCE, melting point: 193° C.).

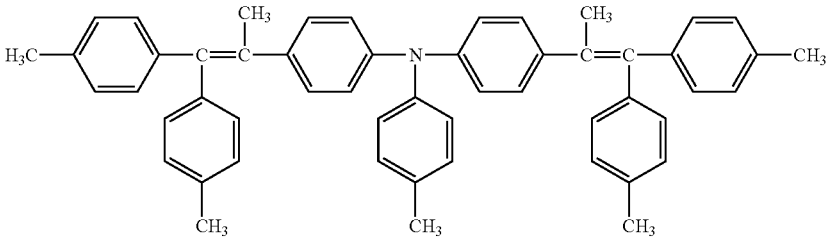

Comparative Example 8

Production of Electrophotographic Photoconductor

An electrophotographic photoconductor of Comparative Example 8 was produced in a similar manner to that described in Comparative Example 2, except that the charge transporting material for the charge transporting layer and the surface protective layer was changed to a charge transporting material No. 52 having the following structural formula (oxidation potential: 0.75V vs SCE, melting point: 193° C.).

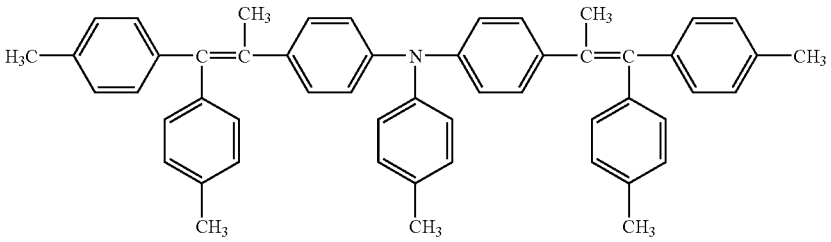

Comparative Example 9

Production of Electrophotographic Photoconductor

An electrophotographic photoconductor of Comparative Example 9 was produced in a similar manner to that described in Comparative Example 1, except that the charge transporting material for the charge transporting layer and the surface protective layer was changed to a charge transporting material No. 12 having the following structural formula (oxidation potential: 0.74V vs SCE, melting point: 183° C.).

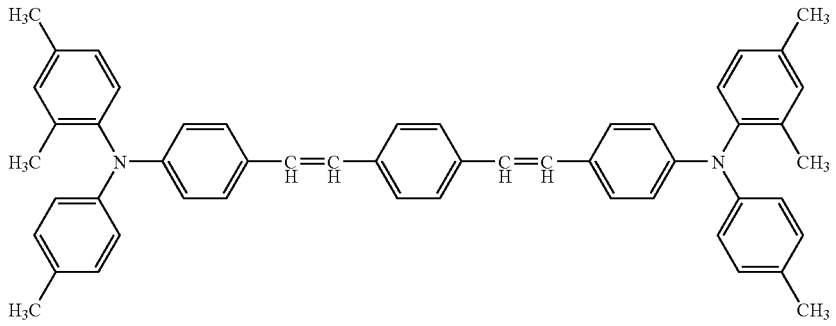

Comparative Example 10

Production of Electrophotographic Photoconductor

An electrophotographic photoconductor of Comparative Example 10 was produced in a similar manner to that described in Comparative Example 2, except that the charge transporting material for the charge transporting layer and the surface protective layer was changed to a charge transporting material No. 12 having the following structural formula (oxidation potential: 0.74V vs SCE, melting point: 183° C.).

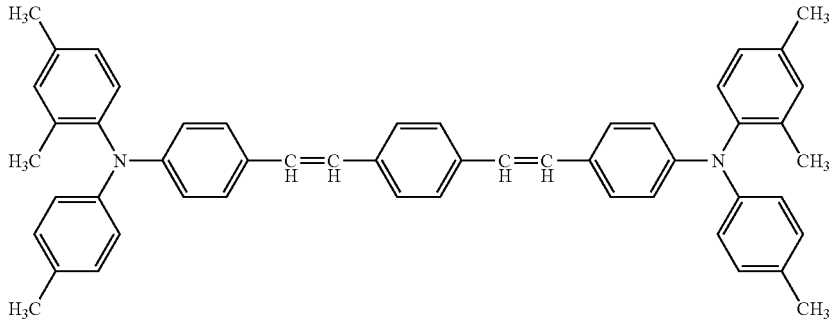

Comparative Example 11

Production of Electrophotographic Photoconductor

An electrophotographic photoconductor of Comparative Example 11 was produced in a similar manner to that described in Comparative Example 1, except that the charge transporting material for the charge transporting layer and the surface protective layer was changed to a charge transporting material No. 14 having the following structural formula (oxidation potential: 0.73V vs SCE, melting point: 211° C.).

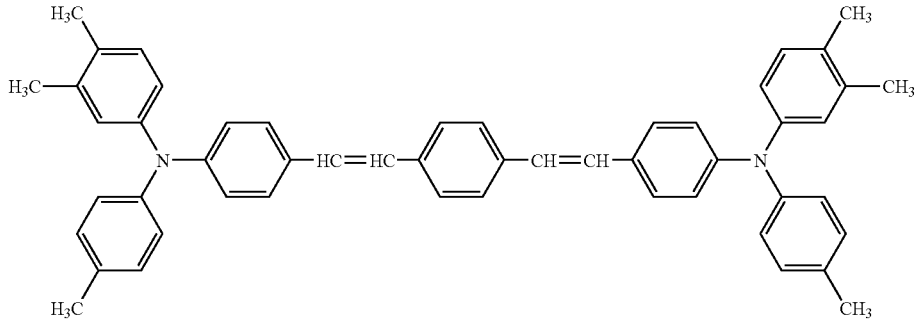

Comparative Example 12

Production of Electrophotographic Photoconductor

An electrophotographic photoconductor of Comparative Example 12 was produced in a similar manner to that described in Comparative Example 2, except that the charge transporting material for the charge transporting layer and the surface protective layer was changed to a charge transporting material No. 14 having the following structural formula (oxidation potential: 0.73V vs SCE, melting point: 211° C.).

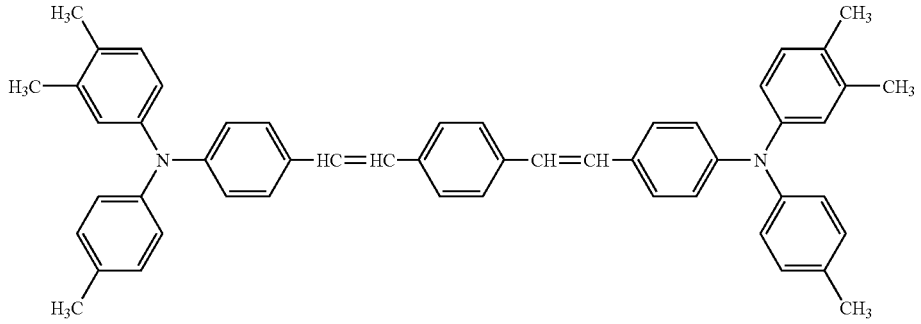

Comparative Example 13

Production of Electrophotographic Photoconductor

An electrophotographic photoconductor of Comparative Example 13 was produced in a similar manner to that described in Comparative Example 1, except that the charge transporting material for the surface protective layer was changed to a charge transporting material having the following structural formula (oxidation potential: 0.80V vs SCE, melting point: 139.5° C.).

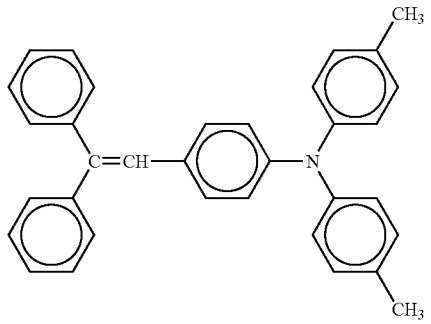

Comparative Example 14

Production of Electrophotographic Photoconductor

An electrophotographic photoconductor of Comparative Example 14 was produced in a similar manner to that described in Comparative Example 3, except that the charge transporting material for the surface protective layer was changed to a charge transporting material having the following structural formula (oxidation potential: 0.76V vs SCE, melting point: 165.5° C.).

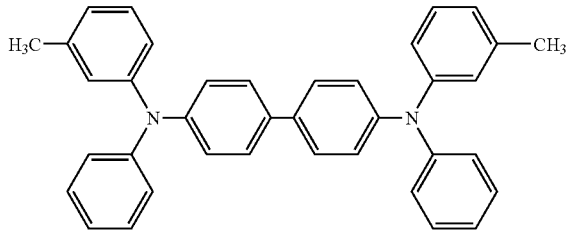

Example 1

Production of Electrophotographic Photoconductor

An electrophotographic photoconductor of Example 1 was produced in a similar manner to that described in Comparative Example 7, except that is the charge transporting material for the surface protective layer was changed to a charge transporting material having the following structural formula (oxidation potential: 0.89V vs SCE, melting point: 93.5° C.).

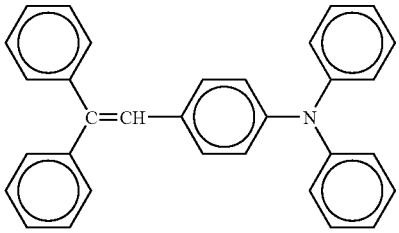

Example 2

Production of Electrophotographic Photoconductor

An electrophotographic photoconductor of Example 2 was produced in a similar manner to that described in Comparative Example 8, except that the charge transporting material for the surface protective layer was changed to a charge transporting material having the following structural formula (oxidation potential: 0.89V vs SCE, melting point: 93.5° C.).

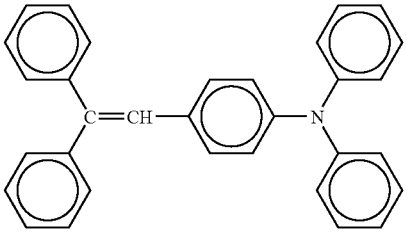

Example 3

Production of Electrophotographic Photoconductor

An electrophotographic photoconductor of Example 3 was produced in a similar manner to that described in Comparative Example 9, except that the charge transporting material for the surface protective layer was changed to a charge transporting material having the following structural formula (oxidation potential: 0.89V vs SCE, melting point: 93.5° C.).

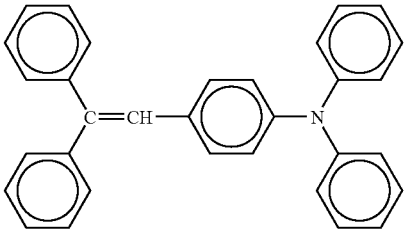

Example 4

Production of Electrophotographic Photoconductor

An electrophotographic photoconductor of Example 4 was produced in a similar manner to that described in Comparative Example 10, except that the charge transporting material for the surface protective layer was changed to a charge transporting material having the following structural formula (oxidation potential: 0.89V vs SCE, melting point: 93.5° C.).

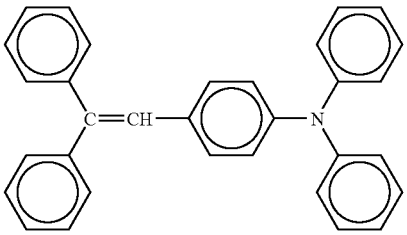

Example 5

Production of Electrophotographic Photoconductor

An electrophotographic photoconductor of Example 5 was produced in a similar manner to that described in Comparative Example 11, except that the charge transporting material for the surface protective layer was changed to a charge transporting material having the following structural formula (oxidation potential: 0.89V vs SCE, melting point: 93.5° C.).

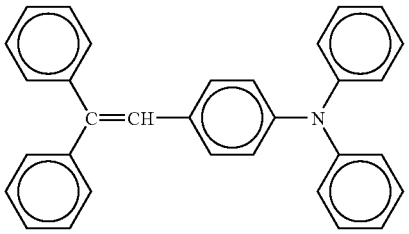

Example 6

Production of Electrophotographic Photoconductor

An electrophotographic photoconductor of Example 6 was produced in a similar manner to that described in Comparative Example 12, except that the charge transporting material for the surface protective layer was changed to a charge transporting material having the following structural formula (oxidation potential: 0.89V vs SCE, melting point: 93.5° C.).

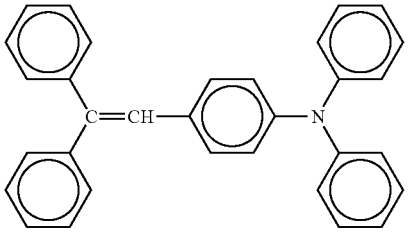

Example 7

Production of Electrophotographic Photoconductor

An electrophotographic photoconductor of Example 7 was produced in a similar manner to that described in Comparative Example 7, except that the charge transporting material for the surface protective layer was changed to a charge transporting material having the following structural formula (oxidation potential: 0.80V vs SCE, melting point: 139.5° C.).

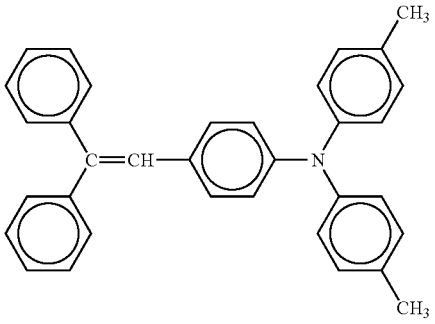

Example 8

Production of Electrophotographic Photoconductor

An electrophotographic photoconductor of Example 8 was produced in a similar manner to that described in Comparative Example 8, except that the charge transporting material for the surface protective layer was changed to a charge transporting material having the following structural formula (oxidation potential: 0.80V vs SCE, melting point: 139.5° C.).

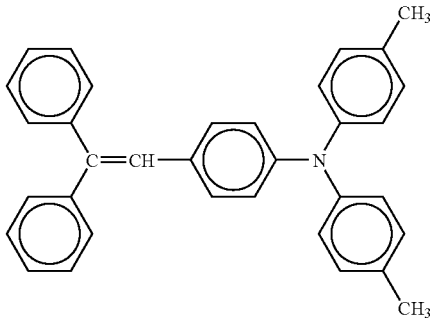

Example 9

Production of Electrophotographic Photoconductor

An electrophotographic photoconductor of Example 9 was produced in a similar manner to that described in Comparative Example 9, except that the charge transporting material for the surface protective layer was changed to a charge transporting material having the following structural formula (oxidation potential: 0.80V vs SCE, melting point: 139.5° C.).

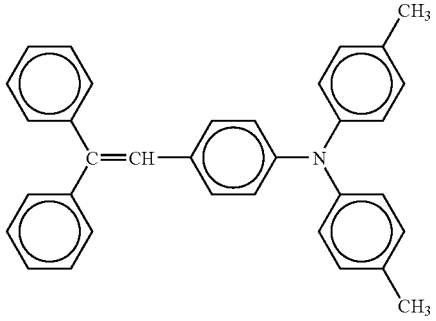

Example 10

Production of Electrophotographic Photoconductor

An electrophotographic photoconductor of Example 10 was produced in a similar manner to that described in Comparative Example 10, except that the charge transporting material for the surface protective layer was changed to a charge transporting material having the following structural formula (oxidation potential: 0.80V vs SCE, melting point: 139.5° C.).

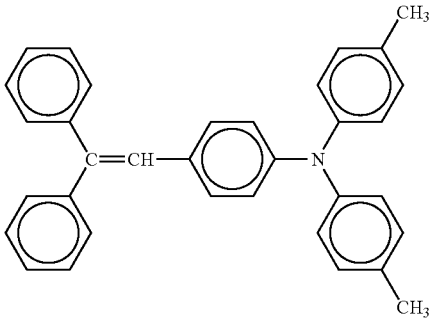

Example 11

Production of Electrophotographic Photoconductor

An electrophotographic photoconductor of Example 11 was produced in a similar manner to that described in Comparative Example 11, except that the charge transporting material for the surface protective layer was changed to a charge transporting material having the following structural formula (oxidation potential: 0.80V vs SCE, melting point: 139.5° C.).

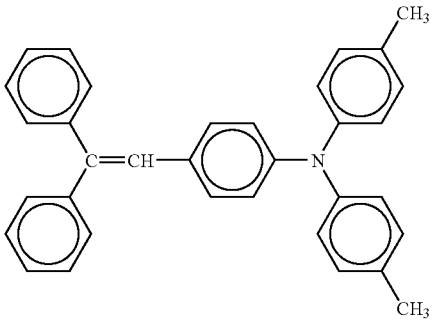

Example 12

Production of Electrophotographic Photoconductor

An electrophotographic photoconductor of Example 12 was produced in a similar manner to that described in Comparative Example 12, except that the charge transporting material for the surface protective layer was changed to a charge transporting material having the following structural formula (oxidation potential: 0.80V vs SCE, melting point: 139.5° C.).

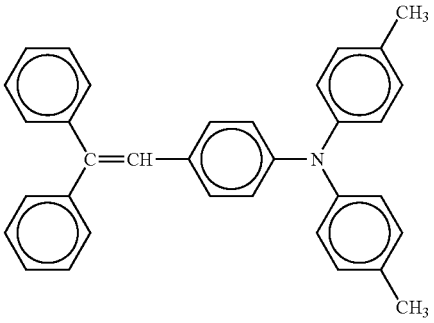

Example 13

Production of Electrophotographic Photoconductor

An electrophotographic photoconductor of Example 13 was produced in a similar manner to that described in Comparative Example 7, except that the charge transporting material for the surface protective layer was changed to a charge transporting material having the following structural formula (oxidation potential: 0.76V vs SCE, melting point: 165.5° C.).

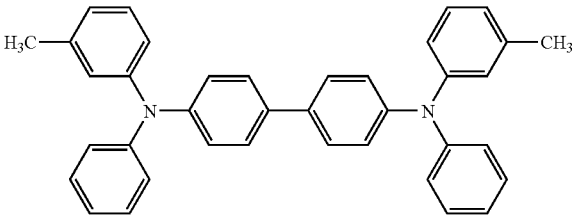

Example 14

Production of Electrophotographic Photoconductor

An electrophotographic photoconductor of Example 14 was produced in a similar manner to that described in Comparative Example 8, except that the charge transporting material for the surface protective layer was changed to a charge transporting material having the following structural formula (oxidation potential: 0.76V vs SCE, melting point: 165.5° C.).

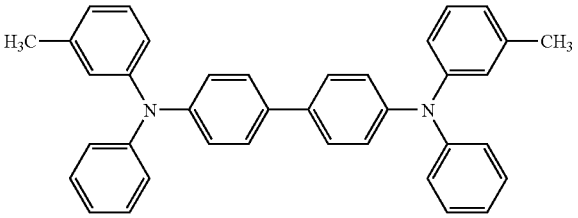

Example 15

Production of Electrophotographic Photoconductor

An electrophotographic photoconductor of Example 15 was produced in a similar manner to that described in Comparative Example 9, except that the charge transporting material for the surface protective layer was changed to a charge transporting material having the following structural formula (oxidation potential: 0.76V vs SCE, melting point: 165.5° C.).

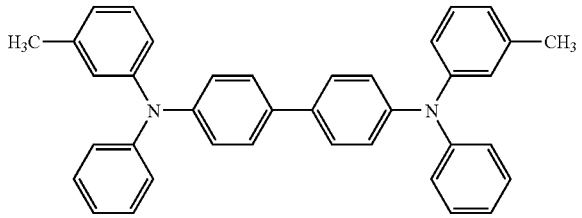

Example 16

Production of Electrophotographic Photoconductor

An electrophotographic photoconductor of Example 16 was produced in a similar manner to that described in Comparative Example 10, except that the charge transporting material for the surface protective layer was changed to a charge transporting material having the following structural formula (oxidation potential: 0.76V vs SCE, melting point: 165.5° C.).

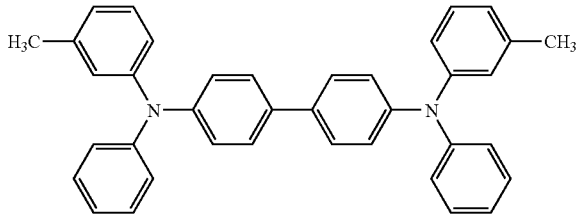

Example 17

Production of Electrophotographic Photoconductor

An electrophotographic photoconductor of Example 17 was produced in a similar manner to that described in Comparative Example 11, except that the charge transporting material for the surface protective layer was changed to a charge transporting material having the following structural formula (oxidation potential: 0.76V vs SCE, melting point: 165.5° C.).

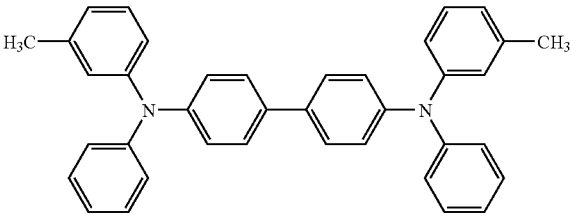

Example 18

Production of Electrophotographic Photoconductor

An electrophotographic photoconductor of Example 18 was produced in a similar manner to that described in Comparative Example 12, except that the charge transporting material for the surface protective layer was changed to a charge transporting material having the following structural formula (oxidation potential: 0.76V vs SCE, melting point: 165.5° C.).

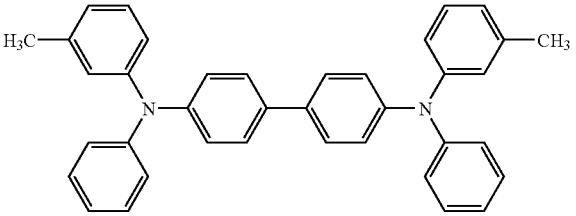

Example 19

Production of Electrophotographic Photoconductor

An electrophotographic photoconductor of Example 19 was produced in a similar manner to that described in Comparative Example 1, except that the charge transporting material for the charge transporting layer was changed to a charge transporting material No. 7 having the following structural formula (oxidation potential: 0.71V vs SCE, melting point: 214° C.), and the charge transporting material for the surface protective layer was changed to a charge transporting material having the following structural formula (oxidation potential: 0.80V vs SCE, melting point: 139.5° C.).

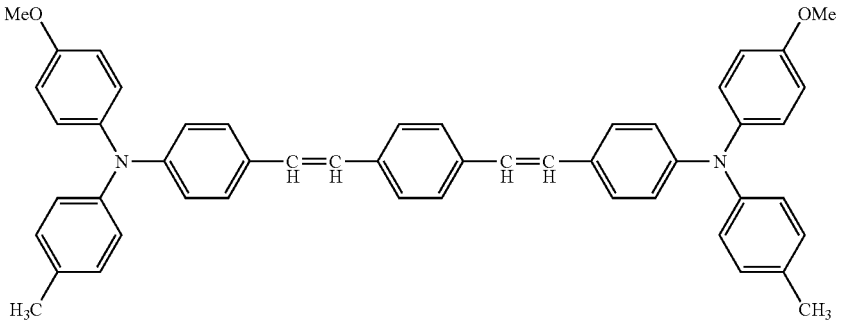

-continued

Me represents a methyl group.

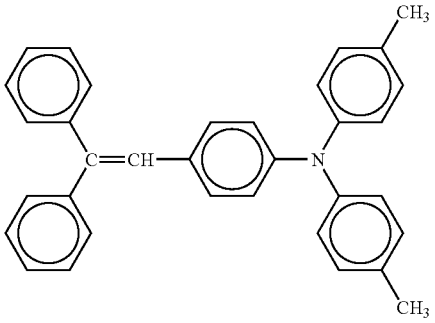

Example 20

Production of Electrophotographic Photoconductor

An electrophotographic photoconductor of Example 20 was produced in a similar manner to that described in Comparative Example 1, except that the charge transporting material for the charge transporting layer was changed to a charge transporting material No. 5 having the following structural formula (oxidation potential: 0.67V vs SCE, melting point: 178° C.), and the charge transporting material for the surface protective layer was changed to a charge transporting material having the following structural formula (oxidation potential: 0.80V vs SCE, melting point: 139.5° C.).

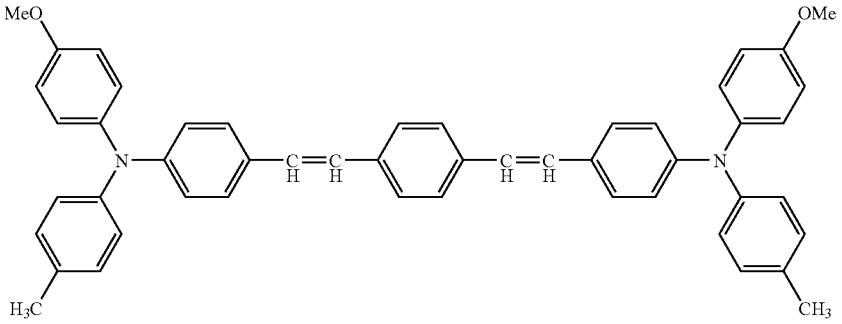

Me represents a methyl group.

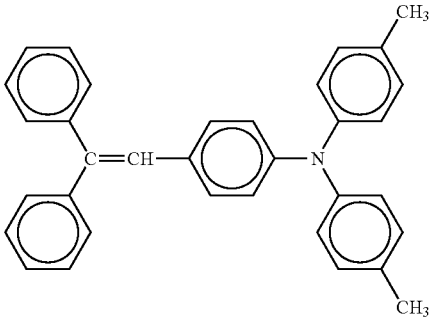

Example 21

Production of Electrophotographic Photoconductor

An electrophotographic photoconductor of Example 21 was produced in a similar manner to that described in Example 9, except that the thickness of the surface protective layer was changed to 8 μm.

Example 22

Production of Electrophotographic Photoconductor

An electrophotographic photoconductor of Example 22 was produced in a similar manner to that described in Example 9, except that the thickness of the surface protective layer was changed to 2 μm.

Example 23

Production of Electrophotographic Photoconductor

An electrophotographic photoconductor of Example 23 was produced in a similar manner to that described in Example 9, except that the amount of the charge transporting material added in the charge transporting layer was changed to 8.5 parts by mass.

Example 24

Production of Electrophotographic Photoconductor

An electrophotographic photoconductor of Example 24 was produced in a similar manner to that described in Example 11, except that the amount of the charge transporting material added in the charge transporting layer was changed to 8.5 parts by mass.

Example 25

Production of Electrophotographic Photoconductor

An electrophotographic photoconductor of Example 25 was produced in a similar manner to that described in Example 9, except that the amount of the charge transporting material added in the charge transporting layer was changed to 10 parts by mass.

Example 26

Production of Electrophotographic Photoconductor

An electrophotographic photoconductor of Example 26 was produced in a similar manner to that described in Example 11, except that the amount of the charge transporting material added in the charge transporting layer was changed to 10 parts by mass.

Example 27

Production of Electrophotographic Photoconductor

An electrophotographic photoconductor of Example 27 was produced in a similar manner to that described in Example 23, except that in the charge transporting layer, an additive (melting point: 69° C.) having the following structural formula was added in an amount of 2.5% by mass to the charge transporting material contained in the charge transporting layer.

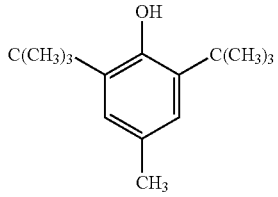

Example 28

Production of Electrophotographic Photoconductor

An electrophotographic photoconductor of Example 28 was produced in a similar manner to that described in Example 24, except that in the charge transporting layer, an additive (melting point: 62.5° C.) having the following structural formula was added in an amount of 2.5% by mass to the charge transporting material contained in the charge transporting layer.

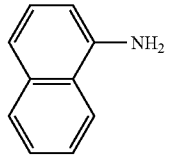

Example 29

Production of Electrophotographic Photoconductor

An electrophotographic photoconductor of Example 29 was produced in a similar manner to that described in Example 23, except that in the charge transporting layer, an additive (melting point: 69° C.) having the following structural formula was added in an amount of 5% by mass to the charge transporting material contained in the charge transporting layer.

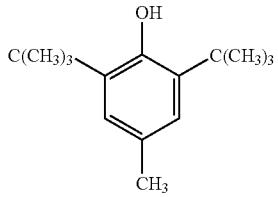

Example 30

Production of Electrophotographic Photoconductor

An electrophotographic photoconductor of Example 30 was produced in a similar manner to that described in Example 24, except that in the charge transporting layer, an additive (melting point: 62.5° C.) having the following structural formula was added in an amount of 5% by mass to the charge transporting material contained in the charge transporting layer.

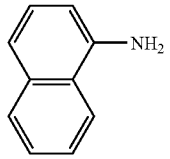

Example 31

Production of Electrophotographic Photoconductor

An electrophotographic photoconductor of Example 31 was produced in a similar manner to that described in Example 23, except that in the charge transporting layer, an additive (melting point: 137.5° C.) having the following structural formula was added in an amount of 5% by mass to the charge transporting material contained in the charge transporting layer.

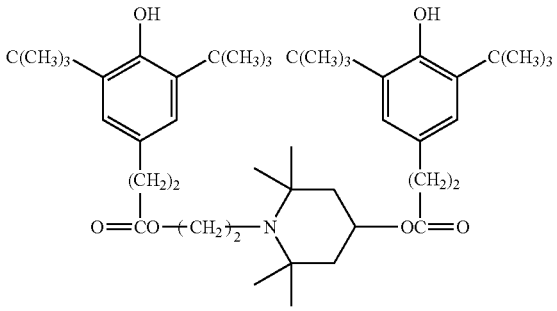

Example 32

Production of Electrophotographic Photoconductor

An electrophotographic photoconductor of Example 32 was produced in a similar manner to that described in Example 23, except that in the charge transporting layer, two types of additive each having the following structural formula were each added in an amount of 2.5% by mass to the charge transporting material contained in the charge transporting layer.

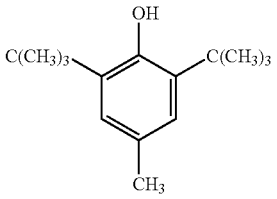

(melting point: 69° C.)

-continued

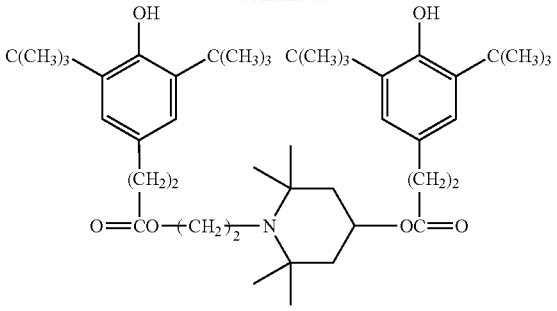

(melting point: 137.5° C.)

Example 33

Production of Electrophotographic Photoconductor

An electrophotographic photoconductor of Example 33 was produced in a similar manner to that described in Example 24, except that in the charge transporting layer, two types of additive each having the following structural formula were each added in an amount of 2.5% by mass to the charge transporting material contained in the charge transporting layer.

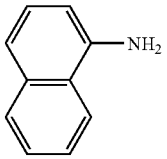

(melting point: 62.5° C.)

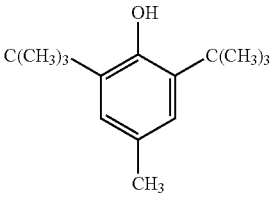

(melting point: 69° C.)

Example 34

Production of Electrophotographic Photoconductor

An electrophotographic photoconductor of Example 34 was produced in a similar manner to that described in Example 9, except that in the charge transporting layer, an additive (melting point: 69° C.) having the following structural formula was added in an amount of 10% by mass to the charge transporting material contained in the charge transporting layer.

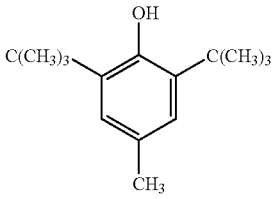

Example 35

Production of Electrophotographic Photoconductor

An electrophotographic photoconductor of Example 35 was produced in a similar manner to that described in Example 11, except that in the charge transporting layer, an additive (melting point: 62.5° C.) having the following structural formula was added in an amount of 10% by mass to the charge transporting material contained in the charge transporting layer.

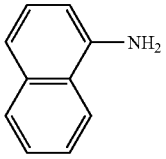

Example 36

Production of Electrophotographic Photoconductor

An electrophotographic photoconductor of Example 36 was produced in a similar manner to that described in Example 9, except that in the charge transporting layer, an additive (melting point: 137.5° C.) having the following structural formula was added in an amount of 10% by mass to the charge transporting material contained in the charge transporting layer.

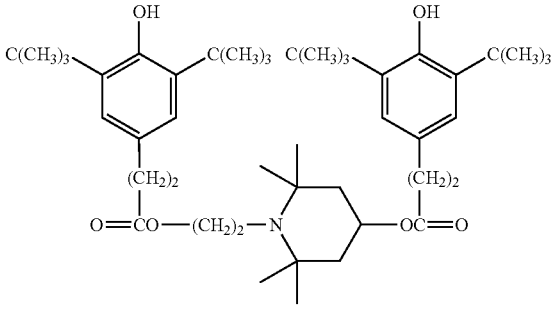

The physical properties and the additive amount of the charge transporting materials and the additives used in each of the electrophotographic photoconductors produced as above are shown in Tables 1-1, 1-2 and 1-3.

TABLE 1-1

| | Charge Transporting Layer | | | | | Surface Protective Layer | | |
|---|---|---|---|---|---|---|---|---|
| | Charge transporting material | | | Additive | Additive amount (% by mass vs charge transporting material) | Charge transporting material | | |
| | Oxidation potential (V) | Additive amount (% by mass vs binder resin) | Melting point (° C.) | Melting point (° C.) | | Oxidation potential (V) | Melting point (° C.) | Difference in oxidation potential |
| Ex. 1 | 0.75 | 70 | 193 | — | — | 0.89 | 93.5 | 0.14 |
| Ex. 2 | 0.75 | 70 | 193 | — | — | 0.89 | 93.5 | 0.14 |
| Ex. 3 | 0.74 | 70 | 183 | — | — | 0.89 | 93.5 | 0.15 |
| Ex. 4 | 0.74 | 70 | 183 | — | — | 0.89 | 93.5 | 0.15 |
| Ex. 5 | 0.73 | 70 | 211 | — | — | 0.89 | 93.5 | 0.16 |
| Ex. 6 | 0.73 | 70 | 211 | — | — | 0.89 | 93.5 | 0.16 |
| Ex. 7 | 0.75 | 70 | 193 | — | — | 0.80 | 139.5 | 0.05 |
| Ex. 8 | 0.75 | 70 | 193 | — | — | 0.80 | 139.5 | 0.05 |
| Ex. 9 | 0.74 | 70 | 183 | — | — | 0.80 | 139.5 | 0.06 |
| Ex. 10 | 0.74 | 70 | 183 | — | — | 0.80 | 139.5 | 0.06 |
| Ex. 11 | 0.73 | 70 | 211 | — | — | 0.80 | 139.5 | 0.07 |
| Ex. 12 | 0.73 | 70 | 211 | — | — | 0.80 | 139.5 | 0.07 |
| Ex. 13 | 0.75 | 70 | 193 | — | — | 0.76 | 165.5 | 0.01 |
| Ex. 14 | 0.75 | 70 | 193 | — | — | 0.76 | 165.5 | 0.01 |
| Ex. 15 | 0.74 | 70 | 183 | — | — | 0.76 | 165.5 | 0.02 |
| Ex. 16 | 0.74 | 70 | 183 | — | — | 0.76 | 165.5 | 0.02 |
| Ex. 17 | 0.73 | 70 | 211 | — | — | 0.76 | 165.5 | 0.03 |
| Ex. 18 | 0.73 | 70 | 211 | — | — | 0.76 | 165.5 | 0.03 |

TABLE 1-2

| | Charge Transporting Layer | | | | | Surface Protective Layer | | |
|---|---|---|---|---|---|---|---|---|
| | Charge transporting material | | | Additive | | Charge transporting material | | |
| | Oxidation potential (V) | Additive amount (% by mass vs binder resin) | Melting point (° C.) | Melting point (° C.) | Additive amount (% by mass vs charge transporting material) | Oxidation potential (V) | Melting point (° C.) | Difference in oxidation potential |
| Ex. 19 | 0.71 | 70 | 214 | — | — | 0.80 | 139.5 | 0.09 |
| Ex. 20 | 0.67 | 70 | 178 | — | — | 0.80 | 139.5 | 0.13 |
| Ex. 21 | 0.74 | 70 | 183 | — | — | 0.80 | 139.5 | 0.06 |
| Ex. 22 | 0.74 | 70 | 183 | — | — | 0.80 | 139.5 | 0.06 |
| Ex. 23 | 0.74 | 85 | 183 | — | — | 0.80 | 139.5 | 0.06 |
| Ex. 24 | 0.73 | 85 | 211 | — | — | 0.80 | 139.5 | 0.07 |
| Ex. 25 | 0.74 | 100 | 183 | — | — | 0.80 | 139.5 | 0.06 |
| Ex. 26 | 0.73 | 100 | 211 | — | — | 0.80 | 139.5 | 0.07 |
| Ex. 27 | 0.74 | 85 | 183 | 69 | 2.5 | 0.80 | 139.5 | 0.06 |
| Ex. 28 | 0.73 | 85 | 211 | 62.5 | 2.5 | 0.80 | 139.5 | 0.07 |
| Ex. 29 | 0.74 | 85 | 183 | 69 | 5 | 0.80 | 139.5 | 0.06 |
| Ex. 30 | 0.73 | 85 | 211 | 62.5 | 5 | 0.80 | 139.5 | 0.07 |
| Ex. 31 | 0.74 | 85 | 183 | 137.5 | 5 | 0.80 | 139.5 | 0.06 |
| Ex. 32 | 0.74 | 85 | 183 | 69, 137.5 | Total 5 (2.5 each) | 0.80 | 139.5 | 0.06 |
| Ex. 33 | 0.73 | 85 | 211 | 62.5, 69 | Total 5 (2.5 each) | 0.80 | 139.5 | 0.07 |
| Ex. 34 | 0.74 | 70 | 183 | 69 | 10 | 0.80 | 139.5 | 0.06 |
| Ex. 35 | 0.73 | 70 | 211 | 62.5 | 10 | 0.80 | 139.5 | 0.07 |
| Ex. 36 | 0.74 | 70 | 183 | 137.5 | 10 | 0.80 | 139.5 | 0.06 |

TABLE 1-3

| | Charge Transporting Layer | | | | | Surface Protective Layer | | |
|---|---|---|---|---|---|---|---|---|
| | Charge transporting material | | | Additive | | Charge transporting material | | |
| | Oxidation potential (V) | Additive amount (% by mass vs binder resin) | Melting point (° C.) | Melting point (° C.) | Additive amount (% by mass vs charge transporting material) | Oxidation potential (V) | Melting point (° C.) | Difference in oxidation potential |
| Compara. Ex. 1 | 0.89 | 70 | 93.5 | — | — | 0.89 | 93.5 | 0.00 |
| Compara. Ex. 2 | 0.89 | 70 | 93.5 | — | — | 0.89 | 93.5 | 0.00 |
| Compara. Ex. 3 | 0.80 | 70 | 139.5 | — | — | 0.80 | 139.5 | 0.00 |
| Compara. Ex. 4 | 0.80 | 70 | 139.,5 | — | — | 0.80 | 139.5 | 0.00 |
| Compara. Ex. 5 | 0.76 | 70 | 165.5 | — | — | 0.76 | 165.5 | 0.00 |
| Compara. Ex. 6 | 0.76 | 70 | 165.5 | — | — | 0.76 | 165.5 | 0.00 |
| Compara. Ex. 7 | 0.75 | 70 | 193 | — | — | 0.75 | 193 | 0.00 |
| Compara. Ex. 8 | 0.75 | 70 | 193 | — | — | 0.75 | 193 | 0.00 |
| Compara. Ex. 9 | 0.74 | 70 | 183 | — | — | 0.74 | 183 | 0.00 |
| Compara. Ex. 10 | 0.74 | 70 | 183 | — | — | 0.74 | 183 | 0.00 |
| Compara. Ex. 11 | 0.73 | 70 | 211 | — | — | 0.73 | 211 | 0.00 |
| Compara. Ex. 12 | 0.73 | 70 | 211 | — | — | 0.73 | 211 | 0.00 |
| Compara. Ex. 13 | 0.89 | 70 | 93.5 | — | — | 0.80 | 139.5 | −0.09 |
| Compara. Ex. 14 | 0.80 | 70 | 139.5 | — | — | 0.76 | 165.5 | −0.04 |

* "Difference in oxidation potential" in Tables 1-1, 1-2 and 1-3 is a value calculated by the expression: (oxidation potential of the charge transporting material contained the surface protective layer) − (oxidation potential of the charge transporting material contained in the charge transporting layer).

<Evaluation by Means of Image Forming Apparatus>

Each of the electrophotographic photoconductors of Comparative Examples 1 to 14 and Examples 1 to 36 produced as above was mounted to a process cartridge, and the process cartridge was mounted to a remodeled machine of a full-color digital printer (IPSIO CX8100, manufactured by Ricoh Company Ltd.) which had been remodeled so that the charging method was changed to a chargeable corona charging method (a scorotron type charging unit), and as a light source for exposing image, a semiconductor laser having a wavelength of 780 nm was employed. In the remodeled machine, dark-area potential was set to 800 (−V), and the energy of the laser applied to image surface was adjusted to 0.43 ($\mu J/cm^2$). Thereafter, a running test was performed to output 50,000 sheets of A4 lateral paper for a test image having an image area ratio of 5% at a resolution as high as 600 dpi. The quality (character blur) of the images during printing was visually observed for evaluation. Further, bright-area potentials VL were measured in the initial stage of the printing and after printing 50,000 sheets. Furthermore, the abraded amount obtained from a difference in film thickness of the electrophotographic photoconductors in the initial stage and after printing 50,000 sheets was evaluated using an eddy-current thickness meter (FISHER SCOPE MMS (manufactured by Fisher AG). The measurement results are shown in Tables 2-1, 2-2, and 2-3.

<Evaluation of Image Blur>

A Teflon™ tape was affixed to part of each of the obtained electrophotographic photoconductors, and the electrophotographic photoconductors were left standing for four days in a desiccator whose inside had been adjusted so as to be 50 ppm in concentration of nitrogen oxide gas. Thereafter, after setting each of the electrophotographic photoconductors in the full-color printer (remodeled machine of IPSIO CX8100, manufactured by Ricoh Company Ltd.), a halftone image was output by the printer. Then, a difference in image density between the tape-affixed portion and non-tape-affixed portions was obtained for evaluation as an indicator of image blurring. The image density was measured using a colorimeter (X-RITE939, manufactured by X-RITE Co.). The measurement results are shown in Tables 2-1, 2-2 and 2-3.

<Evaluation of Crack Resistance>

The surface state of each of the obtained electrophotographic photoconductors was visually observed and evaluated based on the following criteria. The evaluation results are shown in Tables 2-1, 2-2, and 2-3.

[Evaluation Criteria]

Grade A: No cracks were found.

Grade 4: Very small crack-like flaws were slightly found.

Grade 3: A small number of cracks were clearly recognized.

Grade 2: A number of cracks were clearly found all over the surface of the electrophotographic photoconductor.

Furthermore, upon completion of the evaluation by means of the image forming apparatus, whether or not the presence of cracks could cause an abnormal image was confirmed. The results were shown in the column of "Abnormal image caused by cracks" in Tables 2-1, 2-2, and 2-3.

TABLE 2-1

| | Evaluation by Image Forming Apparatus | | | | | | | Grade on |
|---|---|---|---|---|---|---|---|---|
| | Initial VL (−V) | VL after running test (−V) | ΔVL (V) | Abraded amount (μm) | Image quality (character blur) | Abnormal image caused by crack | Image blur Difference in image density | crack by visual observation |
| Ex. 1 | 152 | 192 | 40 | 0.56 | No problem | No problem | 0.006 | 5 |
| Ex. 2 | 144 | 187 | 42 | 0.50 | No problem | No problem | 0.009 | 5 |
| Ex. 3 | 135 | 156 | 21 | 0.32 | No problem | No problem | 0.014 | 5 |
| Ex. 4 | 134 | 152 | 18 | 0.46 | No problem | No problem | 0.012 | 5 |
| Ex. 5 | 109 | 126 | 17 | 0.37 | No problem | No problem | 0.010 | 4 |
| Ex. 6 | 104 | 117 | 13 | 0.39 | No problem | No problem | 0.013 | 4 |
| Ex. 7 | 138 | 174 | 36 | 0.29 | No problem | No problem | 0.025 | 4 |
| Ex. 8 | 141 | 177 | 36 | 0.36 | No problem | No problem | 0.017 | 4 |
| Ex. 9 | 126 | 146 | 20 | 0.28 | No problem | No problem | 0.022 | 3-4 |
| Ex. 10 | 129 | 147 | 19 | 0.31 | No problem | No problem | 0.021 | 3-4 |
| Ex. 11 | 112 | 125 | 13 | 0.43 | No problem | No problem | 0.011 | 3 |
| Ex. 12 | 100 | 112 | 12 | 0.50 | No problem | No problem | 0.012 | 3 |
| Ex. 13 | 143 | 176 | 33 | 0.42 | No problem | No problem | 0.032 | 4 |
| Ex. 14 | 142 | 179 | 36 | 0.29 | No problem | No problem | 0.036 | 3 |
| Ex. 15 | 127 | 141 | 15 | 0.53 | No problem | No problem | 0.035 | 3 |
| Ex. 16 | 119 | 133 | 14 | 0.47 | No problem | No problem | 0.030 | 3 |
| Ex. 17 | 102 | 113 | 11 | 0.44 | No problem | Very small background smear occurred on white parts | 0.034 | 2-3 |
| Ex. 18 | 109 | 118 | 9 | 0.24 | No problem | Very small background smear occurred on white parts | 0.038 | 2-3 |

TABLE 2-2

| | Evaluation by Image Forming Apparatus | | | | | | | Grade on |
|---|---|---|---|---|---|---|---|---|
| | Initial VL (−V) | VL after running test (−V) | ΔVL (V) | Abraded amount (μm) | Image quality (character blur) | Abnormal image caused by crack | Image blur Difference in image density | crack by visual observation |
| Ex. 19 | 85 | 93 | 8 | 0.35 | No problem | No problem | 0.035 | 2-3 |
| Ex. 20 | 83 | 95 | 12 | 0.23 | No problem | No problem | 0.037 | 4 |
| Ex. 21 | 130 | 186 | 56 | 0.39 | No problem | No problem | 0.013 | 3-4 |
| Ex. 22 | 129 | 146 | 17 | 0.35 | No problem | No problem | 0.022 | 3-4 |
| Ex. 23 | 126 | 140 | 14 | 0.23 | No problem | No problem | 0.025 | 4-5 |
| Ex. 24 | 103 | 112 | 9 | 0.35 | No problem | No problem | 0.031 | 4 |
| Ex. 25 | 109 | 121 | 11 | 0.57 | No problem | No problem | 0.024 | 5 |
| Ex. 26 | 88 | 98 | 10 | 0.51 | No problem | No problem | 0.036 | 5 |
| Ex. 27 | 121 | 142 | 21 | 0.46 | No problem | No problem | 0.017 | 5 |
| Ex. 28 | 98 | 112 | 15 | 0.55 | No problem | No problem | 0.016 | 4-5 |
| Ex. 29 | 131 | 153 | 23 | 0.54 | No problem | No problem | 0.019 | 5 |
| Ex. 30 | 104 | 123 | 18 | 0.40 | No problem | No problem | 0.027 | 5 |
| Ex. 31 | 127 | 148 | 22 | 0.36 | No problem | No problem | 0.020 | 5 |
| Ex. 32 | 130 | 152 | 22 | 0.42 | No problem | No problem | 0.009 | 5 |
| Ex. 33 | 114 | 139 | 26 | 0.53 | No problem | No problem | 0.015 | 5 |
| Ex. 34 | 148 | 183 | 35 | 0.22 | No problem | No problem | 0.011 | 5 |
| Ex. 35 | 133 | 164 | 31 | 0.30 | No problem | No problem | 0.010 | 5 |
| Ex. 36 | 131 | 159 | 28 | 0.22 | No problem | No problem | 0.013 | 5 |

TABLE 2-3

| | Evaluation by Image Forming Apparatus | | | | | | Image blur | Grade on |
|---|---|---|---|---|---|---|---|---|
| | Initial VL (−V) | VL after running test (−V) | ΔVL (V) | Abraded amount (μm) | Image quality (character blur) | Abnormal image caused by crack | Difference in image density | crack by visual observation |
| Compara. Ex. 1 | 177 | 243 | 66 | 0.47 | No problem | No problem | 0.006 | 5 |
| Compara. Ex. 2 | 175 | 238 | 63 | 0.44 | No problem | No problem | 0.017 | 5 |
| Compara. Ex. 3 | 165 | 223 | 57 | 0.55 | No problem | No problem | 0.011 | 5 |
| Compara. Ex. 4 | 157 | 210 | 54 | 0.48 | No problem | No problem | 0.016 | 5 |
| Compara. Ex. 5 | 156 | 212 | 56 | 0.57 | No problem | No problem | 0.027 | 5 |
| Compara. Ex. 6 | 157 | 212 | 55 | 0.48 | No problem | No problem | 0.027 | 5 |
| Compara. Ex. 7 | 143 | 178 | 35 | 0.51 | Image blur slightly occurred after the 50,000 sheet running | Light-colored short streaks occurred on white parts | 0.057 | 1-2 |
| Compara. Ex. 8 | 140 | 174 | 34 | 0.38 | Image blur slightly occurred after the 50,000 sheet running | Light-colored short streaks occurred on white parts | 0.062 | 1-2 |
| Compara. Ex. 9 | 120 | 135 | 15 | 0.39 | Image blur slightly occurred after the 40,000 sheet running | Light-colored short streaks occurred on white parts | 0.094 | 1 |
| Compara. Ex. 10 | 126 | 142 | 16 | 0.52 | Image blur slightly occurred after the 40,000 sheet running | Light-colored short streaks occurred on white parts | 0.090 | 1 |
| Compara. Ex. 11 | 93 | 103 | 10 | 0.37 | Image blur slightly occurred after the 40,000 sheet running | Light-colored crack-like streaks occurred on white parts | 0.112 | 1 |
| Compara. Ex. 12 | 93 | 101 | 8 | 0.44 | Image blur slightly occurred after the 40,000 sheet running | Light-colored crack-like streaks occurred on white parts | 0.111 | 1 |
| Compara. Ex. 13 | 181 | 255 | 74 | 0.51 | No problem | No problem | 0.015 | 5 |
| Compara. Ex. 14 | 168 | 243 | 75 | 0.55 | No problem | No problem | 0.028 | 5 |

From the results shown in Tables 2-1, 2-2 and 2-3, it was found that the electrophotographic photoconductors of Comparative Examples 1 to 12 caused conspicuous blurred images due to ozone, NOx or other oxidative substances caused by the repetitive use of the electrophotographic photoconductor and the surrounding environment, although the effect of reducing the initial potential VL and the effect of suppressing an increase in residual potential VL were obtained because the compound represented by any one of General Formulas (3) and (4) exhibited high hole mobility and the charge transporting material having a low oxidation potential was contained in the photosensitive layer and the surface protective layer. It was also found that as the oxidation potential of the charge transporting material contained in the surface protective layer lowered, image blur was liable to occur. The electrophotographic photoconductors of Comparative Examples 13 and 14 had a high initial residual potential VL and caused a great increase in residual potential due to the repetitive use.

In contrast, in the electrophotographic photoconductors of Examples 1 to 36, a charge transporting material having a low oxidation potential is contained in a photosensitive layer, and a charge transporting material having an oxidation potential lower than that of the charge transporting material contained in the photosensitive layer is contained in a surface protective layer. It has been generally considered that a difference in oxidation potential of the charge transporting materials contained both layers forms a barrier to charge injection, which leads to a reduction in charge transportability, resulting in an increase in initial residual potential VL and residual potential VL during repetitive use. However, it was demonstrated in the running test that when the surface protective layer has a thickness as thick as 8 μm, the increase in initial residual potential VL and residual potential VL during repetitive use can be suppressed.

Further, an electrophotographic photoconductor provided with a photosensitive layer and a surface protective layer using the above-mentioned charge transporting materials is likely to cause cracks at the interface between the photosensitive layer and the surface protective layer. Some electrophotographic photoconductors of Examples underwent visually observed cracks on their surfaces, and the presence of cracks did not influence the image quality. However, in order to impart high durability to a photoconductor, it is more preferable to prevent the occurrence of cracks. It was also found that by using a charge transporting material having a melting point of 170° C. or lower in its surface protective layer, as in the electrophotographic photoconductors of Comparative Examples 7 to 12 and Examples 1 to 22, increasing the additive amount of the charge transporting material contained in its photosensitive layer to 70% by mass or more, as in the electrophotographic photoconductors of Examples 22 to 36, and further adding a low molecular weight additive having a melting point of 150° C. or lower in an amount of 2.5% by mass to 10% by mass to the additive amount of the charge transporting material contained in the photosensitive layer, it is possible to suppress the occurrence of cracks, and the photoconductor becomes to have a favorable formulation.

As demonstrated above, it was confirmed that even when a photosensitive layer contains a charge transporting material represented by any one of General Formulas (3) and (4), it is possible to reduce the occurrence of image blurring as well as to suppress an increase in residual potential due to repetitive use, by incorporating a charge transporting material having an oxidation potential higher than that of the charge transporting material contained in the photosensitive layer in its surface protective layer and further incorporating a compound represented by any one of General Formulas (1) and (2) in the surface protective layer. It was also confirmed that an employment of the photoconductor formulation of the present invention in an electrophotographic photoconductor in which a filler is contained in its surface protective layer in view of achieving the high durability makes it possible to reduce the initial residual potential, to prevent image degradation due to the occurrence of image blurring, to suppress the increase in residual potential, and to stably obtain high-quality images.

Examples 37 to 50 and Comparative Examples 15 to 28

Evaluation by Means of Image Forming Apparatus 2

Each of the produced electrophotographic photoconductors shown in Tables 3-1 and 3-2 was mounted to a process cartridge, and the process cartridge was mounted to a remodeled machine II of a full-color digital printer (IPSIO CX8100, manufactured by Ricoh Company Ltd.) which had been remodeled so that the charging method was changed to a chargeable corona charging method (a scorotron type charging unit), and as a light source for exposing image, a laser array was employed in which surface emitting lasers were two-dimensionally arrayed in 4×4. In the remodeled machine II, dark-area potential was set to 800 (−V), and the energy of the laser applied to image surface was adjusted to 0.43 (μJ/cm$^2$). Thereafter, a running test was performed to output 50,000 sheets of A4 lateral paper for a test image having an image area ratio of 5% at a resolution as high as 1,200 dpi. The quality (character blur) of the images during printing was visually observed for evaluation. Further, bright-area potentials VL were measured in the initial stage of the printing and after printing 50,000 sheets. Furthermore, the abraded amount obtained from a difference in film thickness of the electrophotographic photoconductors in the initial stage and after printing 50,000 sheets was evaluated using an eddy-current thickness meter (FISHER SCOPE MMS (manufactured by Fisher AG). The results are shown in Tables 3-1 and 3-2.

<Evaluation of Image Blur 2>

A Teflon™ tape was affixed to part of each of the obtained electrophotographic photoconductors, and the electrophotographic photoconductors were left standing for four days in a desiccator whose inside had been adjusted so as to be 50 ppm in concentration of nitrogen oxide gas. Thereafter, after setting each of the electrophotographic photoconductors in the full-color printer (remodeled machine II of IPSIO CX8100, manufactured by Ricoh Company Ltd.), a halftone image was output by the printer. Then, a difference in image density between the tape-affixed portion and non-tape-affixed portions was obtained for evaluation as an indicator of image blurring. The image density was measured using a calorimeter (X-RITE939, manufactured by X-RITE Co.). The measurement results are shown in Tables 3-1 and 3-2.

<Evaluation of Crack Resistance>

The surface state of each of the obtained electrophotographic photoconductors was visually observed and evaluated based on the following criteria. The evaluation results are shown in Tables 3-1 and 3-2.

[Evaluation Criteria]

Grade A: No cracks were found.

Grade 4: Very small crack-like flaws were slightly found.

Grade 3: A small number of cracks were clearly recognized.

Grade 2: A number of cracks were clearly found all over the surface of the electrophotographic photoconductor.

Furthermore, upon completion of the evaluation by means of the full color printer (remodeled machine II of IPSIO CX8100 manufactured by Ricoh Company Ltd.), whether or not the presence of cracks could cause an abnormal image was confirmed. The results were shown in the column of "Abnormal image caused by cracks" in Tables 3-1 and 3-2.

TABLE 3-1

| | | Evaluation by Image Forming Apparatus | | | | | | Image blur Difference | Grade on |
|---|---|---|---|---|---|---|---|---|---|
| | Photoconductor used | Initial VL (−V) | VL after running test (−V) | VL (−V) | Abraded amount (μm) | Image quality (character blur) | Abnormal image caused by crack | in image density | crack by visual observation |
| Ex. 37 | Example 23 | 134 | 150 | 17 | 0.15 | No problem | No problem | 0.025 | 4-5 |
| Ex. 38 | Example 24 | 105 | 118 | 13 | 0.51 | No problem | No problem | 0.033 | 4 |
| Ex. 39 | Example 25 | 116 | 134 | 18 | 0.49 | No problem | No problem | 0.025 | 5 |
| Ex. 40 | Example 26 | 92 | 105 | 13 | 0.74 | No problem | No problem | 0.037 | 5 |
| Ex. 41 | Example 27 | 124 | 152 | 28 | 0.62 | No problem | No problem | 0.018 | 5 |
| Ex. 42 | Example 28 | 104 | 125 | 21 | 0.60 | No problem | No problem | 0.017 | 4-5 |
| Ex. 43 | Example 29 | 135 | 165 | 30 | 0.74 | No problem | No problem | 0.020 | 5 |
| Ex. 44 | Example 30 | 111 | 135 | 25 | 0.60 | No problem | No problem | 0.028 | 5 |
| Ex. 45 | Example 31 | 132 | 161 | 29 | 0.41 | No problem | No problem | 0.021 | 5 |
| Ex. 46 | Example 32 | 133 | 159 | 25 | 0.41 | No problem | No problem | 0.010 | 5 |
| Ex. 47 | Example 33 | 117 | 148 | 30 | 0.72 | No problem | No problem | 0.016 | 5 |
| Ex. 48 | Example 34 | 152 | 191 | 39 | 0.13 | No problem | No problem | 0.012 | 5 |
| Ex. 49 | Example 35 | 139 | 175 | 36 | 0.15 | No problem | No problem | 0.011 | 5 |
| Ex. 50 | Example 36 | 136 | 171 | 35 | 0.32 | No problem | No problem | 0.014 | 5 |

TABLE 3-2

| | | Evaluation by Image Forming Apparatus | | | | | | Image blur | Grade on |
|---|---|---|---|---|---|---|---|---|---|
| | Photoconductor used | Initial VL (−V) | VL after running test (−V) | VL (−V) | Abraded amount (μm) | Image quality (character blur) | Abnormal image caused by crack | Difference in image density | crack by visual observation |
| Compara. Ex. 15 | Compara. Ex. 1 | 185 | 256 | 71 | 0.42 | No problem | No problem | 0.022 | 5 |
| Compara. Ex. 16 | Compara. Ex. 2 | 180 | 249 | 70 | 0.64 | No problem | No problem | 0.046 | 5 |

TABLE 3-2-continued

| | Photoconductor used | Evaluation by Image Forming Apparatus: Initial VL (−V) | VL after running test (−V) | VL (−V) | Abraded amount (μm) | Image quality (character blur) | Abnormal image caused by crack | Image blur: Difference in image density | Grade on crack by visual observation |
|---|---|---|---|---|---|---|---|---|---|
| Compara. Ex. 17 | Compara. Ex. 3 | 172 | 236 | 64 | 0.76 | No problem | No problem | 0.021 | 5 |
| Compara. Ex. 18 | Compara. Ex. 4 | 163 | 222 | 60 | 0.71 | No problem | No problem | 0.043 | 5 |
| Compara. Ex. 19 | Compara. Ex. 5 | 162 | 226 | 63 | 0.57 | No problem | No problem | 0.053 | 5 |
| Compara. Ex. 20 | Compara. Ex. 6 | 160 | 218 | 58 | 0.44 | No problem | No problem | 0.054 | 5 |
| Compara. Ex. 21 | Compara. Ex. 7 | 149 | 191 | 42 | 0.51 | Image blur partially occurred after the 40,000 sheet running | Light-colored crack-like streaks occurred on white parts | 0.082 | 1-2 |
| Compara. Ex. 22 | Compara. Ex. 8 | 147 | 184 | 38 | 0.52 | Image blur partially occurred after the 40,000 sheet running | Light-colored crack-like streaks occurred on white parts | 0.083 | 1-2 |
| Compara. Ex. 23 | Compara. Ex. 9 | 124 | 143 | 19 | 0.33 | Image blur partially occurred after the 35,000 sheet running | Light-colored crack-like streaks occurred on white parts | 0.112 | 1 |
| Compara. Ex. 24 | Compara. Ex. 10 | 133 | 156 | 23 | 0.70 | Image blur partially occurred after the 35,000 sheet running | Light-colored crack-like streaks occurred on white parts | 0.104 | 1 |
| Compara. Ex. 25 | Compara. Ex. 11 | 98 | 111 | 14 | 0.31 | Image blur partially occurred after the 30,000 sheet running | Light-colored crack-like streaks occurred on white parts | 0.139 | 1 |
| Compara. Ex. 26 | Compara. Ex. 12 | 97 | 108 | 11 | 0.58 | Image blur partially occurred after the 20,000 sheet running | Light-colored crack-like streaks occurred on white parts | 0.137 | 1 |
| Compara. Ex. 27 | Compara. Ex. 13 | 187 | 267 | 79 | 0.28 | No problem | No problem | 0.027 | 5 |
| Compara. Ex. 28 | Compara. Ex. 14 | 171 | 253 | 81 | 0.74 | No problem | No problem | 0.041 | 5 |

In an image forming apparatus using a surface emitting laser of 1,200 dpi, it was also confirmed that even when a photosensitive layer contains a charge transporting material represented by any one of General Formulas (3) and (4), it is possible to reduce the occurrence of image blurring as well as to suppress an increase in residual potential due to repetitive use, by incorporating a charge transporting material having an oxidation potential higher than that of the charge transporting material contained in the photosensitive layer in its surface protective layer and further incorporating a compound represented by any one of General Formulas (1) and (2) in the surface protective layer. It was also confirmed that an employment of the photoconductor formulation of the present invention in an electrophotographic photoconductor in which a filler is contained in its surface protective layer in view of achieving the high durability makes it possible to reduce the initial residual potential, to prevent image degradation due to the occurrence of image blurring, to suppress the increase in residual potential, and to stably obtain high-quality images.

The electrophotographic photoconductor of the present invention can reduce the initial residual potential to allow achievement of higher-speed operation in an image forming apparatus, can reduce image degradation due to the occurrence of image blurring, can suppress an increase in residual potential, and can stably form high-quality images even in repetitive use thereof for a long period of time, and thus it can be suitably used in laser printers, digital copiers, full color copiers, full color laser printers etc., each using electrophotography.

What is claimed is:

1. An electrophotographic photoconductor comprising:

a support;

at least a photosensitive layer; and a surface protective layer, the photosensitive layer and the surface protective layer being laid over the support, wherein the surface protective layer comprises a filler, a charge transporting material, and a compound represented by any one of General Formulas (1) and (2), and wherein the photosensitive layer comprises at least a charge transporting material having an oxidation potential lower than the oxidation potential of the charge transporting material contained in the surface protective layer and is a compound represented by General Formula (3), General Formula (1)

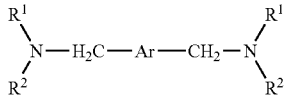

wherein:

$R^1$ and $R^2$ may be identical to or different from each other, each represent any one of an alkyl group that may have a substituent and an aryl group that may have a substituent;

at least one of $R^1$ and $R^2$ is an aryl group that may have a substituent;

$R^1$ and $R^2$ may be bonded to each other to form a heterocyclic ring containing a nitrogen atom, and the heterocyclic ring may be further substituted with a substituent; and Ar represents an allylene group that may have a substituent, General Formula (2)

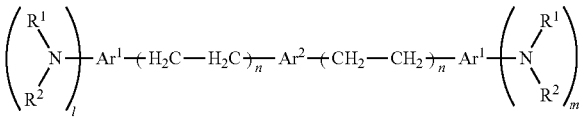

wherein:

$R^1$ and $R^2$ may be identical to or different from each other, each represent any one of an alkyl group that may have a substituent and an aryl group that may have a substituent;

$R^1$ and $R^2$ may be bonded to each other to form a heterocyclic ring containing a nitrogen atom, and the heterocyclic ring may be further substituted with a substituent;

$Ar^1$ and $Ar^2$ each represent an allylene group that may have a substituent;

l and m each represent an integer of 0 to 3, both of which are not zero at the same time; and n is an integer of 1 or 2, General Formula (3)

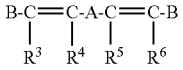

wherein:

$R^3$ to $R^6$ each represent any one of a hydrogen atom, an alkyl group having 1 to 4 carbon atoms, an alkoxy group having 1 to 4 carbon atoms, and a phenyl group that may have a substituent; and A represents any one of an allylene group that may have a substituent and a substituent represented by Structural Formula (3-1), Structural Formula (3-1)

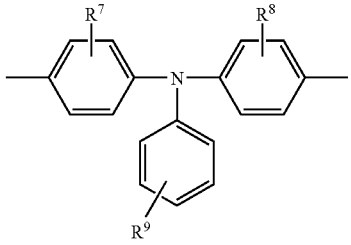

wherein:

$R^7$, $R^8$ and $R^9$ each represent any one of a hydrogen atom, an alkyl group having 1 to 4 carbon atoms, an alkoxy group having 1 to 4 carbon atoms, and a phenyl group, the phenyl group may be further substituted with a substituent; and B represents any one of an aryl group that may have a substituent, and a substituent represented by Structural Formula (3-2), Structural Formula (3-2)

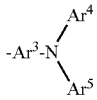

wherein:

$Ar^3$ represents an allylene group that may have a substituent; and $Ar^4$ and $Ar^5$ each represent an aryl group that may have a substituent.

2. The electrophotographic photoconductor according to claim 1, wherein the charge transporting material contained in the photosensitive layer is a distyrylbenzene derivative represented by General Formula (4), General Formula (4)

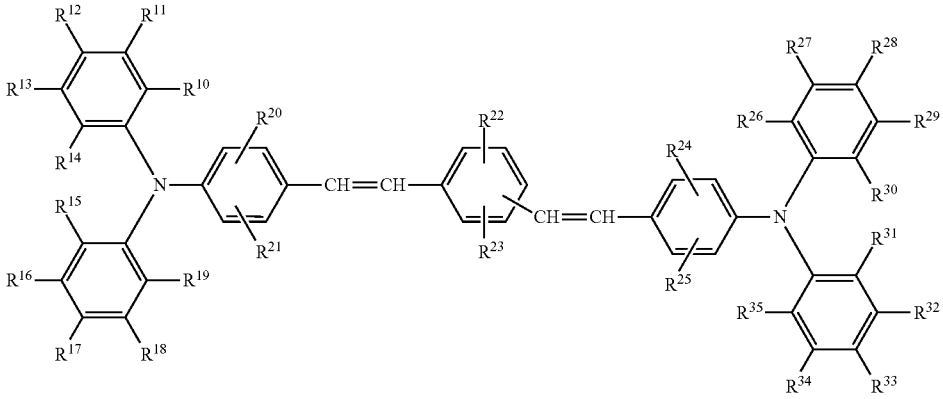

wherein:

$R^{10}$ to $R^{35}$ may be identical to or different from each other, and each represent any one of a hydrogen atom, an alkyl group having 1 to 4 carbon atoms, an alkoxy group having 1 to 4 carbon atoms, and a phenyl group that may have a substituent.

3. The electrophotographic photoconductor according to claim 1, wherein the photosensitive layer comprises a charge generating material comprising a titanylphthalocyanine pigment.

4. The electrophotographic photoconductor according to claim 3, wherein the titanylphthalocyanine pigment has an X-ray diffraction spectrum by a CuKα characteristic X-ray with a wavelength of 1.541 angstroms, having a maximum diffraction peak at least at a Bragg angle of 27.2° among their Bragg angles (2θ±0.2°), main diffraction peaks at Bragg angles of 9.4°, 9.6° and 24.0° and a diffraction peak at the smallest Bragg angle of 7.3°, and having no diffraction peaks at Bragg angles between 7.3° and 9.4° and at 26.3°.

5. The electrophotographic photoconductor according to claim 1, wherein a difference in oxidation potential between the charge transporting material contained in the surface protective layer and the charge transporting material contained in the photosensitive layer is within the range of 0.01 V to 0.20 V.

6. The electrophotographic photoconductor according to claim 1, wherein the charge transporting material contained in the surface protective layer has a melting point of 170° C. or lower.

7. The electrophotographic photoconductor according to claim 1, wherein the amount of the charge transporting material contained in the photosensitive layer is 65 parts by mass or more relative to 100 parts by mass of a resin contained in the photosensitive layer.

8. The electrophotographic photoconductor according to claim 1, wherein the photosensitive layer contains an additive having a melting point of 150° C. or lower, and the amount of the additive is 2.5 parts by mass to 10 parts by mass relative to 100 parts by mass of the charge transporting material contained in the photosensitive layer.

9. The electrophotographic photoconductor according to claim 8, wherein the additive contained in the photosensitive layer is at least one of compounds having any one of Structural Formulas (1) to (3), Structural Formula (1)

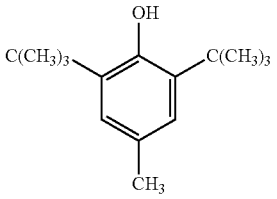

Structural Formula (2)

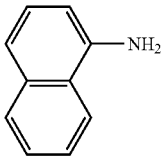

Structural Formula (3)

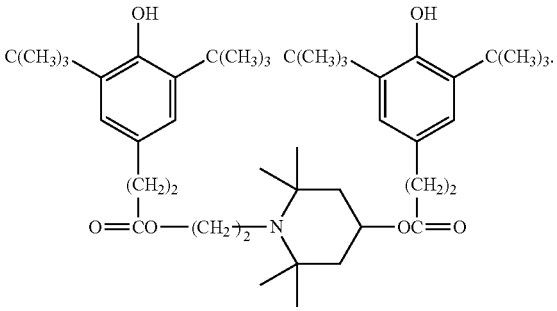

10. The electrophotographic photoconductor according to claim 2, wherein the charge transporting material contained in the photosensitive layer and represented by any one of General Formulas (3) and (4) has a melting point of 170° C. to 240° C.

11. The electrophotographic photoconductor according to claim 1, wherein the filler contains at least one selected from metal oxides.

12. The electrophotographic photoconductor according to claim 1, wherein the filler has an average primary particle diameter of 0.01 μm to 1.0 μm.

13. The electrophotographic photoconductor according to claim 1, wherein the amount of the filler contained in the surface protective layer is 5% by mass to 50% by mass.

14. The electrophotographic photoconductor according to claim 1, wherein the surface protective layer contains an organic compound having an acid value of 10 mgKOH/g to 700 mgKOH/g.

15. The electrophotographic photoconductor according to claim 1, wherein the surface protective layer has a thickness of 0.1 μm to 10 μm.

16. The electrophotographic photoconductor according to claim 2, wherein the photosensitive layer comprises a charge generating layer and a charge transporting layer, and the charge transporting layer contains a charge transporting material represented by any one of General Formulas (3) and (4).

17. An image forming apparatus comprising:

an electrophotographic photoconductor;

a charging unit configured to charge a surface of the electrophotographic photoconductor;

an exposing unit configured to expose the charged surface of the electrophotographic photoconductor to form a latent electrostatic image;

a developing unit configured to develop the latent electrostatic image using a toner to form a visible image;

a transfer unit configured to transfer the visible image onto a recording medium; and a fixing unit configured to fix the transferred image on the recording medium, wherein the electrophotographic photoconductor comprises a support, at least a photosensitive layer, and a surface protective layer, the photosensitive layer and the surface protective layer being laid over the support, wherein the surface protective layer comprises a filler, a charge transporting material, and a compound represented by any one of General Formulas (1) and (2), and wherein the photosensitive layer comprises at least a charge transporting material having an oxidation potential lower than the oxidation potential of the charge transporting material contained in the surface protective layer and is a compound represented by General Formula (3), General Formula (1)

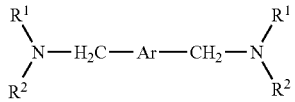

wherein:

$R^1$ and $R^2$ may be identical to or different from each other, each represent any one of an alkyl group that may have a substituent and an aryl group that may have a substituent;

at least one of $R^1$ and $R^2$ is an aryl group that may have a substituent;

$R^1$ and $R^2$ may be bonded to each other to form a heterocyclic ring containing a nitrogen atom, and the heterocyclic ring may be further substituted with a substituent; and Ar represents an allylene group that may have a substituent, General Formula (2)

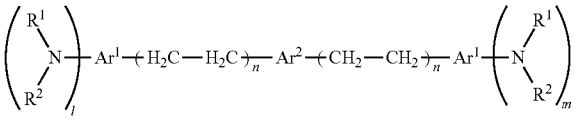

wherein:

$R^1$ and $R^2$ may be identical to or different from each other, each represent any one of an alkyl group that may have a substituent and an aryl group that may have a substituent;

$R^1$ and $R^2$ may be bonded to each other to form a heterocyclic ring containing a nitrogen atom, and the heterocyclic ring may be further substituted with a substituent;

$Ar^1$ and $Ar^2$ each represent an allylene group that may have a substituent; l and m each represent an integer of 0 to 3, both of which are not zero at the same time; and n is an integer of 1 or 2, General Formula (3)

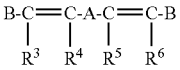

wherein:

$R^3$ to $R^6$ each represent any one of a hydrogen atom, an alkyl group having 1 to 4 carbon atoms, an alkoxy group having 1 to 4 carbon atoms, and a phenyl group that may have a substituent; and A represents any one of an allylene group that may have a substituent and a substituent represented by Structural Formula (3-1), Structural Formula (3-1)

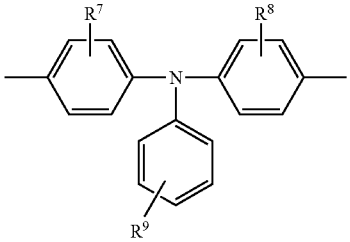

wherein:

$R^7$, $R^8$, and $R^9$ each represent any one of a hydrogen atom, an alkyl group having 1 to 4 carbon atoms, an alkoxy group having 1 to 4 carbon atoms, and a phenyl group, the phenyl group may be further substituted with a substituent; and B represents any one of an aryl group that may have a substituent, and a substituent represented by Structural Formula (3-2), Structural Formula (3-2)

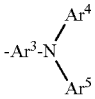

wherein:

$Ar^3$ represents an allylene group that may have a substituent; and $Ar^4$ and $Ar^5$ each represent an aryl group that may have a substituent.

18. A process cartridge detachably mounted to a main body of an image forming apparatus, the process cartridge comprising:

at least one selected from a charging unit, an exposing unit, a developing unit, a transfer unit, a cleaning unit, and a charge eliminating unit; and an electrophotographic photoconductor, wherein the electrophotographic photoconductor comprises a support, at least a photosensitive layer, and a surface protective layer, the photosensitive layer and the surface protective layer being laid over the support, wherein the surface protective layer comprises a filler, a charge transporting material, and a compound represented by any one of General Formulas (1) and (2), and wherein the photosensitive layer comprises at least a charge transporting material having an oxidation potential lower than the oxidation potential of the charge transporting material contained in the surface protective layer and is a compound represented by General Formula (3), General Formula (1)

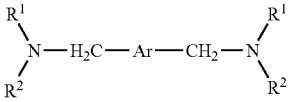

wherein:

$R^1$ and $R^2$ may be identical to or different from each other, each represent any one of an alkyl group that may have a substituent and an aryl group that may have a substituent;

at least one of $R^1$ and $R^2$ is an aryl group that may have a substituent;

$R^1$ and $R^2$ may be bonded to each other to form a heterocyclic ring containing a nitrogen atom, and the heterocyclic ring may be further substituted with a substituent; and Ar represents an allylene group that may have a substituent, General Formula (2)

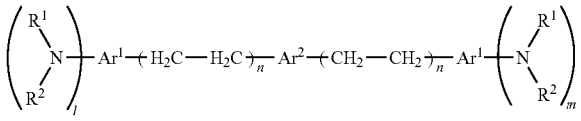

wherein:

$R^1$ and $R^2$ may be identical to or different from each other, each represent any one of an alkyl group that may have a substituent and an aryl group that may have a substituent;

$R^1$ and $R^2$ may be bonded to each other to form a heterocyclic ring containing a nitrogen atom, and the heterocyclic ring may be further substituted with a substituent;

$Ar^1$ and $Ar^2$ each represent an allylene group that may have a substituent;

l and m each represent an integer of 0 to 3, both of which are not zero at the same time; and n is an integer of 1 or 2, General Formula (3)

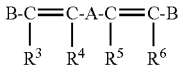

wherein:

$R^3$ to $R^6$ each represent any one of a hydrogen atom, an alkyl group having 1 to 4 carbon atoms, an alkoxy group having 1 to 4 carbon atoms, and a phenyl group that may have a substituent; and A represents any one of an allylene group that may have a substituent and a substituent represented by Structural Formula (3-1), Structural Formula (3-1)

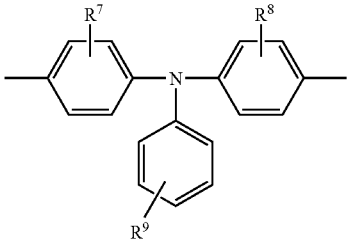

wherein:

$R^7$, $R^8$ and $R^9$ each represent any one of a hydrogen atom, an alkyl group having 1 to 4 carbon atoms, an alkoxy group having 1 to 4 carbon atoms, and a phenyl group, the phenyl group may be further substituted with a substituent; and B represents any one of an aryl group that may have a substituent, and a substituent represented by Structural Formula (3-2), Structural Formula (3-2)

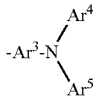

wherein $Ar^3$ represents an allylene group that may have a substituent; and $Ar^4$ and $Ar^5$ each represent an aryl group that may have a substituent.

* * * * *